US007939232B2

(12) United States Patent
Yuasa et al.

(10) Patent No.: US 7,939,232 B2
(45) **Date of Patent: *May 10, 2011**

(54) TONER, PROCESS FOR PRODUCING TONER, AND TWO-COMPONENT DEVELOPING AGENT

(75) Inventors: Yasuhito Yuasa, Osaka (JP); Hidekazu Arase, Hyogo (JP); Masahisa Maeda, Osaka (JP)

(73) Assignee: Panasonic Corporation, Osaka (JP)

( * ) Notice: Subject to any disclaimer, the term of this patent is extended or adjusted under 35 U.S.C. 154(b) by 693 days.

This patent is subject to a terminal disclaimer.

(21) Appl. No.: 11/816,219

(22) PCT Filed: Nov. 1, 2005

(86) PCT No.: PCT/JP2005/020136

§ 371 (c)(1),
(2), (4) Date: Aug. 14, 2007

(87) PCT Pub. No.: WO2006/087847

PCT Pub. Date: Aug. 24, 2006

(65) Prior Publication Data

US 2009/0035681 A1 Feb. 5, 2009

(30) Foreign Application Priority Data

Feb. 17, 2005 (JP) ..... 2005-040164

(51) Int. Cl.
*G03G 9/08* (2006.01)

(52) U.S. Cl. ..... 430/108.4; 430/108.8; 430/109.1; 430/110.1; 430/110.2; 430/110.4; 430/111.32; 430/111.35

(58) Field of Classification Search ..... 430/108.4, 430/108.8, 109.1, 110.1, 110.4, 111.32, 111.35, 430/110.2

See application file for complete search history.

(56) References Cited

U.S. PATENT DOCUMENTS

| | | | | |
|---|---|---|---|---|
| 5,567,561 | A | 10/1996 | Yoshikawa et al. | |
| 5,998,078 | A | 12/1999 | Suwabe et al. | |
| 6,808,851 | B2 * | 10/2004 | Bartel et al. | 430/108.1 |
| 7,459,254 | B2 * | 12/2008 | Yuasa et al. | 430/110.1 |
| 7,560,214 | B2 * | 7/2009 | Yuasa et al. | 430/110.4 |
| 7,645,550 | B2 * | 1/2010 | Yuasa et al. | 430/108.4 |

(Continued)

FOREIGN PATENT DOCUMENTS

| | | |
|---|---|---|
| JP | 10-198070 | 7/1998 |

(Continued)

*Primary Examiner* — Hoa V Le

(74) *Attorney, Agent, or Firm* — Hamre, Schumann, Mueller & Larson, P.C.

(57) ABSTRACT

A toner or two-component developer is obtained by mixing, aggregating, and heating resin particles, colorant particles, and wax particles in an aqueous medium. A gel permeation chromatography (GPC) measurement of the resin particles shows that a weight-average molecular weight is 10000 to 60000, and the ratio of the weight-average molecular weight to a number-average molecular weight is 1.5 to 6. The wax particles include at least a first wax and a second wax. An endothermic peak temperature (melting point Tmw1 (° C.)) of the first wax based on a DSC method is 50° C. to 90° C. An endothermic peak temperature (melting point Tmw2 (° C.)) of the second wax based on the DSC method is at least 5° C. to 50° C. higher than Tmw1. Thus, the toner can have a smaller particle size and a sharp particle size distribution without requiring a classification process, can achieve a longer life, and can suppress transfer voids or scattering during transfer.

9 Claims, 4 Drawing Sheets

U.S. PATENT DOCUMENTS

| | | | | |
|---|---|---|---|---|
| 2001/0002305 | A1 | 5/2001 | Yuasa et al. | |
| 2001/0033982 | A1 | 10/2001 | Ishikawa et al. | |
| 2002/0039699 | A1 | 4/2002 | Nishimori et al. | |
| 2002/0064724 | A1 | 5/2002 | Nakamura et al. | |
| 2003/0091923 | A1 | 5/2003 | Kobayashi et al. | |
| 2004/0142263 | A1* | 7/2004 | Mikuriya et al. | 430/108.2 |
| 2004/0265718 | A1* | 12/2004 | Nakamura et al. | 430/108.4 |
| 2005/0058927 | A1* | 3/2005 | Mikuriya et al. | 430/110.2 |
| 2005/0074685 | A1* | 4/2005 | Kido et al. | 430/110.2 |
| 2005/0196694 | A1* | 9/2005 | Yuasa et al. | 430/108.4 |
| 2005/0287461 | A1* | 12/2005 | Sweeney et al. | 430/108.22 |
| 2006/0014094 | A1* | 1/2006 | Yuasa et al. | 430/108.2 |
| 2006/0051695 | A1* | 3/2006 | Yuasa et al. | 430/111.35 |
| 2008/0160443 | A1* | 7/2008 | Yuasa et al. | 430/110.4 |
| 2009/0004589 | A1* | 1/2009 | Yuasa et al. | 430/108.8 |
| 2009/0035682 | A1* | 2/2009 | Shima et al. | 430/108.4 |

FOREIGN PATENT DOCUMENTS

| | | |
|---|---|---|
| JP | 2801507 | 7/1998 |
| JP | 2000-10337 | 1/2000 |
| JP | 2001-134017 | 5/2001 |
| JP | 2001-154405 | 6/2001 |
| JP | 2001-235894 | 8/2001 |
| JP | 2002-23429 | 1/2002 |
| JP | 2002-116574 | 4/2002 |
| JP | 2002-229252 | 8/2002 |
| JP | 2003-43732 | 2/2003 |
| JP | 3399294 | 2/2003 |
| JP | 2004-191598 | 7/2004 |
| JP | 2004-198862 | 7/2004 |
| JP | 2005-31506 | 2/2005 |

* cited by examiner

TONER, PROCESS FOR PRODUCING TONER, AND TWO-COMPONENT DEVELOPING AGENT

TECHNICAL FIELD

The present invention relates to a toner as a color material used, e.g., in copiers, laser printers, plain paper facsimiles, color copiers, color laser printers, color facsimiles or multi-functional devices, a method for producing the toner, and a two-component developer.

BACKGROUND ART

In recent years, the use of image forming apparatuses such as a printer has been shifting increasingly from office to personal purposes, and there is a growing demand for technologies that can achieve not only maintenance-free use but also a small size, a high speed, and high image quality for those apparatuses. Under such circumstances, e.g., a cleanerless process, a tandem color process, low-temperature fixing, and oilless fixing are required along with better maintainability and less ozone emission. The cleanerless process allows residual toner from the transfer to be recycled for development without cleaning in an electrophotographic system. In the tandem color process, image forming units for different colors are arranged to form color images simultaneously, so that the color images can be outputted at high speed. The low-temperature fixing contributes to high-speed printing and energy saving. The oilless fixing can provide clear color prints by preventing a so-called offset phenomenon, in which toner adheres to the surface of a fixing roller of a fixing device, without using any release oil (fixing oil). It is desired that all of these functions be performed at the same time. Therefore, in the development of the above technologies, improvements in the toner characteristics as well as the image forming process are important factors.

For example, while toner particles should be small enough to provide higher resolution and higher image quality for prints, in a fixing process for color images of a color printer it is also necessary that each color of toner be melted and mixed sufficiently to increase the transmittance. In this case, a melt failure of the toner may cause light scattering on the surface or the inside of the toner image (i.e., the image composed of toner), which affects the original color of the toner pigment. Moreover, light does not reach the lower layer of the superimposed layers of different colors of toner, resulting in poor color reproduction. Therefore, in addition to a reduction in particle size, the toner should be adapted to low-temperature fixing and have a sufficient melting property and transmittance high enough not to reduce the original color. In particular, the need for light transmittance of an overhead projector (OHP) film is increasing with an increase in opportunities to give a color presentation.

However, when the toner with a sufficient melting property is used, a high-temperature offset (hot offset) phenomenon in which the toner adheres to the surface of a fixing roller is likely to occur. To suppress such an offset phenomenon, a large amount of a release agent such as oil (fixing oil) should be applied to the fixing roller, which makes the handling and configuration of the fixing device more complicated. Therefore, oilless fixing (no oil is used for fixing) is required to provide a compact, maintenance-free, and low-cost apparatus. Moreover, the toner needs to satisfy both the aggregation performance that prevents high-temperature offset and coagulation of the toner during storage at high temperatures and the melting performance that allows the toner to melt at low temperatures for low-temperature fixing and improves the transmittance or the like.

The toner generally includes a resin component as a binder, a coloring component of a pigment or dye (i.e., a coloring additive), and any other additives such as a plasticizer, a charge control agent, and if necessary, a release agent (wax). As the resin component, a natural or synthetic resin may be used alone or in combination. After the above additives are pre-mixed in an appropriate ratio, the components are heated, kneaded, and thermally melted. Then, it is pulverized by an air stream collision board system and classified as fine powder, thus producing a toner base. The toner base also may be produced by chemical polymerization instead of the kneading and pulverizing processes.

Subsequently, an additive such as hydrophobic silica is added to the toner base, so that the toner is completed. A single-component developer includes only the toner, while a two-component developer is obtained by mixing this toner and a carrier composed of magnetic particles.

At present, various methods are considered to produce the toner base particles with a small particle size. Even with pulverization and classification of the conventional kneading and pulverizing processes, the actual particle size can be reduced to only about 8 μm in view of the economic and performance conditions. Therefore, various ways of polymerization different from the kneading and pulverizing processes have been studied further as a method for producing a toner base.

For example, a toner base may be produced by suspension polymerization. In this method, however, the particle size distribution of the toner base is no better than that of the toner base produced by the kneading and pulverizing processes, and in many cases further classification is necessary. Moreover, since the toner base obtained by this method is almost spherical in shape, the toner remaining on the photoconductive member of an electrophotographic apparatus does not clean successfully, and thus the reliability of the image quality is reduced.

Also, a toner base may be produced by emulsion polymerization This method includes the following steps: preparing an aggregated particle dispersion by forming aggregated particles in a dispersion that has been obtained by dispersing at least binder resin particles (also referred to as first binder resin particles when they are distinguished from second binder resin particles, as will be described later) in an aqueous medium containing a surface-active agent; adding a second resin particle dispersion in which second binder resin particles are dispersed to the aggregated particle dispersion; and heating the resultant mixture so that the second binder resin particles are fused with the aggregated particles (also referred to as core particles) to form a resin fused layer.

To achieve the oilless fixing with the toner as described above, the configuration in which a release agent (wax) is added to a binder resin with a sharp melting property, i.e., a sufficient melting property, is being put to practical use.

However, such a toner is very prone to a transfer failure or toner image disturbance during transfer because of its strong cohesiveness. Therefore, it is difficult to ensure the compatibility between transfer and fixing. When a toner base is produced by adding a release agent (wax) to the resin with a low softening property during melting and kneading, problems such as low flowability of the toner, transfer failures including transfer voids, and so-called toner filming in which the toner components adhere to a photoconductive member arise as the amount of wax increases. Thus, there is a limit to the amount of wax that can be added. Moreover, when the toner is used as a two-component developer, a so-called spent phenomenon in which a low-melting component of the toner adheres to the surface of a carrier to form a toner film is likely to occur due to heat generated by mechanical collision or friction between the particles of the toner and the carrier or between the particles and the developing unit. This decreases the charging ability of the carrier for the toner and interferes with a longer life of the two-component developer.

To deal with the above problems, Patent Document 1 discloses a coating carrier for positively charged toner that is obtained by introducing a fluorine-substituted alkyl group into a silicone resin of the coating layer. Patent Document 2 discloses a coating carrier that includes conductive carbon and a cross-linked fluorine modified silicone resin. This coating carrier is considered to have high development ability in a high-speed process and maintain the development ability for a long time. While taking advantage of superior charging characteristics of the silicone resin, these carriers use the fluorine-substituted alkyl group to impart properties such as slidability, releasability and repellency to increase resistance to wearing, peeling or cracking, and further to prevent spent.

In the emulsion polymerization method, Patent Document 3 discloses a process of preparing a liquid mixture by mixing at least a resin particle dispersion in which binder resin particles are dispersed in a surface-active agent having a polarity and a colorant particle dispersion in which colorant particles are dispersed in a surface-active agent having a polarity. The surface-active agents included in the liquid mixture have the same polarity, so that a toner for electrostatic charge image development with high reliability and excellent charge and color development properties can be produced in a simple and easy manner.

Patent Document 4 discloses that the release agent includes at least one type of ester composed of at least one selected from higher alcohol having a carbon number of 12 to 30 and higher fatty acid having a carbon number of 12 to 30, and the binder resin particles include at least two types of binder resin particles with different molecular weights. This can provide a toner with an excellent fixing property, color development property, transparency, and color mixing property.

Patent Document 5 discloses that the molecular weight distribution of a resin component has a peak or shoulder in the range of at least 1,500 to 20,000 and 50,000 to 500,000, Mw/Mn is 1.2 to 4.0 in the molecular weight distribution (ML) derived from a peak or shoulder on the lower molecular weight side, and Mw/Mn is 2.0 to 30.0 in the molecular weight distribution (MH) derived from a peak or shoulder on the higher molecular weight side. Patent Document 5 also discloses the addition of an olefin wax such as polypropylene or polyethylene, a modified material thereof, a natural wax such as carnauba wax or rice wax, an amide wax such as fatty acid bisamide, etc. This configuration provides high offset resistance during heat fixing, so that high-quality visible images can be formed stably for a long time.

In the example of Patent Document 5, a manufacturing method is described that includes salting-out/fusing a mixture of a latex 1 in which low molecular weight resin particles are dispersed, a latex 5 in which high molecular weight resin particles are dispersed, a colorant dispersion 1, and a wax emulsion (polypropylene emulsion).

Patent Document 6 discloses a toner obtained by salting-out/fusion, in which the resin includes at least a low molecular weight component having a peak or shoulder in the range of 1,500 to 20,000 and a high molecular weight component having a peak or shoulder in the range of 50,000 to 500,000 of a GPC molecular weight distribution, and the release agent has a peak in the range of 70° C. to 100° C. based on DSC. The toner has an excellent cleaning property and charging stability, so that high-quality images can be formed for a long time. In the example of Patent Document 6, a manufacturing method is described that includes stirring a low molecular weight resin particle dispersion latex 1), a high molecular weight resin particle dispersion latex 2), a colorant particle dispersion 1, and a release agent particle dispersion 1 and salting-out/fusing the mixture.

Patent Document 7 discloses a toner obtained in the following manner. Resin particles (A) having a weight-average molecular weight (MwA) of 15,000 to 500,000 and colorant particles are salted out/fused to form colored particles (core particles), and then resin particles (B) having a predetermined molecular weight are fused with the surface of the individual colored particles to form a resin layer (shell) by salting-out/fusion. Since the amount of a colorant present on the particle surface is small, high charging and developing performance of the toner is not likely to be affected by the operating environment.

However, in the conventional configurations of Patent Documents 1 and 2, when a toner including a release agent such as wax is used in a two-component developer, the coating layer of the carrier is not sufficient to suppress wearing, peeling or cracking. Moreover, when a negatively charged toner is used, the charge amount of the toner is too low, while an oppositely charged toner (positively charged toner) is generated in a large quantity, causing fog, toner scattering, or the like. Thus, the two-component developer is not suitable for practical use.

In the conventional configurations of Patent Documents 3 and 4, a release agent such as wax is added during the production of a toner base with a polymerization method, and thus the toner can achieve oilless fixing, reduce fog in the development, and improve the transfer efficiency. However, it is difficult to incorporate the wax uniformly into the aggregated particles. Therefore, the dispersibility of the wax is reduced, and the toner images melted during fixing are prone to have a dull color. Moreover, the dispersibility of the colorant such as a pigment also is reduced, and thus the color development property of the toner becomes insufficient.

In the conventional configurations of Patent Documents 5 and 6, the binder resin has different molecular weight distributions. During the salting-out/fusion process, the partially melted wax is aggregated first with low molecular weight resin particles, and then with high molecular weight resin particles, since the low molecular weight resin particles start to melt earlier than the high molecular weight resin particles. Therefore, the particle size distribution of the aggregated particles produced tends to be broader. Moreover, the wax dispersibility is affected significantly by the low molecular weight resin particles, so that the dispersion of the wax in the aggregated particles is not likely to be uniform.

In the manufacturing process, when these aggregated particles are used as core particles, and the second binder resin particles are attached and melted on their surfaces to form a rein fused layer, the adhesion of the second binder resin particles does not proceed because the individual aggregated particles cannot incorporate the wax uniformly, and the wax dispersibility is low, Otherwise, the second binder resin particles that once adhered to the aggregated particles may be separated therefrom due to the releasing action of the wax present on the surfaces of the aggregated particles, and thus may remain suspended in the aqueous medium.

The dispersion of the release agent (wax), depending on its polarity or thermal properties such as a melting point, may have a considerable effect on the aggregation of the particles. Moreover, a specified wax should be added in a large quantity to achieve the oilless fixing. When the toner base particles are produced by an aggregation reaction in the medium that contains at least a certain amount of wax, the particle size is likely to increase with heat treatment time.

In particular, when a plurality of waxes with different melting points or compositions are used to achieve both low-temperature fixability and high-temperature offset resistance, thereby broadening the fixable temperature range, a low melting point wax starts to melt and is aggregated with a colorant or partially melted resin particles as the temperature of an aqueous medium is raised to produce aggregated particles. However, a high melting point wax does not start to melt at this stage and is still present in the aqueous medium without being melted, and thus is not involved in the aggregation reaction. Therefore, some wax is melted and aggregated continuously, while other wax is not aggregated. Consequently, the wax dispersion may vary among the aggregated particles produced, and there may be some cases where the particle size of the aggregated particles is increased, or the particle size distribution becomes broader.

In the conventional configuration, the use of a release agent such as wax, particularly a plurality of waxes with different melting points or compositions prevents uniform mixing and aggregation of the particles including the binder resin particles and the colorant particles in the aqueous medium during manufacture. Thus, some wax is not aggregated but suspended in the aqueous medium, causing the molten aggregated particles that serve as toner base particles to be coarser. As a result, it is difficult to produce toner base particles having a small uniform particle size. Moreover, when the conventional toner is mixed with a carrier as a two-component developer, the two-component developer deteriorates easily due to a so-called spent phenomenon in which a component such as wax adheres to the surface of the carrier.

Patent Document 1: Japanese Patent No. 2801507
Patent Document 2: JP 2002-23429 A
Patent Document 3: JP 10 (1998)-198070 A
Patent Document 4: Japanese Patent No. 3399294
Patent Document 5: JP 2001-154405 A
Patent Document 6: JP 2001-134017 A
Patent Document 7: JP 2002-116574 A

DISCLOSURE OF INVENTION

Therefore, with the foregoing in mind, it is an object of the present invention to provide a toner that can ensure low-temperature melting for low-temperature fixability, high-temperature offset resistance, and high-temperature storage stability, and also can have a small uniform particle size without requiring a classification process, since aggregated particles that serve as toner base particles do not become coarser, even if a release agent such as wax is added during the production of a toner base with a polymerization method, a method for producing the toner, and a two-component developer that can have high charging ability and sufficient durability to prevent deterioration caused by spent.

A toner of the present invention includes toner base particles that are aggregated particles obtained by mixing in an aqueous medium at least a resin particle dispersion in which resin particles are dispersed, a colorant particle dispersion in which colorant particles are dispersed, and a wax particle dispersion in which wax particles are dispersed and heating the mixed dispersion so that the particles are aggregated. A gel permeation chromatography (GPC) measurement of the resin particles shows that a weight-average molecular weight (Mw1) is 10000 to 60000, and the ratio (Mw1/Mn1) of the weight-average molecular weight (Mw1) to a number-average molecular weight (Mn1) is 1.5 to 6. The wax particles include at least a first wax and a second wax. An endothermic peak temperature (melting point Tmw1) of the first wax based on a differential scanning calorimetry (DSC) method is 50° C. to 90° C. The relationship between an endothermic peak temperature (melting point Tmw2) of the second wax based on the DSC method and Tmw1 is expressed as $$5+\mathrm{Tmw1}(^\circ\,\mathrm{C.})\leqq\mathrm{Tmw2}(^\circ\,\mathrm{C.})\leqq 50+\mathrm{Tmw1}(^\circ\,\mathrm{C.}).$$

A method for producing a toner of the present invention includes the following: preparing a mixed dispersion by mixing in an aqueous medium at least a resin particle dispersion in which resin particles are dispersed, a colorant particle dispersion in which colorant particles are dispersed, and a wax particle dispersion in which wax particles are dispersed; heat-treating the mixed dispersion; and foaming molten aggregated particles as toner base particles. A gel permeation chromatography (GPC) measurement of the resin particles shows that a weight-average molecular weight Owl) is 10000 to 60000, and the ratio (Mw1/Mn1) of the weight-average molecular weight (Mw1) to a number-average molecular weight (Mn1) is 1.5 to 6. The wax particles include at least a first wax and a second wax. An endothermic peak temperature (melting point Tmw1) of the first wax based on a differential scanning calorimetry (DSC) method is 50° C. to 90° C. The relationship between an endothermic peak temperature (melting point Tmw2) of the second wax based on the DSC method and Tmw1 is expressed as $$5+\mathrm{Tmw1}(^\circ\,\mathrm{C.})\leqq\mathrm{Tmw2}(^\circ\,\mathrm{C.})\leqq 50+\mathrm{Tmw1}(^\circ\,\mathrm{C.}).$$

In the heat treatment process of the mixed dispersion, at least part of a plurality of the wax particles is melted, and molten particles are aggregated and coalesce.

A two-component developer of the present invention includes the above toner as a toner base and a carrier. Inorganic fine powder having an average particle size of 6 nm to 200 nm is added to the toner base in an amount of 1 to 6 parts by weight per 100 parts by weight of the toner base. The carrier includes magnetic particles as a core material, at least the surface of the core material is coated with a fluorine modified silicone resin containing an aminosilane coupling agent, and 5 to 40 parts by weight of the aminosilane coupling agent are present per 100 parts by weight of the coating resin.

BEST MODE FOR CARRYING OUT THE INVENTION

Figure 1:
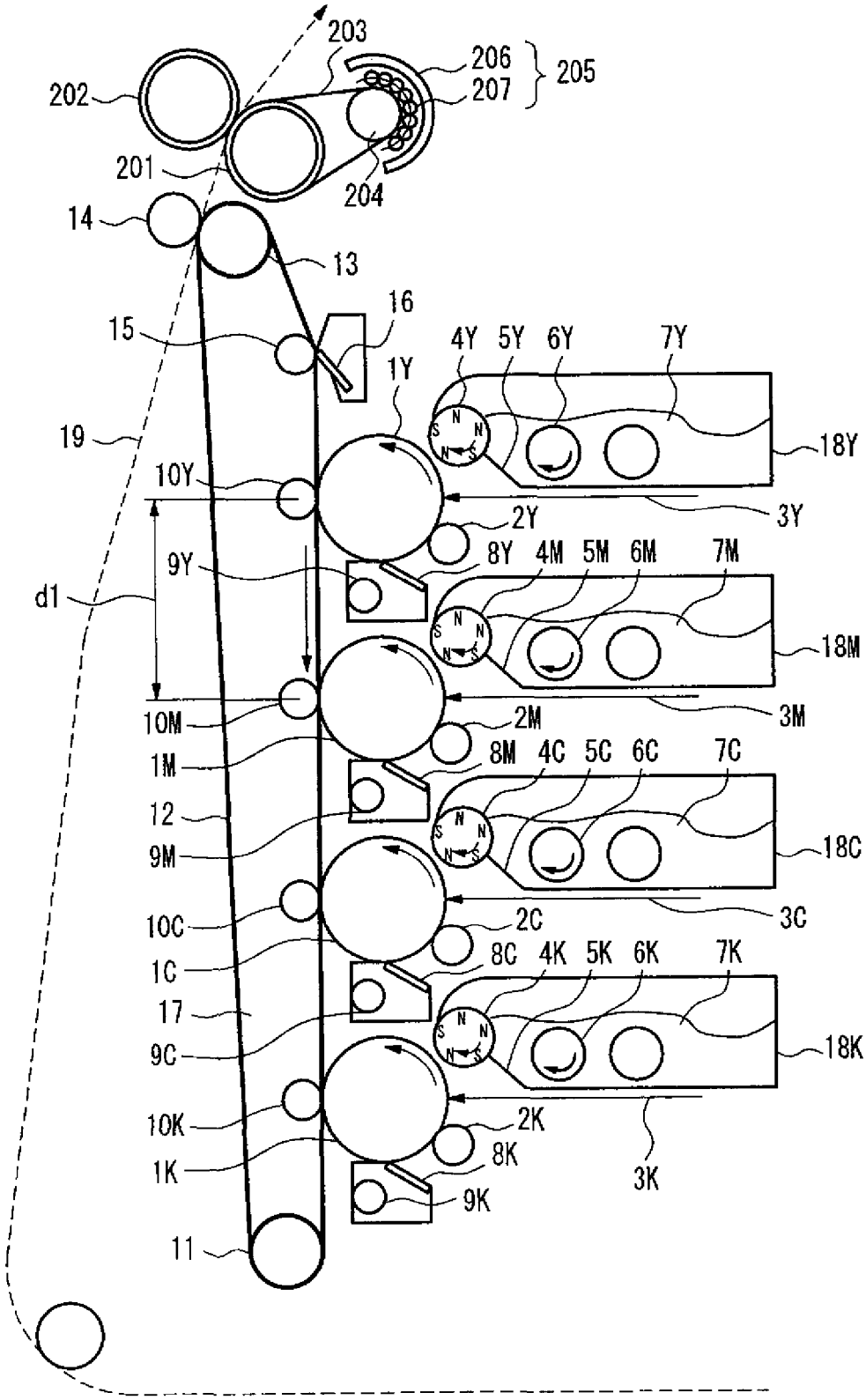
FIG. 1 is a cross-sectional view showing the configuration of an image forming apparatus used in an example of the present invention.

In a method for producing a toner of the present invention, a resin particle dispersion in which binder resin particles are dispersed, a colorant particle dispersion in which colorant particles are dispersed, and a wax particle dispersion in which a plurality of types of wax particles that differ in melting point or composition are dispersed are mixed in an aqueous medium, and then heated so that the particles are aggregated to form aggregated particles. The binder resin is defined to have a weight-average molecular weight Mw of 10000 to 60000 and a Mw/Mn ratio of 1.5 to 6. With this configuration, the low-temperature fixability can be maintained. Moreover, it is possible to suppress the presence of wax or colorant particles that are not aggregated but suspended in the aqueous medium, and to prevent the particle size distribution of the aggregated particles from being broader or coarser. It is also possible to prevent the aggregated particles from being irregular in shape or being uneven due to a reduction in surface smoothness. Thus, even if the wax is added, the molten aggregated particles that serve as toner base particles do not become coarser, and the toner base particles produced can have a small, substantially uniform particle size without requiring a classification process.

Moreover, a plurality of waxes are used together. The first wax having a melting point (Tmw1) of 50° C. to 90° C. can improve the low-temperature fixability, transmittance, and glossiness. The second wax having a melting point (Tmw2) 5° C. to 50° C. higher than Tmw1 can impart high-temperature offset resistance during fixing. By using a low melting point wax with a high melting point wax, low-temperature fixing can be achieved, and an offset phenomenon can be suppressed without the application of fixing oil.

A two-component developer is obtained by adding inorganic fine powder having an average particle size of 6 nm to 200 nm in an amount of 1 to 6 parts by weight per 100 parts by weight of the toner base and mixing this toner base with a carrier that includes magnetic particles whose surfaces are coated with a fluorine modified silicone resin containing an aminosilane coupling agent. The two-component developer does not suffer deterioration caused by spent.

The present inventors conducted a detailed study of providing i) a toner for electrostatic charge image development that has a small particle size and a sharp particle size distribution and can achieve not only the oilless fixing but also high glossiness, high transmittance, suitable charging characteristics, environmental dependence, cleaning property and transfer property; ii) a two-component developer using the toner; and iii) image formation that can form color images with high quality and reliability without causing toner scattering, fog, or the like.

(1) Polymerization Process

A resin particle dispersion is prepared by forming resin particles of a homopolymer or copolymer (vinyl resin) of vinyl monomers by emulsion or seed polymerization of the vinyl monomers in a surface-active agent and dispersing the resin particles in the surface-active agent. Any known dispersing devices such as a high-speed rotating emulsifier, a high-pressure emulsifier, a colloid-type emulsifier, and a ball mill, a sand mill, and Dyno mill that use a medium can be used.

When the resin particles are made of resin other than the homopolymer or copolymer of the vinyl monomers, a resin particle dispersion may be prepared in the following manner. If the resin dissolves in an oil solvent that has a relatively low water solubility, a solution is obtained by mixing the resin with the oil solvent. The solution is blended with a surface-active agent or polyelectrolyte, and then is dispersed in water to produce a fine particle dispersion by using a dispersing device such as a homogenizer. Subsequently, the oil solvent is evaporated by heating or under reduced pressure. Thus, the resin particles made of resin other than the vinyl resin are dispersed in the surface-active agent.

Examples of a polymerization initiator include an azo- or diazo-based initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile, persulfate such as potassium persulfate or ammonium persulfate, an azo compound such as 4,4'-azobis-4-cyanovaleric acid and its salt or 2,2'-azobis(2-amidinopropane) and its salt, and a peroxide compound.

A colorant particle dispersion is prepared by adding colorant particles to water that includes a surface-active agent and dispersing the colorant particles using the above dispersing device.

A wax particle dispersion is prepared by adding wax particles to water that includes a surface-active agent and dispersing the wax particles using an appropriate dispersing device.

In the basic configuration of a toner of the present invention, at least the resin particle dispersion in which the resin particles are dispersed, the colorant particle dispersion in which the colorant particles are dispersed, and the wax particle dispersion in which the wax particles are dispersed are mixed in an aqueous medium to form a mixed dispersion. Then, the mixed dispersion is heat-treated, so that molten aggregated particles are produced. The wax particles include a plurality of waxes that differ in at least endothermic peak temperature based on a DSC method. During the heat treatment process of the mixed dispersion, at least part of the wax particles including different waxes and the resin particles are melted, and subsequently the colorant particles, the molten wax particles, and the molten resin particles are aggregated and coalesce into the molten aggregated particles.

In the toner of the present invention, at least the resin particle dispersion in which the resin particles are dispersed, the colorant particle dispersion in which the colorant particles are dispersed, and the wax particle dispersion in which the wax particles are dispersed are mixed in an aqueous medium, and the particles are aggregated to form aggregated particles, at least part of which is melted.

Moreover, it is preferable that a mixed dispersion is produced by mixing the resin particle dispersion in which the resin particles are dispersed, the colorant particle dispersion in which the colorant particles are dispersed, and the wax particle dispersion in which the wax particles are dispersed. Then, the pH of the mixed dispersion is adjusted under predetermined conditions, and a water-soluble inorganic salt is added to the mixed dispersion. Subsequently, the mixed dispersion is heated at temperatures not less than the glass transition point (Tg) of the first resin particles and/or the melting point of the wax so that the particles are aggregated to form aggregated particles (also referred to as core particles), at least part of which is melted.

There is a predetermined relationship between the molecular weight characteristics of the resin particles measured by gel permeation chromatography (GPC) and the thermal properties (melting point) of the wax.

Specifically, the weight-average molecular weight (Mw1) of the resin particles is 10000 to 60000, and the ratio (Mw1/Mn1) of the weight-average molecular weight (Mw1) to the number-average molecular weight (Mn1) is 1.5 to 6. Moreover, the wax includes at least a first wax and a second wax. The endothermic peak temperature (melting point: Tmw1 (° C.)) of the first wax based on the DSC method is 50° C. to 90° C., and the endothermic peak temperature (melting point: Tmw2 (° C.)) of the second wax based on the DSC method is 5° C. to 50° C. higher than Tmw1.

In the molecular weight characteristics of the resin particles, it is more preferable that the weight-average molecular weight (Mw1) is 10000 to 50000, and the ratio (Mw1/Mn1) of the weight-average molecular weight (Mw1) to the number-average molecular weight (Mn) is 1.5 to 3.9. It is further preferable that the weight-average molecular weight (Mw1) is 10000 to 30000, and the ratio (Mw1/Mn1) of the weight-average molecular weight (Mw1) to the number-average molecular weight (Mn1) is 1.5 to 3.

It is also preferable that the number-average molecular weight (Mn1) is 3000 to 15000, the weight-average molecular weight (Mw1) is 10000 to 60000, the Z-average molecular weight (Mz1) is 30000 to 100000, the ratio (Mw1/Mn1) of the weight-average molecular weight (Mw1) to the number-average molecular weight (Mn1) is 1.5 to 6, and the ratio (Mz1/Mn1) of the Z-average molecular weight (Mz1) to the number-average molecular weight (Mn1) is 3 to 10

It is more preferable that the number-average molecular weight (Mn1) is 3000 to 12000, the weight-average molecular weight (Mw1) is 10000 to 50000, the Z-average molecular weight (Mz1) is 30000 to 70000, the ratio (Mw1/Mn1) of the weigh-average molecular weight (Mw1) to the number-average molecular weight (Mn1) is 1.5 to 3.9, and the ratio (Mz1/Mn1) of the Z-average molecular weight (Mz1) to the number-average molecular weight (Mn1) is 3 to 8.

It is further preferable that the number-average molecular weight (Mn1) is 4000 to 8000, the weight-average molecular weight (Mw1) is 10000 to 30000, the Z-average molecular weight (Mz1) is 30000 to 50000, the ratio (Mw1/Mn1) of the weigh-average molecular weight (Mw1) to the number-average molecular weight (Mn1) is 1.5 to 3, and the ratio (Mz1/Mn1) of the Z-average molecular weight (Mz1) to the number-average molecular weight (Mn1) is 3 to 5.

When a plurality of waxes with different melting points are used together, a low melting point wax starts to melt first with a rise in temperature, and then a high melting point wax starts to melt at a later time after the temperature rise. In the case of the conventional binder resin with the molecular weight characteristics such that the molecular weight distribution has two peaks or Mw1/Mn1 is large, the resin is melted gradually as the temperature rises. Therefore, the partially melted wax is aggregated first with low molecular weight resin particles, and then with high molecular weight resin particle, since the low molecular weight resin particles start to melt earlier than the high molecular weight resin particles. Thus, the aggregation reaction slows down with a rise in temperature, and the particle size distribution of the aggregated particles produced tends to be broader. Moreover, the wax dispersibility is affected significantly by the low molecular weight resin particles, so that the dispersion of the wax in the aggregated particles is not likely to be uniform.

However, when the resin with predetermined molecular weight characteristics of the present invention is used, unlike the conventional resin characteristics, the resin particles are not melted gradually, but rather sharply. Therefore, even if the low melting point wax starts to melt, the aggregation of the wax and the resin particles is delayed. Subsequently, the high melting point wax starts to melt, and the melting and aggregation of both low and high melting point waxes and the resin particles are accelerated. Thus, it is possible to form aggregated particles having a small particle size and a narrow p article size distribution, in which the low and high melting point waxes are incorporated uniformly into the individual aggregated particles.

If Mw is smaller than 10000 or Mz is smaller than 30000, the aggregation proceeds easily, and the particles tend to be coarser. The offset resistance and the high-temperature storage stability are reduced.

If Mw is larger than 60000 or Mz is larger than 100000, the low-temperature fixability is degraded. If Mw/Mn is larger than 6 or Mz/Mn is larger than 10, the particle size distribution of the aggregated particles tends to be broader, and the dispersion of the wax in the aggregated particles is not likely to be uniform. Moreover, the core particles are not stable but irregular in shape, and do not have sufficient surface smoothness. If Mw/Mn is smaller than 1.5 or Mz/Mn is smaller than 3, the productivity of the resin is reduced.

The melting point Tmw1 of the first wax is preferably 55° C. to 85° C., more preferably 60° C. to 85° C., and further preferably 65° C. to 75° C. If Tmw1 is lower than 50° C., the storage stability is degraded. If Tmw1 is higher than 90° C., the low-temperature fixability, the color transmittance, and the glossiness cannot be improved.

The melting point Tmw2 of the second wax is at least 5° C. higher than Tmw1 of the first wax, thereby separating the functions of the waxes efficiently. Accordingly the low melting point wax is used to provide low-temperature fixability, and the high melting point wax is used to achieve high-temperature offset resistance, heat resistance, and high-temperature storage stability. If the temperature difference is less than 5° C., it is difficult to exhibit the effects of low-temperature fixability, offset resistance, and releasability.

When the endothermic peak temperature (melting point: Tmw2(° C.)) of the second wax based on the DSC method is higher than Tmw1 by 50° C. or more, the time of melting between the first and second waxes is too long. Therefore, the dispersion of the wax is not likely to be uniform, and the particle size distribution becomes broader.

In the toner of the present invention, it is preferable to use a specified wax composition. Specifically; the wax includes at least a first wax and a second wax. The first wax may include at least one ester wax selected from higher alcohol having a carbon number of 16 to 24 and higher fatty acid having a carbon number of 16 to 24. The second wax may include an aliphatic hydrocarbon wax.

In the toner of the present invention, it is preferable to use a specified wax composition. Specifically, the wax includes at least a first wax and a second wax. The first wax may include a wax having an iodine value of not more than 25 and a saponification value of 30 to 300. The second wax may include an aliphatic hydrocarbon wax.

When the resin, the colorant, and the aliphatic hydrocarbon wax are mixed to form aggregated particles (also referred to as core particles) in an aqueous medium, the aliphatic hydrocarbon wax is unlikely to be aggregated with the resin because of its conformability with the resin. Therefore, particles that do not incorporate the wax are suspended. Such presence of the suspended particles may hinder the progress of aggregation and make the particle size distribution broader.

However, if the temperature or time of the heat treatment is changed to reduce the suspended particles or to prevent a broad particle size distribution, the particle size is increased. Moreover, when the second resin particles are added further to form a shell on the molten core particles, secondary aggregation of the core particles occurs rapidly, and the particles become coarser.

By using the wax that includes the first wax including a specified wax and the second wax including a specified aliphatic hydrocarbon wax, it is possible to suppress the presence of suspended particles that do not incorporate the aliphatic hydrocarbon wax and to prevent the particle size distribution of the aggregated particles from being broader. Moreover, when the second resin particles are added to form a shell, it is also possible to reduce a phenomenon in which secondary aggregation of the core particles occurs rapidly, and the core particles become coarser.

In the process of heating and aggregation, it is assumed that the first wax continues to be compatibilized with the resin, which promotes aggregation of the aliphatic hydrocarbon wax and the resin, and therefore the wax is incorporated uniformly, and the presence of suspended particles can be suppressed.

When the first wax is partially compatibilized with the resin, it tends to improve the low-temperature fixability further Since the aliphatic hydrocarbon wax is not compatibilized with the resin, it is present in the crystalline state in the core particles, and thus can have the effect of improving the high-temperature offset resistance. In other words, the first wax may function as both a dispersion assistant for emulsifying and dispersing the aliphatic hydrocarbon wax and a low-temperature fixing assistant.

In the present invention, it is preferable that the first wax has a melting point Tmw1 of 50° C. to 90° C. and the second wax has a melting point Tmw2 of 80° C. to 120° C.

The melting point Tmw1 of the first wax is preferably 55° C. to 85° C., more preferably 60° C. to 85° C., and further preferably 65° C. to 75° C. If Tmw1 is lower than 50° C., the storage stability of the toner at high temperatures is degraded. Moreover, melting of the wax is accelerated, and the aggregated particles become coarser. If Tmw1 is higher than 90° C., the aggregation of the wax is reduced during the formation of the core particles, and the numbers of liberated particles are increased in the aqueous medium. This makes it difficult to improve the low-temperature fixability.

The melting point Tmw2 of the second wax is more preferably 85° C. to 100° C., and further preferably 90° C. to 100° C. If Tmw2 is lower than 80° C., the storage stability is degraded, and the releasing action for offset resistance is weakened. If Tmw2 is higher than 120° C., the aggregation of the wax is reduced during the formation of the core particles, and the numbers of liberated particles are increased in the aqueous medium. Moreover, the low-temperature fixability and the color transmittance are impaired.

In the toner of the present invention, the wax particle dispersion is produced preferably by mixing, emulsifying, and dispersing the first wax and the second wax together. In this method, the first wax and the second wax may be mixed at a predetermined mixing ratio, and then heated, emulsified, and dispersed in an emulsifying and dispersing device. The first wax and the second wax may be put in the device either separately or simultaneously. However, it is preferable that the wax particle dispersion thus produced includes the first wax and the second wax in the mixed state.

When a dispersion obtained by emulsifying and dispersing the first wax and the second wax separately is mixed with the resin particle dispersion and the colorant particle dispersion, and then this mixed dispersion is heated and aggregated, particles that do not incorporate the wax may be suspended, and the particle size distribution of the core particles tends to be broader. Moreover, the problem of coarse particles resulting from secondary aggregation of the core particles in forming a shell also cannot be solved satisfactorily.

Although the dispersion stability is improved by treating the aliphatic hydrocarbon wax with an anionic surface-active agent, when the particles are aggregated to form core particles, the particle size is increased, and it may be difficult to obtain particles having a sharp particle size distribution. Therefore, the wax particle dispersion is produced preferably by mixing, emulsifying, and dispersing the first wax and the second wax with a surface-active agent that includes a nonionic surface-active agent as the main component.

When the aliphatic hydrocarbon wax and the ester wax are mixed and dispersed to form an emulsion dispersion by using the surface-active agent that includes a nonionic surface-active agent as the main component, aggregation of the wax particles themselves can be suppressed, and the dispersion stability can be improved. Then, this wax particle dispersion is mixed with the resin particle dispersion and the colorant particle dispersion, so that the core particles are formed. In this manner, the wax particles are not liberated, and the core particles can have a small particle size and a narrow sharp particle size distribution.

It is preferable that FT2/ES1 is 0.2 to 10 where ES1 and FT2 are weight ratios of the first wax and the second wax to 100 parts by weight of the wax in the wax particle dispersion, respectively. FT2/ES1 is more preferably 1 to 9, and further preferably 1.5 to 9. When FT2/ES1 is less than 0.2, the effect of the high-temperature offset resistance cannot be obtained, and the storage stability is degraded. When FT2/ES1 is more than 10, the low-temperature fixing cannot be achieved, and the particle size distribution of the aggregated particles tends to be broader. Moreover, FT2/ES1 in the range of 1.5 to 3 is a well-balanced ratio at which the low-temperature fixability, the high-temperature storage stability, and the high-temperature offset resistance can be achieved.

The total amount of the wax added is preferably 5 to 30 parts by weight, more preferably 8 to 25 parts by weight, and further preferably 10 to 20 parts by weight per 100 parts by weight of the binder resin component. If the amount is less than 5 parts by weight, the effects of the low-temperature fixability and the releasability cannot be obtained. If the amount is more than 30 parts by weight, it is difficult to control small particles.

In the toner of the present invention, to eliminate the presence of suspended particles and to produce aggregated particles having a sharp particle size distribution by the aggregation reaction of the binder resin, two types of wax particles with different melting points, and the coloring particles, the binder resin preferably has a glass transition temperature of 45° C. to 60° C. and a softening temperature of 90° C. to 140° C., more preferably a glass transition temperature of 45° C. to 55° C. and a softening temperature of 90° C. to 135° C., and further preferably a glass transition temperature of 45° C. to 52° C. and a softening temperature of 90° C. to 130° C.

If the glass transition point is lower than 45° C., the particle size distribution of the aggregated particles tends to be broader, and the particles become coarser. The high-temperature storage stability is reduced. If the glass transition point is higher than 60° C., the low-temperature fixability is degraded. If the softening point is lower than 90° C., the particle size distribution of the aggregated particles tends to be broader, and the particles become coarser. The glossiness fluctuates widely. If the softening point is higher than 140° C., the low-temperature fixability is degraded. The aggregation of the binder resin particles is reduced during the formation of the aggregated particles, and the numbers of suspended particles are increased.

In the toner of the present invention, at least the resin particle dispersion in which the resin particles are dispersed, the colorant particle dispersion in which the colorant particles are dispersed, and the wax particle dispersion in which the wax particles are dispersed are mixed in the aqueous medium. In this case, the resin particle dispersion preferably has a pH (hydrogen ion concentration) of 6.0 or less.

When persulfate (e.g., potassium persulfate) is used as a polymerization initiator in the emulsion polymerization of the resin, the residue may be decomposed by heat applied during the aggregation process and may reduce the pH of the mixed dispersion. Therefore, it is preferable that a heat treatment is performed at temperatures not less than a predetermined temperature (preferably 80° C. or more for sufficient decomposition of the residue) for a predetermined time (preferably about 1 to hours) after the emulsion polymerization. The pH is preferably 4 or less, and more preferably 1.8 or less. If the pH is more than 6.0, the residue of the persulfate (polymerization initiator) is decomposed, and the pH fluctuation (pH decrease) is increased during the formation of the core particles by heating. Thus, the core particles obtained by heating and aggregation become coarser.

Then, a water-soluble inorganic salt is added to the mixed dispersion of the first resin particle dispersion, the colorant particle dispersion, and the wax particle dispersion, and the mixed dispersion is heated at temperatures not less than the glass transition point of the resin and/or the melting point of the wax, thereby forming aggregated particles with a predetermined particle size. The pH of the mixed dispersion is adjusted preferably in the range of 9.5 to 12.2, more preferably in the range of 10 to 12, and further preferably in the range of 10.5 to 12 before adding the water-soluble inorganic salt and heating. In this case, 1N NaOH can be used for the pH adjustment. If the pH is less than 9.5, the aggregated particles produced become coarser. If the pH is more than 12.2, the amount of liberated wax is increased, and it is difficult to incorporate the wax uniformly into the resin.

After the pH adjustment, the water-soluble inorganic salt is added to the mixed dispersion, which then is heat-treated so that the resin particles, the colorant particles, and the wax particles are aggregated to form aggregated particles having a predetermined volume-average particle size (e.g., 3 to 7 μm), and at least part of the aggregated particles is melted. The pH of the dispersion at the time of forming the aggregated particles with the predetermined volume-average particle size is maintained in the range of 7.0 to 9.5. This can reduce the liberation of the wax and form the aggregated particles that incorporate the wax and have a narrow particle size distribution. The amount of NaOH added, the type or amount of aggregating agent, the pH values of the emulsion-polymerized resin dispersion, the colorant dispersion and the wax dispersion, a heating temperature, or time may be selected appropriately. If the pH of the dispersion is less than 7.0 at the time of forming the aggregated particles, the aggregated core particles become coarser. If the pH of the dispersion is more than 9.5, the amount of liberated wax is increased due to poor aggregation.

Subsequently, it is also preferable that the pH further is adjusted in the range of 2.2 to 6.8, and then the aggregated particles are heat-treated for a predetermined time (e.g., about 1 to 5 hours). When the heat treatment is performed after adjusting the pH in the above range, the surface smoothness of the aggregated particles can be improved while suppressing secondary aggregation of the aggregated particles. Moreover, the particle size distribution can be made sharper.

In the process of forming the aggregated particles for the toner of the present invention, it is preferable that the main component of the surface-active agent used for each of the resin particle dispersion, the colorant particle dispersion, and the wax particle dispersion is a nonionic surface-active agent. This configuration eliminates the presence of colorant or wax particles that are not aggregated but suspended in the aqueous medium, and thus can provide a toner having a smaller particle size and a uniform, narrow and sharp particle size distribution without requiring a classification process.

The surface-active agent used for the first resin particle dispersion may be a mixture of a nonionic surface-active agent and an ionic surface-active agent, and the nonionic surface-active agent is preferably 60 wt % or more, more preferably 60 to 95 wt %, and further preferably 65 to 90 wt % of the total surface-active agent. If the nonionic surface-active agent is less than 60 wt %, stable aggregated particles cannot be produced. When only the nonionic surface-active agent is used, or it is more than 95 wt %, the dispersion of the resin particles is not stable.

It is also preferable that the surface-active agent used for the first resin particle dispersion is a mixture of a nonionic surface-active agent and an ionic surface-active agent, the main component of the surface-active agent used for the colorant particle dispersion is only a nonionic surface-active agent, and the main component of the surface-active agent used for the wax particle dispersion is only a nonionic surface-active agent.

Moreover, it is preferable that the surface-active agent used for the first resin particle dispersion is a mixture of a nonionic surface-active agent and an ionic surface-active agent, the main component of the surface-active agent used for the colorant particle dispersion is a mixture of a nonionic surface-active agent and an ionic surface-active agent, and the main component of the surface-active agent used for the wax particle dispersion is only a nonionic surface-active agent. When the mixture of nonionic and ionic surface-active agents is used for the colorant particle dispersion and the first resin particle dispersion, the nonionic surface-active agent is preferably 60 wt % or more, more preferably 60 to 95 wt %, and further preferably 65 to 90 wt % of the total surface-active agent.

The surface-active agent allows the dispersed particles of the wax and the resin to be hydrated by many water molecules. Therefore, the particles are not likely to adhere to each other. However, when an electrolyte is added, it takes the water molecules away from the hydrated particles. Accordingly, the particles can adhere easily, so that more and more particles join and grow into larger particles. In this case, when an ionic surface-active agent, e.g., an anionic surface-active agent is used for both resin dispersion and wax dispersion, although the aggregated particles are formed, some wax particles repel each other while the water molecules are taken away by the electrolyte. Thus, there may be particles formed by aggregating only the wax particles suspended independently. The presence of such particles that are not involved in the aggregation reaction can cause filming of the toner on a photoconductive member, a reduction in image density during development, and an increase in fog. Moreover, the suspended particles gradually join with the aggregated particles as the aggregation reaction proceeds by heating for a predetermined time. Consequently, the resultant particles become coarser and have a broad particle size distribution.

In the case of the wax particle dispersion using a nonionic surface-active agent, when an electrolyte is added, it takes the water molecules away from the hydrated particles. Accordingly, the particles can adhere easily, so that more and more particles join and grow into larger particles. Since the nonionic surface-active agent is used, the effect of repulsion of the wax particles is small while the water molecules are taken away by the electrolyte. This can suppress the presence of particles formed by aggregating only the wax particles suspended independently. Thus, it may be possible to produce particles having a uniform sharp particle size distribution.

In this embodiment, it is preferable that a second resin particle dispersion in which second resin particles are dispersed is mixed with the aggregated particles (also referred to as core particles), and then is heated so that the second resin particles are fused with the core particles to form toner base particles It is also preferable that the second resin particle dispersion in which the second resin particles are dispersed is mixed with the core particle dispersion, and then is heat-treated at temperatures not less than the glass transition point of the second resin particles so that the second resin particles are fused with the core particles to form a resin fused layer (also referred to as a "shell").

In the molecular weight characteristics of the second resin particles measured by gel permeation chromatography (GPC), it is preferable that the number-average molecular weight (Mn) is 9000 to 30000, the weight-average molecular weight (Mw) is 50000 to 500000, and the ratio (Mw/Mn) of the weight-average molecular weight (Mw) to the number-average molecular weight (Mn) is 2 to 10.

It is more preferable that the number-average molecular weight (n) is 11000 to 25000, the weight-average molecular weight Mw) is 50000 to 400000, the Z-average molecular weight (Mz) is 100000 to 500000, Mw/Mn is 2 to 8, and Mz/Mn is 5 to 40. It is further preferable that the number-average molecular weight (Mn) is 14000 to 22000, the weight-average molecular weight (Mw) is 50000 to 300000, the Z-average molecular weight (Mz) is 100000 to 400000, Mw/Mn is 2.5 to 5, and Mz/Mn is 5 to 30.

The point of fusing the second resin particles with the core particles is to improve high-temperature offset resistance, high-temperature storage stability, or repeated printings during development.

When the second resin particles are attached and melted (fused) on the surface of the individual core particles including wax, the releasing action of the wax interferes with the fusion of the second resin particles, so that the resin particles are not fused but remain suspended in the aqueous medium. Thus, it is difficult to form a uniform layer of the second resin particles. In particular, if the wax is exposed partially from the core particles including two or more waxes with different melting points or compositions, the fusion of the second resin particles is less likely to occur.

Therefore, the molecular weight characteristics, glass transition point, or softening point of the second resin particles are controlled within a predetermined range so as to cause the second resin particles to melt more quickly during heating. Thus, the second resin particles can be fused with the surface of the individual core particles including two or more waxes with different melting points, while reducing the effects of the waxes.

If Mn is smaller than 9000, Mw is smaller than 50000, or Mz is smaller than 100000, the durability, the high-temperature offset resistance, and the separability of paper from a fixing roller during fixing are reduced. Since the melting of the second resin particles is faster, the particle size distribution of the particles fused with the second resin particles tends to be broader. If Mn is larger than 30000, Mw is larger than 500000, or Mz is larger than 500000, the glossiness and the transmittance are reduced. The fusion of the second resin particles with the surface of the individual core particles does not proceed easily.

When the molecular weight distribution is brought closer to monodisperse by decreasing Mw/Mn or Mz/Mn of the second resin particles, the second resin particles can be fused uniformly with the surface of the individual core particles. If Mw/Mn is larger than 10 or Mz/Mn is larger than 40, the thermal adhesiveness of the second resin particles to the surface of the individual core particles is degraded, and thus the fused layer can be nonuniform, and the surface layer is likely to be uneven and not smooth. If Mw/Mn is smaller than 2 or Mz/Mn is smaller than 5, the productivity of the resin is reduced.

The second resin particles preferably have a glass transition point (Tg2(° C.)) of 60° C. to 75° C. and a softening point (Ts2(° C.)) of 140° C. to 180° C., more preferably a glass transition point of 63° C. to 75° C. and a softening point of 150° C. to 180° C., and further preferably a glass transition point of 68° C. to 75° C. and a softening point of 160° C. to 180° C. The high-temperature storage stability, the repeated printings, the high-temperature offset resistance, or the separability of paper can be improved.

If the glass transition point of the second resin particles is lower than 60° C., the storage stability is degraded. If it is higher than 75° C., the fusion of the second resin particles with the surface of the individual core particles including two types of the wax particles with different melting points is degraded, thus making it difficult to adhere uniformly. If the softening point of the second resin particles is lower than 140° C., the repeated printings, the high-temperature offset resistance, or the separability of paper is reduced. If it is higher than 180° C., the fusion of the second resin particles with the surface of the individual core particles is degraded, thus making it difficult to adhere uniformly The glossiness and the transmittance are reduced.

The softening point and the glass transition point of the second resin particles are higher than those of the resin particles (first resin particles) used for the core particles, thereby satisfying the low-temperature fixability, the high-temperature storage stability, and the offset resistance. However, when the softening point and the glass transition point of the second resin particles are higher than those of the first resin particles, the thermal adhesiveness of the second resin particles to the surface of the individual core particles is degraded, and thus the fused layer can be nonuniform, and the surface layer is likely to be uneven and not smooth. Therefore, the molecular weight distribution is brought closer to monodisperse by decreasing Mw/Mn or Mz/Mn of the second resin particles, so that the second resin particles can be fused uniformly with the surface of the individual core particles.

The second resin particles are preferably 10 wt % or more, more preferably 20 wt % or more, and further preferably 30 to 40 wt % of the total resin of the toner.

The second resin particles adhere to the surface of the individual core particles and are formed into a resin fused layer by heating at temperatures not less than Tg of the second resin particles. During this process, to achieve uniform adhesion of the second resin particles to the core particles without liberating the second resin particles and also to prevent secondary aggregation of the core particles, a preferred method may include the following: adding the second resin particle dispersion to the core particle dispersion; adjusting the pH of the core particle dispersion to which the second resin particle dispersion has been added in the range of 2.2 to 7.8; and heat-treating the resultant mixture at temperatures not less than the glass transition point of the second resin particles for 0.5 to 5 hours.

With this process, the second resin particles can adhere uniformly to the surface of the individual core particles while suppressing suspended particles of the second resin particles. If the pH is less than 2.2, the adhesion of the second resin particles does not occur easily, and the numbers of liberated resin particles are increased. If the pH is more than 7.8, secondary aggregation of the core particles is likely to occur.

If the treatment time is longer than 5 hours, the particles become coarser, and the particle size distribution becomes broader.

To improve the durability, storage stability, and high-temperature offset resistance of the toner, the thickness of the layer is preferably 0.5 μm to 2 μm, If the thickness is smaller than the lower limit, the above effect cannot be obtained. If the thickness is larger than the upper limit, the low-temperature fixability is impaired.

It is preferable that the surface-active agent used for the second resin particle dispersion is a mixture of a nonionic surface-active agent and an ionic surface-active agent, and the nonionic surface-active agent is preferably 50 wt % or more, more preferably 60 wt % or more, even more preferably 60 to 95 wt %, and further preferably 65 to 90 wt % of the total surface-active agent. This configuration can promote the adhesion of the second resin particles to the core particles. If the proportion of the ionic surface-active agent is increased, the adhesion of the second resin particles to the core particles is reduced. Therefore, the core particles are becoming coarser with time due to secondary aggregation, while the second resin particles remain suspended in the aqueous medium.

The water-soluble inorganic salt may be, e.g., an alkali metal salt or an alkaline-earth metal salt. Examples of the alkali metal include lithium, potassium, and sodium. Examples of the alkaline-earth metal include magnesium, calcium, strontium, and barium. Among these, potassium, sodium, magnesium, calcium, and barium are preferred. The counter ions (the anions constituting a salt) of the above alkali metals or alkaline-earth metals may be, e.g., a chloride ion, bromide ion, iodide ion, carbonate ion, or sulfate ion.

Examples of the organic solvent with infinite solubility in water include methanol, ethanol, 1-propanol, 2-propanol, ethylene glycol, glycerin, and acetone. Among these, alcohols having a carbon number of not more than 3 such as methanol, ethanol, 1-propanol, and 2-propanol are preferred, and 2-propanol is particularly preferred.

The nonionic surface-active agent may be, e.g., a polyethylene glycol-type nonionic surface-active agent or a polyol-type nonionic surface-active agent. Examples of the polyethylene glycol-type nonionic surface-active agent include a higher alcohol ethylene oxide adduct, alkylphenol ethylene oxide adduct, fatty acid ethylene oxide adduct, polyol fatty acid ester ethylene oxide adduct, fatty acid amide ethylene oxide adduct, ethylene oxide adduct of fats and oils, and polypropylene glycol ethylene oxide adduct. Examples of the polyol-type nonionic surface-active agent include fatty acid ester of glycerol, fatty acid ester of pentaerythritol, fatty acid ester of sorbitol and sorbitan, fatty acid ester of cane sugar, polyol alkyl ether, and fatty acid amide of alkanolamines.

In particular, the polyethylene glycol-type nonionic surface-active agent such as a higher alcohol ethylene oxide adduct or alkylphenol ethylene oxide adduct can be used preferably.

Examples of the aqueous medium include water such as distilled water or ion-exchanged water, and alcohols. They can be used individually or in combinations of two or more. The content of the polar surface-active agent need not be defined generally and may be selected appropriately depending on the purposes.

In the present invention, when the nonionic surface-active agent is used with the ionic surface-active agent, the polar surface-active agent may be, e.g., a sulfate-based, sulfonate-based, or phosphate-based anionic surface-active agent or an amine salt-type or quaternary ammonium salt-type cationic surface-active agent.

Specific examples of the anionic surface-active agent include sodium dodecyl benzene sulfonate, sodium dodecyl sulfate, sodium alkyl naphthalene sulfonate, and sodium dialkyl sulfosuccinate.

Specific examples of the cationic surface-active agent include alkyl benzene dimethyl ammonium chloride, alkyl trimethyl ammonium chloride, and distearyl ammonium chloride. They can be used individually or in combinations of two or more.

After the resin fused particles having a resin fused layer are produced by fusing the resin with the aggregated particles (core particles), cleaning, liquid-solid separation, and drying processes may be performed as desired to provide toner base particles. The cleaning process preferably involves sufficient substitution cleaning with ion-exchanged water to improve the chargeability. The liquid-solid separation process is not particularly limited, and any known filtration methods such as suction filtration and pressure filtration can be used preferably in view of productivity. The drying process is not particularly limited, and any known drying methods such as flash-jet drying, flow drying, and vibration-type flow drying can be used preferably in view of productivity.

(2) Wax

Preferred examples of the second wax include fatty acid hydrocarbon wax such as low molecular weight polypropylene wax, low molecular weight polyethylene wax, polypropylene-polyethylene copolymer wax, microcrystalline wax, paraffin wax, or Fischer-Tropsch wax.

As the second wax, e.g., wax obtained by the reaction of long chain alkyl alcohol, unsaturated polycarboxylic acid or its anhydride, and synthetic hydrocarbon wax also can be used. The long chain alkyl alcohol may have a carbon number of 4 to 30, and the wax preferably has an acid value of 10 to 80 mg KOH/g.

Moreover, the second wax may be obtained by the reaction of long chain alkylamine, unsaturated polycarboxylic acid or its anhydride, and unsaturated hydrocarbon wax. Alternatively, the second wax may be obtained by the reaction of long chain fluoroalkyl alcohol, unsaturated polycarboxylic acid or its anhydride, and unsaturated hydrocarbon wax. In either case, the long chain alkyl group can promote the releasing action, the ester group can improve the dispersibility of the wax with the resin, and the vinyl group can enhance the durability and the offset resistance.

For the molecular weight distribution of this wax based on GPC, it is preferable that the weight-average molecular weight is 1000 to 6000, the Z-average molecular weight is 1500 to 9000, the ratio (weight-average molecular weight/number-average molecular weight) of the weight-average molecular weight to the number-average molecular weight is 1.1 to 3.8, the ratio (Z-average molecular weight/number-average molecular weight) of the Z-average molecular weight to the number-average molecular weight is 1.5 to 6.5, there is at least one molecular weight maximum peak in the range of $1\times10^3$ to $3\times10^4$, the acid value is 10 to 80 mgKOH/g, the melting point is 80° C. to 120° C., and the penetration number is not more than 4 at 25° C.

It is more preferable that the weight-average molecular weight is 1000 to 5000, the Z-average molecular weight is 1700 to 8000, the weight-average molecular weight/number-average molecular weight ratio is 1.1 to 2.8, the Z-average molecular weight/number-average molecular weight ratio is 1.5 to 4.5, there is at least one molecular weight maximum peak in the range of $1\times10^3$ to $1\times10^4$, the acid value is 10 to 50 mgKOH/g, and the melting point is 85° C. to 100° C. It is further preferable that the weight-average molecular weight is 1000 to 2500, the Z-average molecular weight is 1900 to 3000, the weight-average molecular weight/number-average molecular weight ratio is 1.2 to 1.8, the Z-average molecular weight/number-average molecular weight ratio is 1.7 to 2.5, there is at least one molecular weight maximum peak in the range of $1\times10^3$ to $3\times10^3$, the acid value is 35 to 50 mgKOH/g, and the melting point is 90° C. to 100° C.

The wax can contribute to higher offset resistance, glossiness, and OHP transmittance in the oilless fixing. Moreover, the wax does not decrease the storage stability at high temperatures. When an image is formed by arranging three layers of color toner on a thin paper, the wax is particularly effective for improving the separability of the paper from the fixing roller or belt.

It is also possible to produce smaller particles that are emulsified and dispersed uniformly in a dispersant. Therefore, the wax can be mixed and aggregated uniformly with the resin particles and the pigment particles, which eliminates the presence of suspended solids and suppresses a dull color. Thus, the oilless fixing that provides high glossiness and high transmittance can be achieved at low temperatures while preventing offset without using oil.

By combining the toner to which the wax is added with a carrier (which will be described later), it is possible not only to achieve the oilless fixing but also to suppress the occurrence of spent on the carrier. Accordingly, the life of a developer can be made longer. Wile the uniformity of the toner in a developing unit can be maintained, the generation of a developing memory also can be reduced. Further, the charge stability can be achieved over continuous use, which ensures compatibility between the fixability and the development stability.

If the carbon number of the long chain alkyl group of the wax is less than 4, the releasing action is weakened, so that the separability and the high-temperature offset resistance are degraded. If the carbon number is more than 30, the mixing and aggregation of the wax with the resin become poor, resulting in low dispersibility. If the acid value is less than 10 mgKOH/g, the charge amount of the toner is reduced over a long period of use. If the acid value is more than 80 mgKOH/g, the moisture resistance is decreased to increase fog under high humidity. Moreover, it is difficult to reduce the particle size of the emulsified and dispersed particles of the wax.

If the melting point is less than 80° C., the storage stability of the toner is reduced, and the high-temperature offset resistance is degraded. If it is more than 120° C., the low-temperature fixability is weakened, and the color transmittance is lowered. Moreover, it is difficult to reduce the particle size of the emulsified and dispersed particles of the wax.

If the penetration number is more than 4 at 25° C., the toughness is reduced to cause filming of the toner on a photoconductive member over a long period of use.

If the weight-average molecular weight is less than 1000 the Z-average molecular weight is less than 1500, the weight-average molecular weight/number-average molecular weight ratio is less than 1.1, the Z-average molecular weight/number-average molecular weight ratio is less than 1.5, and the molecular weight maximum peak is in the range smaller than $1\times10^3$, the storage stability of the toner is degraded, thus causing filing of the toner on a photoconductive member or intermediate transfer member. The handling property of the toner in a developing unit is reduced and impairs the stability of the toner concentration in two-component development. Further, a developing memory can be generated easily. When emulsified and dispersed particles are produced under the strong shearing force of a high-speed rotating body, the particle size distribution becomes broader.

If the weight-average molecular weight is more than 6000, the Z-average molecular weight is more than 9000, the weight-average molecular weight/number-average molecular weight ratio is more than 3.8, the Z-average molecular weight/number-average molecular weight ratio is more than 6.5, and the molecular weight maximum peak is in the range larger than $3\times10^4$, the releasing action is weakened, and the offset resistance during fixing is degraded. Moreover, it is difficult to reduce the particle size of the emulsified and dispersed particles of the wax.

Examples of the alcohol include alcohols having an alkyl chain with a carbon number of 4 to 30 such as octanol ($C_8H_{17}OH$), dodecanol ($C_{12}H_{25}OH$), stearyl alcohol ($C_{18}H_{37}OH$), nonacosanol ($C_{29}H_{59}OH$), and pentadecanol ($C_{15}H_{31}OH$). Examples of the amines include N-methylhexylamine, nonylamine, stearylamine, and nonadecylamine. In addition, 1-methoxy-(perfluoro-2-methyl-1-propene), hexafluoroacetone, 3-perfluorooctyl-1,2-epoxypropane, or the like can be used preferably.

Examples of the unsaturated polycarboxylic acid or its anhydride include maleic acid, maleic anhydride, itaconic add, itaconic anhydride, citraconic add, and citraconic anhydride. They can be used individually or in combinations of two or more. In particular, the maleic acid and the maleic anhydride are preferred. Examples of the unsaturated hydrocarbon wax include ethylene, propylene, and α-olefin.

The unsaturated polycarboxylic acid or its anhydride is polymerized using alcohol or amine, and then is added to the synthetic hydrocarbon wax in the presence of dicumyl peroxide or tert-butylperoxy isopropyl monocarbonate.

The first wax includes at least one type of ester that includes at least one of higher alcohol having a carbon number of 16 to 24 and higher fatty acid having a carbon number of 16 to 24. The use of this wax can facilitate fig of the toner at low temperatures. By using the first wax with the second wax, it is possible to suppress the presence of suspended particles of the aliphatic hydrocarbon wax that are not incorporated into the core particles, and also to prevent the particle size distribution of the core particles from being broader. Moreover, when the second resin particles are added and fused to form a shell, the wax can reduce a phenomenon in which secondary aggregation of the core particles occurs rapidly, and the particles become coarser.

Examples of the alcohol components include monoalcohol of methyl, ethyl, propyl, or butyl, glycols such as ethylene glycol or propylene glycol and polymers thereof, triols such as glycerin and polymers thereof, polyalcohol such as pentaerythritol, sorbitan, and cholesterol. When these alcohol components are polyalcohol, the higher fatty acid may be either monosubstituted or polysubstituted.

Specific examples are as follows: esters composed of higher alcohol having a carbon number of 16 to 24 and higher fatty acid having a carbon number of 16 to 24 such as stearyl stearate, palmityl palmitate, behenyl behenate, or stearyl montanate; esters composed of higher fatty acid having a carbon number of 16 to 24 and lower monoalcohol such as butyl stearate, isobutyl behenate, propyl montanate, or 2-ethylhexyl oleate; esters composed of higher fatty acid having a carbon number of 16 to 24 and polyalcohol such as montanic acid monoethylene glycol ester, ethylene glycol distearate, glyceride monostearate, glyceride monobehenate, glyceride tripalmitate, pentaerythritol monobehenate, pentaerythritol dilinoleate, pentaerythritol trioleate, or pentaerythritol tetrastearate; and esters composed of higher fatty acid having a carbon number of 16 to 24 and a polyalcohol polymer such as diethylene glycol monobehenate, diethylene glycol dibehenate, dipropylene glycol monostearate, diglyceride distearate, triglyceride tetrastearate, tetraglyceride hexabehenate, or decaglyceride decastearate. These waxes can be used individually or in combinations of two or more.

If the carbon number of the alcohol component and/or the acid component is less than 16, the wax is not likely to function as a dispersion assistant. If it is more than 24, the wax is not likely to function as a low-temperature fixing assistant.

The wax particle dispersion may be prepared in such a manner that wax is mixed in an aqueous medium (e.g., ion-exchanged water) including the surface-active agent, and then is heated, melted, and dispersed.

The first wax preferably has an iodine value of not more than 25 and a saponification value of 30 to 300. By using the first wax with the second wax, an increase in the particle size can be prevented, thus producing toner base particles formed of the core particles having a small particle size and a narrow particle size distribution. More preferably, the first wax has an iodine value of not more than 18 and a saponification value of 30 to 150. Further preferably, the first wax has an iodine value of not more than 15 and a saponification value of 50 to 130.

If the iodine value is more than 25, suspended solids in the aqueous medium are increased significantly, and the wax, resin, and colorant particles cannot be formed uniformly into core particles. Thus, the particles become coarser and the particle size distribution tends to be broader. If the saponification value is less than 30, the presence of unsaponifiable matter and hydrocarbon is increased and makes it difficult to form small uniform aggregated particles. This may result in filming of the toner on a photoconductive member, low chargeability of the toner, and a reduction in chargeability during continuous use. If the saponification value is more than 300, suspended solids in the aqueous medium are increased significantly.

The wax preferably has a heating loss of not more than 8 wt % at 220° C. If the heating loss is more than 8 wt %, the glass transition point of the toner becomes low, and the storage stability is degraded. Therefore, such wax adversely affects the development property and allows fog or filming of the toner on a photoconductive member to occur. The particle size distribution of the toner becomes broader.

In the molecular weight characteristics of the wax based on gel permeation chromatography (GPC), it is preferable that the number-average molecular weight is 100 to 5000, the weight-average molecular weight is 200 to 10000, the ratio (weight-average molecular weight/number-average molecular weight) of the weight-average molecular weight to the number-average molecular weight is 1.01 to 8, the ratio (Z-average molecular weight/number-average molecular weight) of the Z-average molecular weight to the number-average molecular weight is 1.02 to 10, and there is at least one molecular weight maximum peak in the range of $5\times10^2$ to $1\times10^4$.

It is more preferable that the number-average molecular weight is 500 to 4500, the weight-average molecular weight is 600 to 9000, the weight-average molecular weight/number-average molecular weight ratio is 1.01 to 7, and the Z-average molecular weight/number-average molecular weight ratio is 1.02 to 9. It is further preferable that the number-average molecular weight is 700 to 4000, the weight-average molecular weight is 800 to 8000, the weight-average molecular weight/number-average molecular weight ratio is 1.01 to 6, and the Z-average molecular weight/number-average molecular weight ratio is 1.02 to 8.

If the number-average molecular weight is less than 100, the weight-average molecular weight is less than 200, or the molecular weight maximum peak is in the range smaller than $5\times10^2$, the storage stability is degraded. The filming of the toner on a photoconductive member may occur easily. Moreover, the particle size distribution of the toner tends to be broader.

If the number-average molecular weight is more than 5000, the weight-average molecular weight is more than 10000, the weight-average molecular weight/number-average molecular weight ratio is more than 8, the Z-average molecular weight/number-average molecular weight ratio is more than 10, and the molecular weight maximum peak is in the range larger than $1\times10^4$, the releasing action is weakened, and the fixing functions such as fixability and offset resistance are degraded. Moreover, it is difficult to reduce the particle size of the emulsified and dispersed particles of the wax.

Materials for the wax may be, e.g., meadowfoam oil, jojoba oil, Japan wax, beeswax, ozocerite, carnauba wax, candelilla wax, ceresin wax, rice wax, and derivatives thereof. They can be used individually or in combinations of two or more.

Examples of the meadowfoam oil derivative include meadowfoam oil fatty acid, a metal salt of the meadowfoam oil fatty acid, meadowfoam oil fatty acid ester, hydrogenated meadowfoam oil, and meadowfoam oil triester. These materials can produce an emulsified dispersion having a small particle size and a uniform particle size distribution. Moreover, the materials are effective to perform the oilless fixing, to increase the life of a developer, and to improve the transfer property. They can be used individually or in combinations of two or more.

Examples of the meadowfoam oil fatty acid ester include methyl, ethyl, butyl, and esters of glycerin, pentaerythritol, polypropylene glycol and trimethylol propane. In particular, e.g., meadowfoam oil fatty acid pentaerythritol monoester, meadowfoam oil fatty acid pentaerythritol triester, or meadowfoam oil fatty acid trimethylol propane ester is preferred. These materials can improve the cold offset resistance as well as the high-temperature offset resistance.

The hydrogenated meadowfoam oil can be obtained by adding hydrogen to meadowfoam oil to convert unsaturated bonds to saturated bonds. This can improve the offset resistance, glossiness, and transmittance.

Moreover, an isocyanate polymer of meadowfoam oil fatty acid polyol ester, which is obtained by cross-linking a product of the esterification reaction between meadowfoam oil fatty acid and polyhydric alcohol (e.g., glycerin, pentaerythritol, or trimethylol propane) with isocyanate such as tolylene diisocyanate (TDI) or diphenylmethane-4,4'-diisocyanate (MDI), can be used preferably. This suppresses spent on a carrier, and thus can make the life of a two-component developer even longer.

Examples of the jojoba oil derivative include jojoba oil fatty acid, a metal salt of the jojoba oil fatty acid, jojoba oil fatty acid ester, hydrogenated jojoba oil, jojoba oil triester, a maleic acid derivative of epoxidized jojoba oil, an isocyanate polymer of jojoba oil fatty acid polyol ester, and halogenated modified jojoba oil. These materials can produce an emulsified dispersion having a small particle size and a uniform particle size distribution. The resin and the wax can be mixed and dispersed uniformly. Moreover, the materials are effective to perform the oilless fixing, to increase the life of a developer, and to improve the transfer property. They can be used individually or in combinations of two or more.

Examples of the jojoba oil fatty acid ester include methyl, ethyl, butyl, and esters of glycerin, pentaerythritol, polypropylene glycol and trimethylol propane. In particular, e.g., jojoba oil fatty acid pentaerythritol monoester, jojoba oil fatty acid pentaerythritol triester, or jojoba oil fatty acid trimethylol propane ester is preferred. These materials can improve the cold offset resistance as well as the high-temperature offset resistance.

The hydrogenated jojoba oil can be obtained by adding hydrogen to jojoba oil to convert unsaturated bonds to saturated bonds. This can improve the offset resistance, glossiness, and transmittance.

Moreover, an isocyanate polymer of jojoba oil fatty acid polyol ester, which is obtained by cross-linking a product of the esterification reaction between jojoba oil fatty acid and polyhydric alcohol (e.g., glycerin, pentaerythritol, or trimethylol propane) with isocyanate such as tolylene diisocyanate (TDI) or diphenylmethane-4,4'-diisocyanate (MDI), can be used preferably. This suppresses spent on a carrier, and thus can make the life of a two-component developer even longer.

The saponification value is the milligrams of potassium hydroxide (KOH) required to saponify a 1 g sample and corresponds to the sum of an acid value and an ester value. When the saponification value is measured, a sample is saponified with approximately 0.5N potassium hydroxide in an alcohol solution, and then excess potassium hydroxide is titrated with 0.5N hydrochloric acid.

The iodine value may be determined in the following manner. The amount of halogen absorbed by a sample is measured while the halogen acts on the sample. Then, the amount of halogen absorbed is converted to iodine and expressed in grams per 100 g of the sample. The iodine value is grams of iodine absorbed, and the degree of unsaturation of fatty acid in the sample increases with the iodine value. A chloroform or carbon tetrachloride solution is prepared as a sample, and an alcohol solution of iodine and mercuric chloride or a glacial acetic acid solution of iodine chloride is added to the sample. After the sample is allowed to stand, the iodine that remains without undergoing any reaction is titrated with a sodium thiosulfate standard solution, thus calculating the amount of iodine absorbed.

The heating loss may be measured in the following manner. A sample cell is weighed precisely to the first decimal place (W1 mg). Then, 10 to 15 mg of sample is placed in the sample cell and weighed precisely to the first decimal place (W2 mg). This sample cell is set in a differential thermal balance and measured with a weighing sensitivity of 5 mg. After measurement, the weight loss (W3 mg) of the sample at 220° C. is read to the first decimal place using a chart. The measuring device is, e.g., TGD-3000 (manufactured by ULVAC-RICO, Inc.), the rate of temperature rise is 10° C./min, the maximum temperature is 220° C., and the retention time is 1 min. Accordingly, the heating loss (%) can be determined by W3/(W2−W1)×100.

Thus, the transmittance in color images and the offset resistance can be improved. Moreover, it is possible to suppress spent on a carrier and to increase the life of a developer.

Preferred materials that can be used together or instead of the above wax as the first wax may be, e.g., a derivative of hydroxystearic acid, glycerin fatty add ester, glycol fatty acid ester, or sorbitan fatty acid ester. They can be used individually or in combinations of two or more. These materials can produce smaller particles that are emulsified and dispersed uniformly. By using the first wax with the second wax, an increase in the particle size can be prevented, thus producing toner base particles having a small particle size and a narrow particle size distribution. Thus, the oilless fixing that provides high glossiness and high transmittance can be achieved at low temperatures while preventing offset without using oil.

Examples of the derivative of hydroxystearic acid include methyl 12-hydroxystearate, butyl 12-hydroxystearate, propylene glycol mono 12-hydroxystearate, glycerin mono 12-hydroxystearate, and ethylene glycol mono 12-hydroxystearate. These materials have the effects of preventing filming and winding of paper in the oilless fixing. Examples of the glycerin fatty acid ester include glycerol stearate, glycerol distearate, glycerol tristearate, glycerol monopalmitate, glycerol dipalmitate, glycerol tripalmitate, glycerol behenate, glycerol dibehenate, glycerol tribehenate, glycerol monomyristate, glycerol dimyristate, and glycerol trimyristate. These materials have the effects of relieving cold offset at low temperatures in the oilless fixing and preventing a reduction in transfer property.

Examples of the glycol fatty acid ester include propylene glycol fatty acid ester such as propylene glycol monopalmitate or propylene glycol monostearate and ethylene glycol fatty acid ester such as ethylene glycol monostearate or ethylene glycol monopalmitate. These materials have the effects of improving the oilless fixability and preventing spent on a carrier while increasing the sliding property in development.

Examples of the sorbitan fatty acid ester include sorbitan monopalmitate, sorbitan monostearate, sorbitan tripalmitate, and sorbitan tristearate. Moreover, stearic acid ester of pentaerythritol, mixed esters of adipic acid and stearic add or oleic acid, and the like are preferred. They can be used individually or in combinations of two or more. These materials have the effects of preventing filming and winding of paper in the oilless fixing.

The above wax should be incorporated uniformly into the resin so as not to be liberated or suspended during mixing and aggregation. This may be affected by the particle size distribution, composition, and melting property of the wax.

The wax particle dispersion may be prepared in such a manner that wax is mixed in an aqueous medium (e.g., ion-exchanged water) including the surface-active agent, and then is heated, melted, and dispersed.

In this case, the wax may be emulsified and dispersed so that the particle size is 20 to 200 nm for 16% diameter (PR16), 40 to 300 nm for 50% diameter (PR50), not more than 400 nm for 84% diameter (PR84), and PR84/PR16 is 1.2 to 2.0 in a cumulative volume particle size distribution obtained by accumulation from the smaller particle diameter side. It is preferable that the ratio of particles having a diameter not greater than 200 nm is 65 vol % or more, and the ratio of particles having a diameter greater than 500 nm is 10 vol % or less.

Preferably the particle size may be 20 to 100 nm for 16% diameter (PR16), 40 to 160 nm for 50% diameter (PR50), not more than 260 nm for 84% diameter (PR84), and PR84/PR16 is 1.2 to 1.8 in the cumulative volume particle size distribution obtained by accumulation from the smaller particle diameter side. It is preferable that the ratio of particles having a diameter not greater than 150 nm is 65 vol % or more, and the ratio of particles having a diameter greater than 400 nm is 10 vol % or less.

More preferably, the particle size may be 20 to 60 nm for 16% diameter (PR16), 40 to 120 nm for 50% diameter (PR50), not more than 220 nm for 84% diameter (PR84), and PR84/PR16 is 1.2 to 1.8 in the cumulative volume particle size distribution obtained by accumulation from the smaller particle diameter side. It is preferable that the ratio of particles having a diameter not greater than 130 nm is 65 vol % or more, and the ratio of particles having a diameter greater than 300 nm is 10 vol % or less.

When the resin particle dispersion, the colorant particle dispersion, and the wax particle dispersion are mixed to form aggregated particles, the wax is dispersed finely and thus incorporated easily into the resin particles. Therefore, it is possible to prevent aggregation of the wax particles themselves that are not aggregated with the resin particles and the colorant particles, to achieve uniform dispersion, and to eliminate the suspended particles in the aqueous medium. Moreover when the aggregated particles are heated and melted in the aqueous medium, the molten wax is covered with the molten resin particles due to surface tension, so that the wax can be incorporated easily into the resin particles.

If the particle size is more than 200 nm for PRIG, more than 300 nm for PR50, and more than 400 nm for PR84, PR84/PR16 is more than 2.0, the ratio of particles having a diameter not greater than 200 nm is less than 65 vol %, or the ratio of particles having a diameter greater than 500 nm is more than 10 vol %, the wax particles are not incorporated easily into the resin particles and thus are prone to aggregation by themselves. Therefore, a large number of particles that are not incorporated into the resin particles are likely to be suspended in the aqueous medium. When the aggregated particles are heated and melted in the aqueous medium, the molten wax is not covered with the molten resin particles, so that the wax cannot be incorporated easily into the resin particles. Moreover, the amount of wax that is exposed on the surfaces of the aggregated particles and liberated therefrom is increased while further resin particles are fused. This may increase filing of the toner on a photoconductive member or spent of the toner on a carrier, reduce the handling property of the toner in a developing unit, and cause a developing memory.

If the particle size is less than 20 nm for PR16 and less than 40 nm for PR50, and PR84/PR16 is less than 1.2, it is difficult to maintain the dispersion state, and reaggregation of the wax occurs during the time it is allowed to stand, so that the standing stability of the particle size distribution can be degraded. Moreover, the load and heat generation are increased while the particles are dispersed, thus reducing productivity.

The wax particles can be dispersed finely in the following manner. A wax melt in which the wax is melted at a concentration of not more than 40 wt % is emulsified and dispersed into a medium that includes a surface-active agent and is maintained at temperatures not less than the melting point of the wax by utilizing the effect of a strong shearing force generated when a rotating body rotates at high speed relative to a fixed body with a predetermined gap between them.

Figure 3:
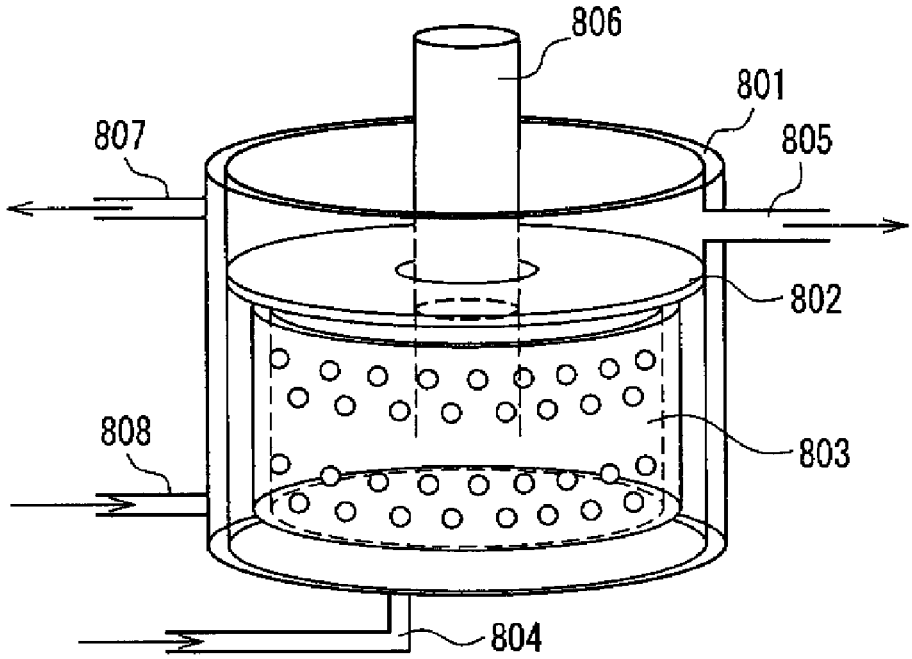
FIG. 3 is a schematic perspective view showing a stirring/dispersing device used in an example of the present invention.
Figure 4:
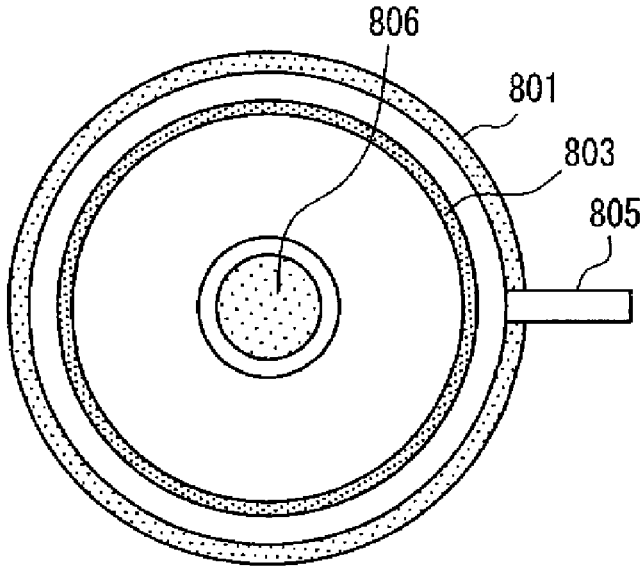
FIG. 4 is a plan view of the stirring/dispersing device in FIG. 3.

As shown in FIGS. 3 and 4, e.g., a rotating body may be placed in a tank having a certain capacity so that there is a gap of about 0.1 mm to 10 mm between the side of the rotating body and the tank wall. The rotating body rotates at a high speed of not less than 30 m/s, preferably not less than 40 m/s, and more preferably not less than 50 m/s and exerts a strong shearing force on the liquid, thus producing an emulsified dispersion with a finer particle size. A 30-second to 5-minute treatment may be enough to obtain the fine dispersion.

Figure 5:
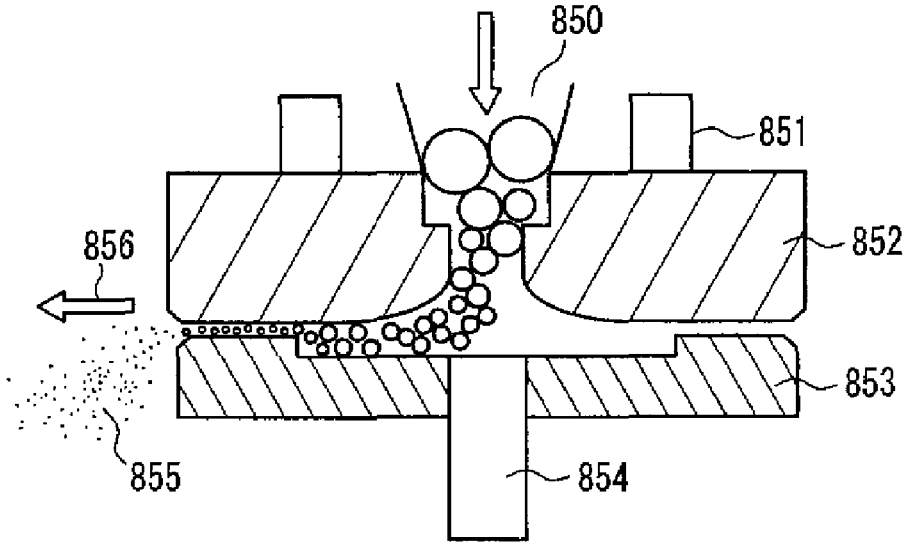
FIG. 5 is a schematic perspective view showing a stirring/dispersing device used in an example of the present invention.
Figure 6:
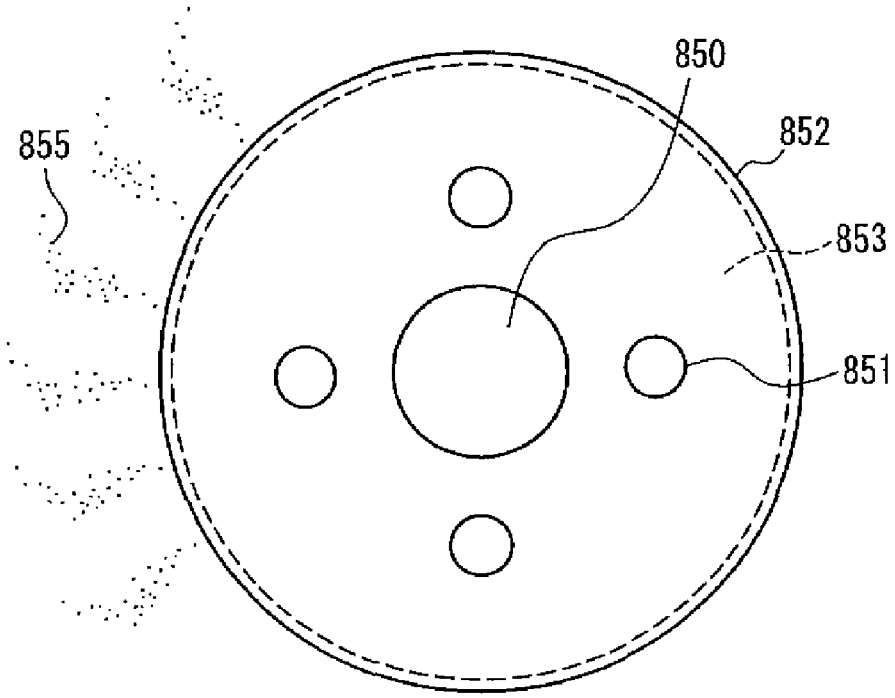
FIG. 6 is a plan view of the stirring/dispersing device in FIG. 5.

As shown in FIGS. 5 and 6, e.g., a rotating body may rotate at a speed of not less than 30 m/s, preferably not less than 40 m/s, and more preferably not less than 50 m/s relative to a fixed body, while a gap of about 1 to 100 μm is kept between them. This configuration also can provide the effect of a strong shearing force, thus producing a fine dispersion.

In this manner it is possible to form a narrower and sharper particle size distribution of the fine particles than using a dispersing device such as a homogenizer. It is also possible to maintain a stable dispersion state without causing any reaggregation of the fine particles in the dispersion even when left standing for a long time. Thus, the standing stability of the particle size distribution can be improved.

When the wax has a high melting point, it may be heated under high pressure to form a melt. Alternatively, the wax may be dissolved in an oil solvent. This solution is blended with a surface-active agent or polyelectrolyte and dispersed in water to make a fine particle dispersion by using either of the dispersing devices as shown in FIGS. 3 and 4 and FIGS. 5 and 6, and then the oil solvent is evaporated by heating or under reduced pressure.

The particle size can be measured, e.g., by using a laser diffraction particle size analyzer LA920 (manufactured by Horiba, Ltd.) or SALD2100 (manufactured by Shimadzu Corporation).

(3) Resin

As the resin particles of the toner of this embodiment, e.g., a thermoplastic binder resin can be used. Specific examples of the thermoplastic binder resin include the following: styrenes such as styrene, parachloro styrene, and α-methyl styrene; acrylic monomers such as methyl acrylate, ethyl acrylate, n-propyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; a homopolymer of unsaturated polycarboxylic acid monomers having a carboxyl group as a dissociation group such as acrylic acid, methacrylic acid, maleic acid, or fumaric acid; a copolymer of two or more or these monomers; or a mixture of these substances.

The concentration of resin particles in the resin particle dispersion is 5 to 50 wt %, and preferably 20 to 45 wt %.

The molecular weights of the resin, wax, and toner can be measured by gel permeation chromatography (GPC) using several types of monodisperse polystyrene as standard samples.

The measurement may be performed with HLC 8120 GPC series manufactured by TOSOH CORP., using TSK gel super HM-H H4000/H3000/H2000 (6.0 mm I.D.-150 mm×3) as a column and THF (tetrahydrofuran) as an eluent, at a flow rate of 0.6 mL/min, a sample concentration of 0.1%, an injection amount of 20 μL, RI as a detector, and at a temperature of 40° C. Prior to the measurement, the sample is dissolved in THF and allowed to stand overnight, and then is filtered through a 0.45 μm membrane filter so that additives such as silica are removed to measure the resin component. The measurement requirement is that the molecular weight distribution of the subject sample is in the range where the logarithms and the count numbers of the molecular weights in the analytical curve obtained from the several types of monodisperse polystyrene standard samples form a straight line.

The wax obtained by the reaction of long chain alkyl alcohol, unsaturated polycarboxylic acid or its anhydride, and synthetic hydrocarbon wax can be measured with GPC-150C (manufactured by Waters Corporation), using Shodex HT-806M (8.0 mm I.D.-30 cm×2) as a column and o-dichlorobenzene as an eluent, at a flow rate of 1.0 mL/min, a sample concentration of 0.3%, an injection amount of 200 μL, RI as a detector, and at a temperature of 130° C. Prior to the measurement, the sample is dissolved in a solvent, and then is filtered through a 0.5 μm sintered metal filter. The measurement requirement is that the molecular weight distribution of the subject sample is in the range where the logarithms and the count numbers of the molecular weights in the analytical curve obtained from the several types of monodisperse polystyrene standard samples form a straight line.

The softening point of the binder resin can be measured with a capillary rheometer flow tester (CFT-500, constant-pressure extrusion system, manufactured by Shimadzu Corporation). A load of about $9.8\times10^5$ N/m$^2$ is applied to a 1 cm$^3$ sample with a plunger while heating the sample at a temperature increase rate of 6° C./min, so that the sample is extruded from a die having a diameter of 1 mm and a length of 1 mm.

Based on the relationship between the piston stroke of the plunger and the temperature increase characteristics, when the temperature at which the piston stroke starts to occur is a flow start temperature (Tfb), one-half the difference between the minimum value of a curve and the flow end point is determined. Then, the resultant value and the minimum value of the curve are added to define a point, and the temperature of this point is identified as a melting point (softening point Tm) according to a ½ method.

The glass transition point of the resin can be measured with a differential scanning calorimeter (DSC-50 manufactured by Shimadzu Corporation). The temperature of a sample is raised to 100° C., retained for 3 minutes, and reduced to room temperature at 10° C./min. Subsequently, the temperature is raised at 10° C./min and a thermal history of the sample is measured. In the thermal history, an intersection point of an extension line of the base line lower than a glass transition point and a tangent that shows the maximum inclination between the rising point and the highest point of a peak is determined. The temperature of this intersection point is identified as a glass transition point.

The melting point at an endothermic peak of the wax based on the DSC method can be measured with a differential scanning calorimeter (DSC-50 manufactured by Shimadzu Corporation). The temperature of a sample is raised to 200° C. at 5° C./min, retained for 5 minutes, and reduced to 10° C. rapidly, Subsequently, the sample is allowed to stand for 15 minutes, and the temperature is raised at 5° C./min. Then, the melting point is determined from the endothermic (melt) peak. The amount of the sample placed in a cell is 10 mg ±2 mg.

(4) Pigment

The colorant (pigment) used in this embodiment may include, e.g., carbon black, iron black, graphite, nigrosine, a metal complex of azo dyes, acetoacetic acid aryl amide monoazo yellow pigments such as C. I. Pigment Yellow 1, 3, 74, 97, and 98, acetoacetic acid aryl amide disazo yellow pigments such as C. I. Pigment Yellow 12, 13, 14, and 17, C.I. Solvent Yellow 19, 77, and 79, or C. I. Disperse Yellow 164. In particular, benzimidazolone pigments of C. I. Pigment Yellow 93, 180, and 185 are suitable.

One or more selected from red pigments such as C. I. Pigment Red 48, 49:1, 53:1, 57, 57:1, 81,122 and 5, red dyes such as C.I. Solvent Red 49, 52, 58 and 8, and blue dyes/pigments of phthalocyanine and its derivative such as C. I. Pigment Blue 15:3 may be added. The added amount is preferably 3 to 8 parts by weight per 100 parts by weight of the binder resin.

The median diameter of the pigment particles is generally not more than 1 μm, and preferably 0.01 to 1 μm. If the median diameter is more than 1 μm, toner as a final product for electrostatic charge image development can have a broader particle size distribution. Moreover, liberated particles are generated and tend to reduce the performance or reliability. When the median diameter is within the above range, these disadvantages are eliminated, and the uneven distribution of the toner is decreased. Therefore, the dispersion of the pigment particles in the toner can be improved, resulting in a smaller variation in performance and reliability. The median diameter can be measured, e.g., by a laser diffraction particle size analyzer (LA 920 manufactured by Horiba, Ltd.).

(5) Additive

In this embodiment, inorganic fine powder is added as an additive. Examples of the additive include metal oxide fine powder such as silica, alumina, titanium oxide, zirconia, magnesia, ferrite or magnetite, titanate such as barium titanate, calcium titanate, or strontium titanate, zirconate such as barium zirconate, calcium zirconate, or strontium zirconate, and a mixture of these substances. The additive can be made hydrophobic as needed.

Preferred examples of a silicone oil material that is used to treat the additive include dimethyl silicone oil, methyl hydrogen silicone oil, methyl phenyl silicone oil, epoxy modified silicone oil, carboxyl modified silicone oil, alkyl modified silicone oil, fluorine modified silicone oil, amino modified silicone oil, and chlorophenyl modified silicone oil. The additive that is treated with at least one of the above silicone oil materials is used preferably. For example, SH200, SH510, SF230, SH203, BY16-823, or BY16-855B manufactured by Toray-Dow Corning Co., Ltd. can be used. The treatment may be performed by mixing the additive and the silicone oil material with a mixer (e.g., a Henshel mixer). Moreover, the silicone oil material may be sprayed onto the additive. Alternatively, the silicone oil material may be dissolved or dispersed in a solvent, and mixed with the additive, followed by removal of the solvent. The amount of silicone oil material is preferably 1 to 20 parts by weight per 100 parts by weight of the additive.

Examples of a silane coupling agent include dimethyldichlorosilane, trimethylchlorosilane, allyldimethylchlorosilane, and hexamethyldisilazane. The silane coupling agent may be treated by a dry treatment in which the additive is fluidized by agitation or the like, and an evaporated silane coupling agent is reacted with the fluidized additive, or a wet treatment in which a silane coupling agent dispersed in a solvent is added dropwise to the additive.

It is also preferable that the silicone oil material is treated after a silane coupling treatment.

The additive having positive chargeability may be treated with aminosilane, amino modified silicone oil, or epoxy modified silicone oil.

To enhance a hydrophobic treatment, hexamethyldisilazane, dimethyldichlorosilane, or other silicone oil also can be used along with the above materials. For example, at least one selected from dimethyl silicone oil, methylphenyl silicone oil, and alkyl modified silicone oil is preferred to treat the inorganic fine powder.

It is also preferable that the surface of the additive is treated with one or more selected from fatty acid ester, fatty acid amide, fatty add, and fatty acid metal salt (referred to as "fatty acid or the like" in the following. The surface-treated silica or titanium oxide fine powder is more preferred.

Examples of the fatty acid and the fatty acid metal salt include caprylic add, capric acid, undecylic acid, lauric acid, myristic acid, palmitic acid, stearic acid, behenic acid, montanic acid, lacceric add, oleic acid, erucic acid, sorbic acid, and linoleic acid. In particular, fatty acid having a carbon number of 12 to 22 is preferred.

Metals of the fatty acid metal salt may be, e.g., aluminum, zinc, calcium, magnesium, lithium, sodium, lead, or barium. Among these metals, aluminum, zinc, and sodium are preferred. Further, mono- and di-fatty acid aluminum such as aluminum distearate ($Al(OH)(C_{17}H_{35}COO)_2$) or aluminum monostearate ($Al(OH)_2(C_{17}H_{35}COO)$) are particularly preferred. By containing a hydroxy group, they can prevent overcharge and suppress a transfer failure. Moreover, it is possible to improve the treatment of the additive.

Preferred examples of aliphatic amide include saturated or mono-unsaturated aliphatic amide having a carbon number of 16 to 24 such as palmitic acid amide, palmitoleic acid amide, stearic acid amide, oleic acid amide, arachidic acid amide, eicosanoic acid amide, behenic acid amide, erucic acid amide, or lignoceric acid amide.

Preferred examples of the fatty acid ester include the following: esters composed of higher alcohol having a carbon number of 16 to 24 and higher fatty add having a carbon number of 16 to 24 such as stearyl stearate, palmityl palmitate, behenyl behenate, or stearyl montanate; esters composed of higher fatty acid having a carbon number of 16 to 24 and lower monoalcohol such as butyl stearate, isobutyl behenate, propyl montanate, or 2-ethylhexyl oleate; fatty acid pentaerythritol monoester; fatty acid pentaerythritol triester; and fatty acid trimethylol propane ester.

Moreover, materials such as a derivative of hydroxystearic add and polyol fatty acid ester such as glycerin fatty acid ester, glycol fatty acid ester, or sorbitan fatty acid ester are preferred. They can be used individually or in combinations of two or more.

In a preferred surface treatment, the surface of the additive preferably is treated with a fatty acid or the like after it has been treated with a coupling agent and/or silicone oil. This is because a more uniform treatment can be performed than when hydrophilic silica merely is treated with a fatty acid, high charging of the toner can be achieved, and the flowability can be improved when the additive is added to the toner. The above effect also can be obtained by treating with a fatty acid or the like along with a coupling agent and/or silicone oil.

The surface treatment may be performed by dissolving the fatty acid or the like in a hydrocarbon organic solvent such as toluene, xylene, or hexane, wet mixing this solution with an additive such as silica, titanium oxide, or alumina in a dispersing device, and allowing the fatty acid or the like to adhere to the surface of the additive with the treatment agent. After the surface treatment, the solvent is removed, and a drying process is performed.

It is preferable that the mixing ratio of polysiloxane to the fatty acid or the like is 1:2 to 20:1. If the fatty acid or the like is increased to a ratio higher than 1:2, the charge amount of the additive becomes high, the image density is reduced, and charge-up is likely to occur in two-component development. If the fatty acid or the like is decreased to a ratio lower than 20:1, the effect of suppressing transfer voids or reverse transfer is reduced.

In this case, the ignition loss of the additive whose surface has been treated with the fatty acid or the like is preferably 1.5 to 25 wt %, more preferably 5 to 25 wt %, and further preferably 8 to 20 wt %. If the ignition loss is smaller than 1.5 wt %, the treatment agent does not function sufficiently, and the chargeability and the transfer property cannot be improved. If the ignition loss is larger than 25 wt %, the treatment agent remains unused and adversely affects the developing property or durability.

Unlike the conventional pulverizing process, the surface of the individual toner base particles produced in the present invention consists mainly of resin. Therefore, it is advantageous in terms of charge uniformity, but affinity with the additive used for the charge-imparting property or charge-retaining property becomes important.

It is preferable that the additive having an average particle size of 6 nm to 200 nm is added in an amount of 1 to 6 parts by weight per 100 parts by weight of toner base particles. If the average particle size is less than 6 nm, suspended particles are generated, and filming of the toner on a photoconductive member is likely to occur. Therefore, it is difficult to avoid the occurrence of reverse transfer. If the average particle size is more than 200 nm, the flowability of the toner is decreased. If the amount of the additive is less than 1 part by weight, the flowability of the toner is decreased, and it is difficult to avoid the occurrence of reverse transfer. If the amount of the additive is more than 6 parts by weight, suspended particles are generated, and filming of the toner on a photoconductive member is likely to occur, thus degrading the high-temperature offset resistance.

Moreover it is preferable that at least the additive having an average particle size of 6 nm to 20 nm is added in an amount of 0.5 to 2.5 parts by weight per 100 parts by weight of the toner base particles, and the additive having an average particle size of 20 nm to 200 nm is added in an amount of 0.5 to 3.5 parts by weight per 100 parts by weight of toner base particles. With this configuration, the additives of different functions can improve both the charge-imparting property and the charge-retaining property, and also can ensure larger tolerances against reverse transfer, transfer voids, and scattering of the toner during transfer. In this case, the ignition loss of the additive having an average particle size of 6 nm to 20 nm is preferably 0.5 to 20 wt %, and the ignition loss of the additive having an average particle size of 20 nm to 200 nm is preferably 1.5 to 25 wt %. When the ignition loss of the additive having an average particle size of 20 nm to 200 nm is larger than that of the additive having an average particle size of 6 nm to 20 nm, it is effective in improving the charge-retaining property and suppressing reverse transfer and transfer voids.

By specifying the ignition loss of the additive, larger tolerances can be ensured against reverse transfer, transfer voids, and scattering of the toner during transfer. Moreover, the handling property of the toner in a developing unit can be improved, thus increasing the uniformity of the toner concentration. The generation of a developing memory also can be reduced.

If the ignition loss of the additive having an average particle size of 6 nm to 20 nm is less than 0.5 wt %, the tolerances against reverse transfer and transfer voids become narrow. If the ignition loss is more than 20 wt %, the surface treatment is not uniform, resulting in charge variations. The ignition loss is preferably 1.5 to 17 wt %, and more preferably 4 to 10 wt %.

If the ignition loss of the additive having an average particle size of 20 nm to 200 nm is less than 1.5 wt %, the tolerances against reverse transfer and transfer voids become narrow. If the ignition loss is more than 25 wt %, the surface treatment is not uniform, resulting in charge variations. The ignition loss is preferably 2.5 to 20 wt %, and more preferably 5 to 15 wt %.

Further, it is preferable that at least the additive having an average particle size of 6 nm to 20 nm and an ignition loss of 0.5 to 20 wt % is added in an amount of 0.5 to 2 parts by weight per 100 parts by weight of the toner base particles, the additive having an average particle size of 20 nm to 100 nm and an ignition loss of 1.5 to 25 wt % is added in an amount of 0.5 to 3.5 parts by weight per 100 parts by weight of the toner base particles, and the additive having an average particle size of 100 nm to 200 nm and an ignition loss of 0.1 to 10 wt % is added in an amount of 0.5 to 2.5 parts by weight per 100 parts by weight of toner base particles. With this configuration, the additives of different functions, having the specified average particle size and ignition loss, can improve both the charge-imparting property and the charge-retaining property, suppress reverse transfer and transfer void, and remove a substance attached to the surface of a carrier.

It is also preferable that a positively charged additive having an average particle size of 6 nm to 200 nm and an ignition loss of 0.5 to 25 wt % is added further in an amount of 0.2 to 1.5 parts by weight per 100 parts by weight of toner base particles.

The addition of the positively charged additive can suppress the overcharge of the toner for a long period of continuous use and increase the life of a developer. Therefore, the scattering of the toner during transfer caused by overcharge also can be reduced. Moreover, it is possible to prevent spent on a carrier. If the amount of positively charged additive is less than 0.2 parts by weight, these effects are not likely to be obtained. If it is more than 1.5 parts by weight, fog is increased significantly during development. The ignition loss is preferably 1.5 to 20 wt %, and more preferably 5 to 19 wt %.

A drying loss (%) can be determined in the following manner. A container is dried, allowed to stand and cool, and weighed precisely beforehand. Then, a sample (about 1 g) is put in the container, weighed precisely, and dried for 2 hours with a hot-air dryer at 105° C.±1° C. After cooling for 30 minutes in a desiccator, the weight is measured, and the drying loss is calculated by the following formula.

Drying loss (%)=[weight loss (g) by drying/sample amount (g)]×100.

An ignition loss can be determined in the following manner. A magnetic crucible is dried, allowed to stand and cool, and weighed precisely beforehand. Then, a sample (about 1 g) is put in the crucible, weighed precisely, and ignited for 2 hours in an electric furnace at 500° C., After cooling for 1 hour in a desiccator, the weight is measured, and the ignition loss is calculated by the following formula.

Ignition loss (%)=[weight loss (g) by ignition/sample amount (g)]×100.

(6) Powder Physical Characteristics of Toner

In this embodiment, it is preferable that toner base particles including a binder resin, a colorant, and wax have a volume-average particle size of 3 to 7 μm, the content of the toner base particles having a particle size of 2.52 to 4 μm in a number distribution is 10 to 75% by number, the toner base particles having a particle size of 4 to 6.06 μm in a volume distribution is 25 to 75% by volume, the toner base particles having a particle size of not less than 8 μm in the volume distribution is not more than 5% by volume, P46/V46 is in the range of 0.5 to 1.5 where V46 is the volume percentage of the toner base particles having a particle size of 4 to 6.06 μm in the volume distribution and P46 is the number percentage of the toner base particles having a particle size of 4 to 6.06 μm in the number distribution, the coefficient of variation in the volume-average particle size is 10 to 25%, and the coefficient of variation in the number particle size distribution is 10 to 28%.

More preferably the toner base particles have a volume-average particle size of 3 to 6.5 μm, the content of the toner base particles having a particle size of 2.52 to 4 μm in the number distribution is 20 to 75% by number, the toner base particles having a particle size of 4 to 6.06 μm in the volume distribution is 35 to 75% by volume, the toner base particles having a particle size of not less than 8 μm in the volume distribution is not more than 3% by volume, P46/V46 is in the range of 0.5 to 1.3, the coefficient of variation in the volume-average particle size is 10 to 20%, and the coefficient of variation in the number particle size distribution is 10 to 23%.

Further preferably, the toner base particles have a volume-average particle size of 3 to 5 μm, the content of the toner base particles having a particle size of 2.52 to 4 μm in the number distribution is 40 to 75% by number, the toner base particles having a particle size of 4 to 6.06 μm in the volume distribution is 45 to 75% by volume, the toner base particles having a particle size of not less than 8 μm in the volume distribution is not more than 3% by volume, P46/V46 is in the range of 0.5 to 0.9, the coefficient of variation in the volume-average particle size is 10 to 15%, and the coefficient of variation in the number particle size distribution is 10 to 18%.

The toner base particles with the above characteristics can provide high-resolution image quality, prevent reverse transfer and transfer voids during tandem transfer, and achieve the oilless fixing. The fine powder in the toner affects the flowability, image quality, and storage stability of the toner, filming of the toner on a photoconductive member, developing roller, or transfer member, the aging property the transfer property, and particularly the multilayer transfer property in a tandem system. The fine powder also affects the offset resistance, glossiness, and transmittance in the oilless fixing. When the toner includes wax or the like to achieve the oilless fixing, the amount of fine powder may affect compatibility between the oilless fixing and the tandem transfer property.

If the volume-average particle size is more than 7 μm, the image quality and the transfer property cannot be ensured together. If the volume-average particle size is less than 3 μm, the handling property of the toner particles in development is reduced.

If the content of the toner base particles having a particle size of 2.52 to 4 μm in the number distribution is less than 10% by number, the image quality and the transfer property cannot be ensured together. If it is more than 75% by number, the handling property of the toner particles in development is reduced. Moreover, the filming of the toner on a photoconductive member, developing roller, or transfer member is likely to occur. The adhesion of the fine powder to a heat roller is large, and thus tends to cause offset. In the tandem system, the agglomeration of the toner is likely to be stronger, which easily leads to a transfer failure of the second color during multilayer transfer. Therefore, an appropriate range is necessary.

If the toner base particles having a particle size of 4 to 6.06 μm in the volume distribution is more than 75% by volume, the image quality and the transfer property cannot be ensured together. If it is less than 25% by volume, the image quality is degraded.

If the toner base particles having a particle size of not less than 8 μm in the volume distribution is more than 5% by volume, the image quality is degraded to cause a transfer failure.

If P46/V46 is less than 0.5, the amount of fine powder is increased excessively, so that the flowability and the transfer property are decreased, and fog becomes worse. If P46/V46 is more than 1.5, the number of large particles is increased, and the particle size distribution becomes broader. Thus, high image quality cannot be achieved.

The purpose of controlling P46/V46 is to provide an index for reducing the size of the toner particles and narrowing the particle size distribution.

The coefficient of variation is obtained by dividing a standard deviation by an average particle size of the toner particles based on the measurement using a Coulter Counter (manufactured by Coulter Electronics, Inc.). When the particle sizes of n particles are measured, the standard deviation can be expressed by the square root of the value that is obtained by dividing the square of a difference between each of the n measured values and the mean value by (n−1).

In other words, the coefficient of variation indicates the degree of expansion of the particle size distribution. When the coefficient of variation of the volume particle size distribution or the number particle size distribution is less than 10%, the production becomes difficult, and the cost is increased. When the coefficient of variation of the volume particle size distribution is more than 25%, or when the coefficient of variation of the number particle size distribution is more than 28%, the particle size distribution is broader, and the agglomeration of toner is stronger. This may lead to filming of the toner on a photoconductive member, a transfer failure, and difficulty of recycling the residual toner in a cleanerless process.

The particle size distribution is measured, e.g., by using a Coulter Counter TA-II (manufactured by Coulter Electronics, Inc.). An interface (manufactured by Nikkaki Bios Co., Ltd.) for outputting a number distribution and a volume distribution and a personal computer are connected to the Coulter Counter TA-II. An electrolytic solution (about 50 ml) is prepared by including a surface-active agent (sodium lauryl sulfate) so as to have a concentration of 1%. About 2 mg of measuring toner is added to the electrolytic solution. This electrolytic solution in which the sample is suspended is dispersed for about 3 minutes with an ultrasonic dispersing device, and then is measured using the 70 μm aperture of the Coulter Counter TA-II. In the 70 μm aperture system, the measurement range of the particle size distribution is 1.26 μm to 50.8 μm. However, the region smaller than 2.0 μm is not suitable for practical use because the measurement accuracy or reproducibility is low due to the influence of external noise or the like. Therefore, the measurement range is set from 2.0 μm to 50.8 μm.

A compression ratio calculated from a static bulk density and a dynamic bulk density can be used as an index of the flowability of the toner. The toner flowability may be affected by the particle size distribution and particle shape of the toner, the additive, and the type or amount of wax. When the particle size distribution of the toner is narrow, less fine powder is present, the toner surface is not rough, the toner shape is close to spherical, a large amount of additive is added, and the additive has a small particle size, the compression ratio is reduced, and the toner flowability is increased. The compression ratio is preferably 5 to 40%, and more preferably 10 to 30%. This can ensure compatibility between the oilless fixing and the multilayer transfer property in the tandem system. If the compression ratio is less than 5%, the fixability is degraded, and particularly the transmittance is likely to be lower Moreover, toner scattering from the developing roller may be increased. If the compression ratio is more than 40%, the transfer property is decreased to cause a transfer failure such as transfer voids in the tandem system.

(7) Carrier

A carrier of this embodiment includes magnetic particles as a core material, and the surface of the core material is coated with a fluorine modified silicone resin containing an aminosilane coupling agent.

Moreover, the carrier may include composite magnetic particles including at least magnetic particles and a binder resin, and the surfaces of the composite magnetic particles are coated with the fluorine modified silicone resin containing an aminosilane coupling agent.

A thermosetting resin is suitable for the binder resin of the composite magnetic particles. Examples of the thermosetting resin include a phenol resin, an epoxy resin, a polyamide resin, a melamine resin, a urea resin, an unsaturated polyester resin, an alkyd resin, a xylene resin, an acetoguanamine resin, a furan resin, a silicone resin, a polyimide resin, and a urethane resin. Although these resins can be used individually or in combinations of two or more, it is preferable to include at least the phenol resin.

The composite magnetic particles of the present invention may be spherical particles having an average particle size of 10 to 50 g/m, preferably 10 to 40 μm, more preferably 10 to 30 μm, and most preferably 15 to 30 μm. The specific gravity of the composite magnetic particles may be 2.5 to 4.5, and particularly 2.5 to 4.0. The BET specific surface area based on nitrogen adsorption of the carrier is preferably 0.03 to 0.3 $m^2/g$. If the average particle size of the carrier is less than 10 μm, the abundance ratio of fine particles in the carrier particle distribution is increased, and the magnetization per carrier particle is reduced. Therefore, the carrier is likely to be developed on a photoconductive member. If the average particle size is more than 50 μm, the specific surface area of the carrier particles is smaller, and the toner retaining ability is decreased, causing toner scattering. For full color images including many solid portions, the reproduction of the solid portions is particularly poor.

A conventional carrier including ferrite core particles has a large specific gravity of 5 to 6, and also has a large particle size of 50 to 80 μm. Therefore, the BET specific surface area is small, and the mixing of the carrier with the toner is weak during stirring. Thus, the charge build-up property is insufficient when the toner is supplied, and toner consumption is increased. For this reason, at the time of supplying a large amount of toner, considerable fog is likely to be generated. Moreover, if the ratio of concentration of the toner to the carrier is not controlled in a narrow range, it is difficult to reduce fog and toner scattering while maintaining the image density. However, the carrier having a large specific surface area value can suppress the image deterioration, even if the concentration ratio is controlled in a broad range, so that the toner concentration can be controlled roughly.

The above toner is substantially spherical in shape and has a specific surface area value dose to that of the carrier. Therefore, the carrier and the toner can be mixed more uniformly by stirring, and the charge build-up property is good when the toner is supplied. Moreover, even if the concentration ratio of the toner to the carrier is controlled in a broader range, the image deterioration is suppressed, and fog and toner scattering can be reduced while maintaining the image density.

In this case, the image quality can be stabilized by satisfying the relationship TS/CS=2 to 110, where TS ($m^2/g$) represents the specific surface area value of the toner and CS ($m^2/g$) represents the specific surface area value of the carrier. TS/CS is preferably 2 to 50, and more preferably 2 to 30. If TS/CS is less than 2, the adhesion of the carrier is likely to occur. If it is more than 110, the concentration ratio of the toner to the carrier has to be narrow so as to reduce fog and toner scattering while maintaining the image density. Thus, the image deterioration is caused easily. The conventional carrier including ferrite core particles has a small specific surface area value. The conventional pulverized toner is irregular in shape and has a large specific surface area value.

The composite magnetic particles including magnetic particles and a phenol resin may be produced in such a manner that phenols and aldehydes react and cure while they are stirred into an aqueous medium in the presence of the magnetic particles and a basic catalyst.

The average particle size of the composite magnetic particles can be controlled by controlling the agitating speed of an agitator so that appropriate shear or consolidation is applied in accordance with the amount of water used.

The composite magnetic particles using an epoxy resin as the binder resin may be produced in such a manner that bisphenol, epihalohydrin, and lipophilized inorganic compound particles are dispersed in an aqueous medium and react in an alkaline aqueous medium.

The composite magnetic particles of the present invention may include 1 to 20 wt % of a binder resin and 80 to 99 wt % of magnetic particles. If the content of the magnetic particles is less than 80 wt %, the saturation magnetization is reduced. If it is more than 99 wt %, the binding between the magnetic particles with the phenol resin is likely to be weaker. In view of the strength of the composite magnetic particles, the content of the magnetic particles is preferably 97 wt % or less.

Examples of the magnetic particles include spinel ferrite such as magnetite or gamma iron oxide, spinel ferrite including one or more than one metal (Mn, Ni, Zn, Mg, Cu, etc.) other than iron, magnetoplumbite ferrite such as barium ferrite, and iron or alloy fine particles having an oxide layer on the surface thereof. The magnetic particles may be granular, spherical, or acicular in shape. Ferromagnetic fine particles of iron or the like also can be used, particularly when high magnetization is required. In view of the chemical stability, however, it is preferable to use ferromagnetic fine particles of the spinel ferrite such as magnetite or gamma iron oxide or the magnetoplumbite ferrite such as barium ferrite. The composite magnetic particles with desired saturation magnetization can be obtained by selecting the type and content of the ferromagnetic fine particles appropriately.

According to the measurement under a magnetic field of 1000 oersted (79.57 kA/m), the magnetization strength may be 30 to 70 $Am^2/kg$, and preferably 35 to 60 $Am^2/kg$, the residual magnetization ($\sigma r$) may be 0.1 to 20 $Am^2/kg$, and preferably 0.1 to 10 $Am^2/kg$, and the specific resistance value may be $1\times10^6$ to $1\times10^{14}$ Ωcm, preferably $5\times10^6$ to $5\times10^{13}$ Ωcm, and more preferably $5\times10^6$ to $5\times10^9$ Ωcm.

In a method for producing the carrier of the present invention, phenols and aldehydes, together with magnetic particles and a suspension stabilizer, react in an aqueous medium in the presence of a basic catalyst.

Examples of the phenols used as the binder resin include phenol, alkylphenol such as m-cresol, p-tert-butyl phenol, o-propylphenol, resorcinol, or bisphenol A, and a compound having a phenolic hydroxyl group such as halogenated phenol in which part or all of the benzene nucleus or the alkyl group is replaced by chlorine or bromine atoms. Above all, phenol is most preferred. When compounds other than phenol are used, particles are not formed easily or may have an irregular shape, even if they are formed. Therefore, phenol is most preferred in view of the shape of the particles.

Examples of the aldehydes used in the method for producing the composite magnetic particles include formaldehyde in the form of either formalin or paraformaldehyde and furfural. Above all, formaldehyde is particularly preferred.

A fluorine modified silicone resin is essential for the resin coating of the present invention. The fluorine modified silicone resin may be a cross-linked fluorine modified silicone resin obtained by the reaction between an organosilicon compound containing a perfluoroalkyl group and polyorganosiloxane. It is preferable that 3 to 20 parts by weight of the organosilicon compound containing a perfluoroalkyl group is mixed with 100 parts by weight of the polyorganosiloxane. Compared to the coating on the conventional ferrite core particles, the adhesion of the composite magnetic particles in which magnetic particles are dispersed in a curable resin is strengthened, thus improving the durability along with the chargeability (as will be described later).

The polyorganosiloxane preferably has at least one repeating unit selected from the following Chemical Formulas (1) and (2).

Chemical Formula (1):

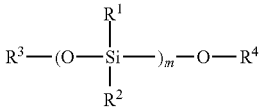

(where $R^1$ and $R^2$ are a hydrogen atom, a halogen atom, a hydroxy group, a methoxy group, an alkyl group having a carbon number of 1 to 4, or a phenyl group, $R^3$ and $R^4$ are an alkyl group having a carbon number of 1 to 4 or a phenyl group, and m represents a mean degree of polymerization and is positive integers (preferably in the range of 2 to 500, and more preferably in the range of 5 to 200)).

Chemical Formula (2):

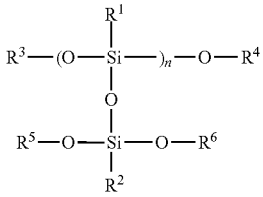

(where $R^1$ and $R^2$ are a hydrogen atom, a halogen atom, a hydroxy group, a methoxy group, an alkyl group having a carbon number of 1 to 4, or a phenyl group, $R^3$, $R^4$, $R^5$ and $R^6$ are an alkyl group having a carbon number of 1 to 4 or a phenyl group, and n represents a mean degree of polymerization and is positive integers (preferably in the range of 2 to 500, and more preferably in the range of 5 to 200)).

Examples of the organosilicon compound containing a perfluoroalkyl group include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, and $(CF_3)_2CF(CF_2)_8CH_2CH_2Si(OCH_3)_3$. In particular, a compound containing a trifluoropropyl group is preferred.

In this embodiment, the aminosilane coupling agent is included in the resin coating. As the aminosilane coupling agent, e.g., the following known materials can be used: γ-(2-aminoethyl)aminopropyltrimethoxysilane, γ-(2-aminoethyl)aminopropylmethyldimethoxysilane, and octadecylmethyl [3-(trimethoxysilyl)propyl]ammonium chloride (corresponding to SH6020, SZ6023, and AY43-021 manufactured by Toray-Dow Corning Co., Ltd.); KBM602, KBM603, KBE903, and KBM573 (manufactured by Shin-Etsu Chemical Co., Ltd.). In particular, the primary amine is preferred. The secondary or tertiary amine that is substituted with a methyl group, an ethyl group, or a phenyl group has weak polarity and is less effective for the charge build-up property of the toner. When the amino group is replaced by an aminomethyl group, an aminoethyl group, or an aminophenyl group, the end of a straight chain extended from silane of the silane coupling agent can be the primary amine. However, the amino group contained in the organic group of the straight chain does not contribute to the charge build-up property and is affected by moisture under high humidity. Therefore, although the carrier may have charging ability for the initial toner because the amino group is at the end, the charging ability is decreased during printing, resulting in a short life of the carrier.

By using the above aminosilane coupling agent with the fluorine modified silicone resin of this embodiment, the toner can be charged negatively while maintaining a sharp charge distribution. When the toner is supplied, it shows a quick rise in charge, and thus the toner consumption can be reduced. Moreover, the aminosilane coupling agent has the effect comparable to that of a cross-linking agent, and therefore can increase the degree of cross-linking of the coating of fluorine modified silicone resin as a base resin. The hardness of the resin coating is improved further, so that abrasion or peeling can be reduced over a long period of use. Accordingly, higher resistance to spent can be obtained, and the electrification can be stabilized by suppressing a decrease in the charging ability of the carrier, thus improving the durability.

When wax having a low melting point is added to toner with the above configuration in an amount not less than a predetermined value, the chargeability of the toner is rather unstable because the toner surface consists mainly of resin. There may be some cases where the chargeability is weaker and the rise in charge is slower. This tends to cause fog, poor uniformity of a solid image, and transfer voids or skipping in characters during transfer. However, combining the toner with the carrier of this embodiment can overcome these problems and improve the handling property of the toner in a developing unit, Moreover, a so-called developing memory, in which a history remains after taking a solid image, can be reduced.

The ratio of the aminosilane coupling agent to the resin is 5 to 40 wt %, and preferably 10 to 30 wt %. If the ratio is less than 5 wt %, no effect of the aminosilane coupling agent is observed. If the ratio is more than 40 wt %, the degree of cross-linking of the resin coating is excessively high, and a charge-up phenomenon is likely to occur. This may lead to image defects such as underdevelopment.

The resin coating also may include conductive fine powder to stabilize the electrification and to prevent charge-up. Examples of the conductive fine powder include carbon black such as oil furnace black or acetylene black, a semiconductive oxide such as titanium oxide or zinc oxide, and powder of titanium oxide, zinc oxide, barium sulfate, aluminum borate, or potassium titanate coated with tin oxide, carbon black, or metal. The specific resistance is preferably not more than $10^{10}$ Ω·cm. The content of the conductive fine powder is preferably 1 to 15 wt %. When the conductive fine powder is included to some extent in the resin coating, the hardness of the resin coating can be improved by a filler effect. However, if the content is more than 15 wt %, the conductive fine powder may interfere with the formation of the resin coating, resulting in lower adherence and hardness. An excessive amount of conductive fine powder in a full color developer may cause the color contamination of the toner that is transferred and fixed on paper.

A method for forming a coating on the composite magnetic particles is not particularly limited, and any known coating methods can be used, such as a dipping method of dipping the composite magnetic particles in a solution for forming a coating layer, a spraying method of spraying a solution for forming a coating layer on the surfaces of the composite magnetic particles, a fluidized bed method of spraying a solution for forming a coating layer onto the composite magnetic p articles that are floated by fluidizing air, and a kneader and coater method of mixing the composite magnetic particles and a solution for forming a coating layer in a kneader and coater, and removing a solvent. In addition to these wet coating methods, a dry coating method also can be used. The dry coating method includes, e.g., mixing resin powder and the composite magnetic particles at high speed, and fusing the resin powder on the surfaces of the composite magnetic particles by utilizing the frictional heat. In particular, the wet coating method is preferred for coating of the fluorine modified silicone resin containing an aminosilane coupling agent of the present invention.

A solvent of the solution for forming a coating layer is not particularly limited as long as it dissolves the coating resin, and can be selected in accordance with the coating resin to be used. Examples of the solvent include aromatic hydrocarbons such as toluene and xylene, ketones such as acetone and methyl ethyl ketone, and ethers such as tetrahydrofuran and dioxane.

The amount of coating resin is preferably 0.2 to 6.0 wt %, more preferably 0.5 to 5.0 wt %, further preferably 0.6 to 4.0 wt %, and most preferably 0.7 to 3 wt % with respect to the composite magnetic particles. If the amount of coating resin is less than 0.2 wt %, a uniform coating cannot be formed on the composite magnetic particles. Therefore, the carrier is affected significantly by the characteristics of the composite magnetic particles and cannot provide a sufficient effect of the fluorine modified silicone resin containing an aminosilane coupling agent. If the amount of coating resin is more than 6.0 wt %, the coating is too thick, and granulation between the composite magnetic particles occurs. Therefore, the composite magnetic particles are not likely to be uniform.

It is preferable that a baking treatment is performed after coating the composite magnetic particles with the fluorine modified silicone resin containing an aminosilane coupling agent. A system for the baking treatment is not particularly limited, and either of external and internal heating systems may be used. For example, a fixed or fluidized electric furnace, a rotary kiln electric furnace, or a burner furnace can be used as well. Alternatively, baking may be performed with a microwave. The baking temperature should be high enough to provide the effect of fluorine modified silicone that can improve the spent resistance of the resin coating, e.g., preferably 200° C. to 350° C., and more preferably 220° C. to 280° C. The treatment time is preferably 1.5 to 2.5 hours. A lower temperature may degrade the hardness of the resin coating itself, while an excessively high temperature may cause a charge reduction.

(8) Tandem Color Process

This embodiment employs the following transfer process for high-speed color image formation. A plurality of toner image forming stations, each of which includes a photoconductive member, a charging member, and a toner support member, are used. In a primary transfer process, an electrostatic latent image formed on the photoconductive member is made visible by development, and a toner image thus developed is transferred to an endless transfer member that is in contact with the photoconductive member. The primary transfer process is performed continuously in sequence so that a multilayer toner image is formed on the transfer member. Then, a secondary transfer process is performed by collectively transferring the multilayer toner image from the transfer member to a transfer medium such as paper or OHP sheet. The transfer process satisfies the relationship expressed by $$d1/v \leqq 0.65$$

where d1 (mm) is a distance between the first primary transfer position and the second primary transfer position, and v (mm/s) is a circumferential velocity of the photoconductive member. This configuration can reduce the machine size and improve the printing speed. To process at least 20 sheets (A4) per minute and to make the size small enough to be used for SOHO (small office/home office) purposes, a distance between the toner image forming stations should be as short as possible, while the processing speed should be enhanced. Thus, $d1/v \leqq 0.65$ is considered to be the minimum requirement to achieve both small size and high printing speed.

However, when the distance between the toner image forming stations is too short, e.g., when a period of time from the primary transfer of the first color (yellow toner) to that of the second color (magenta toner) is extremely short, the charge of the transfer member or the charge of the transferred toner hardly is relieved. Therefore, when the magenta toner is transferred onto the yellow toner, it is repelled by the charging action of the yellow toner. This may lead to lower transfer efficiency and transfer voids. When the third color (cyan) toner is transferred onto the yellow and the magenta toner, the cyan toner may be scattered to cause a transfer failure or considerable transfer voids. Moreover, toner having a specified particle size is developed selectively with repeated use, and the individual toner particles differ significantly in flowability, so that frictional charge opportunities are different. Thus, the charge amount is varied and further reduces the transfer property.

In such a case, therefore, the toner or two-component developer of this embodiment can be used to stabilize the charge distribution and suppress the overcharge and flowability variations. Accordingly, it is possible to prevent lower transfer efficiency, transfer voids, and reverse transfer without sacrificing the fixing property.

(9) Oilless Color Fixing

The toner of this embodiment can be used preferably in an electrographic apparatus having a fixing process with an oilless fixing configuration that applies no oil to any fixing means. For heating, electromagnetic induction heating is suitable in view of reducing a warm-up time and power consumption. The oilless fixing configuration includes a magnetic field generation means and a heating and pressing means. The heating and pressing means includes a rotational heating member and a rotational pressing member The rotational heating member includes at least a heat generation layer for generating heat by electromagnetic induction and a release layer. There is a certain nip between the rotational heating member and the rotational pressing member. The toner that has been transferred to a transfer medium such as copy paper is fixed by passing the transfer medium between the rotational heating member and the rotational pressing member. This configuration is characterized by the warm-up time of the rotational heating member that has a quick rising property as compared with a conventional configuration using a halogen lamp. Therefore, the copying operation starts before the temperature of the rotational pressing member is raised sufficiently. Thus, the toner is required to have the low-temperature fixability and a wide range of the offset resistance.

Another configuration in which a heating member is separated from a fixing member and a fixing belt runs between the two members also may be used preferably. The fixing belt may be, e.g., a nickel electroformed belt having heat resistance and deformability or a heat-resistant polyimide belt. Silicone rubber, fluorocarbon rubber, or fluorocarbon resin may be used as a surface coating to improve the releasability.

In the conventional fixing process, release oil has been applied to prevent offset. The toner that exhibits releasability without using oil can eliminate the need for application of the release oil. However, if the release oil is not applied to the fixing means, it can be charged easily. Therefore, when an unfixed toner image is close to the heating member or the fixing member, the toner may be scattered due to the influence of charge. Such scattering is likely to occur, particularly at low temperature and low humidity.

In contrast, the toner of this embodiment can achieve the low-temperature fixability and a wide range of the offset resistance without using oil. The toner also can provide high color transmittance. Thus, the use of the toner of this embodiment can suppress overcharge as well as scattering caused by the charging action of the heating member or the fixing member.

EXAMPLES

(1) Carrier Core Producing Example

In a 1 liter flask were placed 52 g of phenol, 75 g of formalin (37%), 400 g of spherical magnetite particles with an average particle size of 0.24 μm, 15 g of ammonia water (28%), 1.0 g of calcium fluoride, and 50 g of water, and then the temperature was raised to 85° C. for 60 minutes while stirring the mixture. Subsequently, the mixture was reacted and hardened for 120 minutes at the same temperature, thus producing composite magnetic particles of the phenol resin and the spherical magnetite particles.

After the content of the flask was cooled to 30° C., 0.5 liter of water was added, and the supernatant liquor was removed. The precipitate on the bottom of the flask was washed with water and air-dried. This further was dried at 50° C. to 60° C. under a reduced pressure (5 mmHg or less), so that the composite magnetic particles (carrier core A) were obtained.

In a 1 liter flask were placed 50 g of phenol, 65 g of formalin (37%), 450 g of spherical magnetite particles with an average particle size of 0.24 μm, 15 g of ammonia water (28%), 1.0 g of calcium fluoride, and 50 g of water, and then the temperature was raised to 85° C. for 60 minutes while stirring the mixture. Subsequently, the mixture was reacted and hardened for 120 minutes at the same temperature, thus producing composite magnetic particles of the phenol resin and the spherical magnetite particles.

After the content of the flask was cooled to 30° C., 0.5 liter of water was added, and the supernatant liquor was removed. The precipitate on the bottom of the flask was washed with water and air-dried. This further was dried at 50° C. to 60° C. under a reduced pressure (5 mmHg or less), so that the composite magnetic particles (carrier core B) were obtained.

In a 1 liter flask were placed 47.5 g of phenol, 62 g of formalin (37%), 480 g of spherical magnetite particles with an average particle size of 0.24 μm, 15 g of ammonia water (28%), 1.0 g of calcium fluoride, and 50 g of water, and then the temperature was raised to 85° C. for 60 minutes while stirring the mixture. Subsequently, the mixture was reacted and hardened for 120 minutes at the same temperature, thus producing composite magnetic particles of the phenol resin and the spherical magnetite particles.

After the content of the flask was cooled to 30° C., 0.5 liter of water was added, and the supernatant liquor was removed. The precipitate on the bottom of the flask was washed with water and air-dried. This further was dried at 50° C. to 60° C. under a reduced pressure (5 mmHg or less), so that the composite magnetic particles (carrier core C) were obtained.

A core material d of ferrite particles having an average particle size of 50 μm and a saturation magnetization of 65 $Am^2/kg$ in an applied magnetic field of 238.74 kA/m (3000 oersted) was used as a comparative example.

Carrier Producing Example 1

Next, 250 g of polyorganosiloxane expressed by the following Chemical Formula (3) in which $R^1$ and $R^2$ are methyl groups, i.e., $(CH_3)_2SiO_{2/2}$ unit is 15.4 mol % and the following Chemical Formula (4) in which $R^3$ is a methyl group, i.e., $CH_3SiO_{3/2}$ unit is 84.6 mol % was allowed to react with 21 g of $CF_3CH_2CH_2Si(OCH_3)_3$ to produce a fluorine modified silicone resin. Then, 100 g of the fluorine modified silicone resin (as represented in terms of solid content) and 10 g of aminosilane coupling agent (γ-aminopropyltriethoxysilane) were weighed and dissolved in 300 cc of toluene solvent.

Chemical Formula (3):

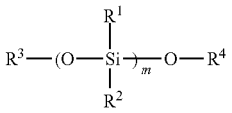

(where $R^1$, $R^2$, $R^3$, and $R^4$ are a methyl group, and m is a mean degree of polymerization of 100)

Chemical Formula (4):

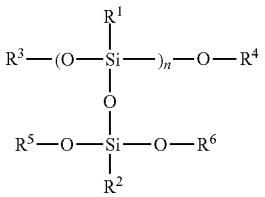

(where $R^1$, $R^2$, $R^3$, $R^4$, $R^5$, and $R^6$ are a methyl group, and n is a mean degree of polymerization of 80)

Using a dip and dry coater, 10 kg of the carrier core A was coated by stirring the resin coating solution for 20 minutes, and then was baked at 260° C. for 1 hour, providing a carrier A1.

The carrier A1 was spherical particles including 80.4 mass % spherical magnetite particles and had an average particle size of 30 μm, a specific gravity of 3.05, a magnetization value of 61 $Am^2/kg$, a volume resistivity of $3\times10^9$ Ωcm, and a specific surface area of 0.098 $m^2/g$.

Carrier Producing Example 2

A carrier B1 was produced in the same manner as the Carrier Producing Example 1 except that the carrier core B was used, and $CF_3CH_2CH_2Si(OCH_3)_3$ was changed to $C_8F_{17}CH_2CH_2Si(OCH_3)_3$.

The carrier B1 was spherical particles including 88.4 mass % spherical magnetite particles and had an average particle size of 45 μm, a specific gravity of 3.56, a magnetization value of 65 $Am^2/kg$, a volume resistivity of $8\times10^{10}$ Ωcm, and a specific surface area of 0.057 $m^2/g$.

Carrier Producing Example 3

A carrier C1 was produced in the same manner as the Carrier Producing Example 1 except that the carrier core C was used, and a conductive carbon (manufactured by Ketjenblack International Corporation EC) was dispersed in an amount of 5 wt % per the resin solid content by using a ball mill.

The carrier C1 was spherical particles including 92.5 mass % spherical magnetite particles and had an average particle size of 48 μm, a specific gravity of 3.98, a magnetization value of 69 $Am^2/kg$, a volume resistivity of $2\times10^7$ Ωcm, and a specific surface area of 0.043 $m^2/g$.

Carrier Producing Example 4

A carrier A2 was produced in the same manner as the Carrier Producing Example 1 except that the amount of aminosilane coupling agent to be added was changed to 30 g.

The carrier A2 was spherical particles including 80.4 mass % spherical magnetite particles and had an average particle size of 30 μm, a specific gravity of 3.05, a magnetization value of 61 $Am^2/kg$, a volume resistivity of $2\times10^{10}$ Ωcm, and a specific surface area of 0.01 $m^2/g$.

Carrier Producing Example 5

A core material was produced in the same manner as the Carrier Producing Example 1 except that the amount of aminosilane coupling agent to be added was changed to 50 g, and a coating was applied, thus providing a carrier a1.

Carrier Producing Example 6

As a coating resin, 100 g of straight silicone (SR-2411 manufactured by Dow Corning Toray Silicone Co., Ltd.) was weighed in terms of solid content and dissolved in 300 cc of toluene solvent. Using a dip and dry coater, 10 kg of the ferrite particles d were coated by stirring the resin coating solution for 20 minutes, and then were baked at 210° C. for 1 hour, providing a carrier d2. The carrier d2 had an average particle size of 80 μm, a specific gravity of 5.5, a magnetization value of 75 $\mu m^2/kg$, a volume resistivity of $2\times10^{12}$ Ω·cm, and a specific surface area of 0.024 $m^2/g$.

Carrier Producing Example 7

As a coating resin, 100 g of acrylic modified silicone resin (KR-9706 manufactured by Shin-Etsu Chemical Co., Ltd.) was weighed in terms of solid content and dissolved in 300 cc of toluene solvent. Using a dip and dry coater, 10 kg of the ferrite particles d were coated by stirring the resin coating solution for 20 minutes, and then were baked at 210° C. for 1 hour, providing a carrier d3. The carrier d3 had an average particle size of 80 μm, a specific gravity of 5.5, a magnetization value of 75 $Am^2/kg$, a volume resistivity of $2\times10^{11}$ Ω·cm, and a specific surface area of 0.022 $m^2/g$.

(2) Resin Particle Dispersion Production

Next, examples of the toner of the present invention will be described, but the present invention is not limited by any of the following examples.

Table 1 shows the characteristics of the binder resin obtained in each of resin particle dispersions (RL1, RL2, RL3, RH1, RH2, RH3, RH4 and RH5) of the present invention and comparative resin particle dispersions (rl4, rl5, rh1, rh2, rh3 and rh4) that were prepared as examples of producing the resin particle dispersion. In Table 1, "Mn" is a number-average molecular weight, "Mw" is a weight-average molecular weight, "Mz" is a Z-average molecular weight, "Mw/Mn" is the ratio of the weight-average molecular weight (Mw) to the number-average molecular weight (Mn), "Mz/Mn" is the ratio of the Z-average molecular weight (Mz) to the number-average molecular weight (Mn), and "Mp" is a peak value of the molecular weight. Tg is a glass transition point and Ts is a softening point.

TABLE 1

| Resin particle | Molecular weight characteristics | | | | | | Thermal characteristics | |
|---|---|---|---|---|---|---|---|---|
| dispersion | Mn ($\times 10^4$) | Mw ($\times 10^4$) | Mz ($\times 10^4$) | Wm = Mw/Mn | Wz = Mz/Mn | Mp ($\times 10^4$) | Tg (° C.) | Ts (° C.) |
| RL1 | 0.72 | 1.38 | 2.05 | 1.92 | 2.85 | 1.08 | 52 | 98 |
| RL2 | 0.75 | 1.76 | 3.01 | 2.35 | 4.01 | 1.85 | 47 | 106 |
| RL3 | 1.53 | 5.14 | 8.74 | 3.36 | 5.71 | 3.14 | 54 | 126 |
| rl4 | 0.41 | 0.76 | 4.30 | 1.85 | 10.49 | 0.70 | 39 | 89 |
| rl5 | 0.89 | 6.12 | 10.84 | 6.88 | 12.18 | 5.28 | 57 | 142 |
| RH1 | 1.43 | 5.14 | 18.90 | 3.59 | 13.22 | 5.80 | 58 | 144 |
| RH2 | 2.12 | 9.77 | 17.30 | 4.61 | 8.16 | 9.88 | 62 | 143 |
| RH3 | 1.77 | 8.46 | 14.60 | 4.78 | 8.25 | 9.06 | 65 | 178 |
| RH4 | 2.34 | 20.85 | 49.32 | 8.91 | 21.08 | 16.36 | 58 | 170 |
| RH5 | 2.50 | 24.20 | 57.80 | 9.68 | 23.12 | 15.40 | 73 | 176 |
| rh1 | 0.26 | 2.83 | 9.62 | 10.88 | 37.00 | 0.27 | 43 | 135 |
| rh2 | 0.48 | 4.89 | 29.20 | 10.19 | 60.83 | 2.33 | 58 | 135 |
| rh3 | 1.77 | 51.10 | 92.20 | 28.87 | 52.09 | 18.50 | 77 | 207 |
| rh4 | 1.86 | 23.87 | 52.90 | 12.23 | 28.44 | 16.36 | 67 | 182 |

Table 2 shows the amount of nonion (g) and the amount of anion (g) of the surface-active agents used for each of the resin particle dispersions, and the ratio (wt %) of the amount of nonion to the total amount of the surface-active agents.

TABLE 2

| Resin particle dispersion | Amount of nonion (g) | Amount of anion (g) | Ratio of nonion (wt %) |
|---|---|---|---|
| RL1 | 7.5 | 4.5 | 62.5 |
| RL2 | 7.5 | 4.5 | 62.5 |
| RL3 | 9 | 3 | 75.0 |
| rl4 | 3.6 | 6 | 37.5 |
| rl5 | 4.5 | 7.5 | 37.5 |
| RH1 | 9.6 | 2.4 | 80.0 |
| RH2 | 7.5 | 4.5 | 62.5 |
| RH3 | 9 | 3 | 75.0 |
| RH4 | 7.6 | 2 | 79.2 |
| RH5 | 9.6 | 2.4 | 80.0 |
| rh1 | 4.2 | 5 | 45.7 |
| rh2 | 2.4 | 7.2 | 25.0 |
| rh3 | 4.5 | 7.5 | 37.5 |
| rh4 | 2.5 | 7.2 | 25.8 |

Each of the resin particle dispersions was prepared in the following manner.

Resin Particle Dispersion RL1

A monomer solution including 240.1 g of styrene, 59.9 g of n-butylacrylate, and 4.5 g of acrylic acid was dispersed in 440 g of ion-exchanged water with 7.5 g of nonionic surface-active agent (NONIPOL 400 manufactured by Sanyo Chemical Industries, Ltd.), 22.5 g of anionic surface-active agent (S20-F, a 20% concentration aqueous solution, manufactured by Sanyo Chemical Industries, Ltd.), and 6 g of dodecanethiol. Then, 4.5 g of potassium persulfate was added to the resultant solution, and emulsion polymerization was performed at 75° C. for 4 hours, followed by an aging treatment at 90° C. for 2 hours. Thus, a resin particle dispersion RL1 was prepared, in which the binder resin particles having Mn of 7200, Mw of 13800, Mz of 20500, Mp of 10800, a softening temperature of 98° C., a glass transition temperature of 52° C., and a median diameter of 0.14 μm were dispersed.

Resin Particle Dispersion RL2

A monomer solution including 230.1 g of styrene, 69.9 g of n-butylacrylate, and 4.5 g of acrylic acid was dispersed in 440 g of ion-exchanged water with 7.5 g of nonionic surface-active agent (NONIPOL 400 manufactured by Sanyo Chemical Industries, Ltd.), 22.5 g of anionic surface-active agent (S20-F, a 20% concentration aqueous solution, manufactured by Sanyo Chemical Industries, Ltd.), and 6 g of dodecanethiol. Then, 4.5 g of potassium persulfate was added to the resultant solution, and emulsion polymerization was performed at 75° C. for 4 hours, followed by an aging treatment at 90° C. for 5 hours. Thus, a resin particle dispersion RL2 was prepared, in which the binder resin particles having Mn of 7500, Mw of 17600, Mz of 30100, Mp of 18500, a softening temperature of 106° C., a glass transition temperature of 47° C., and a median diameter of 0.18 μm were dispersed.

Resin particle dispersion RL3

A monomer solution including 230.1 g of styrene, 69.9 g of n-butylacrylate, and 4.5 g of acrylic acid was dispersed in 440 g of ion-exchanged water with 9 g of nonionic surface-active agent (NONIPOL 400 manufactured by Sanyo Chemical Industries, Ltd.), 15 g of anionic surface-active agent (S20-F, a 20% concentration aqueous solution, manufactured by Sanyo Chemical Industries, Ltd.). and 1.5 g of dodecanethiol. Then, 4.5 g of potassium persulfate was added to the resultant solution, and emulsion polymerization was performed at 75° C. for 4 hours, followed by an aging treatment at 90° C. for 4 hours. The binder resin particles having a median diameter of 0.18 μm were dispersed.

Resin Particle Dispersion RH1

A monomer solution including 230.1 g of styrene, 69.9 g of n-butylacrylate, and 4.5 g of acrylic acid was dispersed in 440 g of ion-exchanged water with 9.6 g of nonionic surface-active agent (NONIPOL 400 manufactured by Sanyo Chemical Industries, Ltd.), 12 g of anionic surface-active agent (S20-F, a 20% concentration aqueous solution, manufactured by Sanyo Chemical Industries, Ltd.), and 1.5 g of dodecanethiol. Then, 1.5 g of potassium persulfate was added to the resultant solution, and emulsion polymerization was performed at 75° C. for 4 hours, followed by an aging treatment at 90° C. for 4 hours. Thus, a resin particle dispersion RH1 was prepared, in which the binder resin particles having Mn of 14300, Mw of 51400, Mz of 189000, Mp of 58000, a softening temperature of 144° C., a glass transition temperature of 58° C., and a median diameter of 0.14 μm were dispersed.

Resin particle dispersion RH2

A monomer solution including 230.1 g of styrene, 69.9 g of n-butylacrylate, and 4.5 g of acrylic acid was dispersed in 440 g of ion-exchanged water with 7.5 g of nonionic surface-active agent (NONIPOL 400 manufactured by Sanyo Chemical Industries, Ltd.), 22.5 g of anionic surface-active agent (S20-F, a 20% concentration aqueous solution, manufactured by Sanyo Chemical Industries, Ltd.), and 0.75 g of dodecanethiol. Then, 1.5 g of potassium persulfate was added to the resultant solution, and emulsion polymerization was performed at 75° C. for 4 hours, followed by an aging treatment at 90° C. for 4 hours. Thus, a resin particle dispersion RH2 was prepared, in which the resin particles having a median diameter of 0.14 μm were dispersed.

Resin particle dispersion RH3

A monomer solution including 240.1 g of styrene, 59.9 g of n-butylacrylate, and 4.5 g of acrylic acid was dispersed in 440 g of ion-exchanged water with 9 g of nonionic surface-active agent (NONIPOL 400 manufactured by Sanyo Chemical Industries, Ltd.), 15 g of anionic surface-active agent (S20-F, a 20% concentration aqueous solution, manufactured by Sanyo Chemical Industries, Ltd.), and 0.75 g of dodecanethiol. Then, 1.5 g of potassium persulfate was added to the resultant solution, and emulsion polymerization was performed at 75° C. for 4 hours, followed by an aging treatment at 90° C. for 2 hours. Thus, a resin particle dispersion RH3 was prepared, in which the resin particles having a median diameter of 0.18 μm were dispersed.

Resin particle dispersion RH4

A monomer solution including 176 g of styrene, 64 g of n-butylacrylate, and 3.6 g of acrylic acid was dispersed in 350 g of ion-exchanged water with 7.6 g of nonionic surface-active agent (NONIPOL 400 manufactured by Sanyo Chemical Industries, Ltd.) and 10 g of anionic surface-active agent (S20-F, a 20% concentration aqueous solution, manufactured by Sanyo Chemical Industries, Ltd.). Then, 2.4 g of potassium persulfate was added to the resultant solution, and emulsion polymerization was performed at 80° C. for 4 hours, followed by an aging treatment at 90° C. for 2 hours. Thus, a resin particle dispersion RH4 was prepared, in which the binder resin particles having a median diameter of 0.18 μm were dispersed.

Resin particle dispersion RH5

A monomer solution including 255 g of styrene, 45 g of n-butylacrylate, and 4.5 g of acrylic acid was dispersed in 440 g of ion-exchanged water with 9.6 g of nonionic surface-active agent (NONIPOL 400 manufactured by Sanyo Chemical Industries, Ltd.), 12 g of anionic surface-active agent (S20-F, a 20% concentration aqueous solution, manufactured by Sanyo Chemical Industries, Ltd.), and 0.5 g of dodecanethiol. Then, 1.5 g of potassium persulfate was added to the resultant solution, and emulsion polymerization was performed at 80° C. for 5 hours, followed by an aging treatment at 90° C. for 2 hours. Thus, a resin particle dispersion RH5 was prepared, in which the resin particles having a median diameter f0.18 μm were dispersed.

Resin Particle Dispersion rl4

A monomer solution including 192 g of styrene, 48 g of n-butylacrylate, and 3.6 g of acrylic acid was dispersed in 350 g of ion-exchanged water with 3.6 g of nonionic surface-active agent (NONIPOL 400 manufactured by Sanyo Chemical Industries, Ltd.), 30 g of anionic surface-active agent (S20-F, a 20% concentration aqueous solution, manufactured by Sanyo Chemical Industries, Ltd.), 12 g of dodecanethiol, and 2.4 g of carbon tetrabromide. Then, 2.4 g of potassium persulfate was added to the resultant solution, and emulsion polymerization was performed at 70° C. for 5 hours, followed by an aging treatment at 80° C. for 2 hours. Thus, a resin particle dispersion rl4 was prepared, in which the binder resin particles having Mn of 4100, Mw of 7600, Mz of 43000, Mp of 7000, a softening temperature of 89° C., a glass transition temperature of 39° C., and a median diameter of 0.18 μm were dispersed.

Resin Particle Dispersion rl5

A monomer solution including 230.1 g of styrene, 69.9 g of n-butylacrylate, and 4.5 g of acrylic add was dispersed in 440 g of ion-exchanged water with 4.5 g of nonionic surface-active agent (NONIPOL 400 manufactured by Sanyo Chemical Industries, Ltd.), 37.5 g of anionic surface-active agent (S20-F, a 20% concentration aqueous solution, manufactured by Sanyo Chemical Industries, Ltd.), and 1.5 g of dodecanethiol. Then, 1.5 g of potassium persulfate was added to the resultant solution, and emulsion polymerization was performed at 75° C. for 5 hours, followed by an aging treatment at 80° C. for 2 hours. Thus, a resin particle dispersion rl5 was prepared, in which the binder resin particles having Mn of 8900, Mw of 61200, Mz of 108400, Mp of 52800, a softening temperature of 142° C., a glass transition temperature of 57° C., and a median diameter of 0.16 μm were dispersed.

Resin Particle Dispersion rh1

A monomer solution including 204 g of styrene, 36 g of n-butylacrylate, and 3.6 g of acrylic add was dispersed in 350 g of ion-exchanged water with 4.2 g of nonionic surface-active agent (NONIPOL 400 manufactured by Sanyo Chemical Industries, Ltd.), 25 g of anionic surface-active agent (S20-F, a 20% concentration aqueous solution, manufactured by Sanyo Chemical Industries, Ltd.), 12 g of dodecanethiol, and 2.4 g of carbon tetrabromide. Then, 2.4 g of potassium persulfate was added to the resultant solution, and emulsion polymerization was performed at 75° C. for 5 hours, followed by an aging treatment at 80° C. for 2 hours. Thus, a resin particle dispersion rh1 was prepared, in which the binder resin particles having Mn of 2600, Mw of 28300, Mz of 96200, Mp of 2700, a softening temperature of 135° C., a glass transition temperature of 43° C., and a median diameter of 0.18 μm were dispersed.

Resin particle dispersion rh2

A monomer solution including 176 g of styrene, 64 g of n-butylacrylate, and 3.6 g of acrylic acid was dispersed in 350 g of ion-exchanged water with 2.4 g of nonionic surface-active agent (NONIPOL 400 manufactured by Sanyo Chemical Industries, Ltd.), 36 g of anionic surface-active agent (S20-F, a 20% concentration aqueous solution, manufactured by Sanyo Chemical Industries, Ltd.), and 6 g of dodecanethiol. Then, 1.2 g of potassium persulfate was added to the resultant solution, and emulsion polymerization was performed at 70° C. for 5 hours, followed by an aging treatment at 80° C. for 2 hours. Thus, a resin particle dispersion rh2 was prepared, in which the resin particles having a median diameter of 0.16 μm were dispersed.

Resin particle dispersion rh3

A monomer solution including 272 g of styrene, 28 g of n-butylacrylate, and 4.5 g of acrylic acid was dispersed in 440 g of ion-exchanged water with 4.5 g of nonionic surface-active agent (NONIPOL 400 manufactured by Sanyo Chemical Industries, Ltd.) and 37.5 g of anionic surface-active agent (S20-F, a 20% concentration aqueous solution, manufactured by Sanyo Chemical Industries, Ltd.), while no dodecanethiol was present. Then, 1.5 g of potassium persulfate was added to the resultant solution, and emulsion polymerization was performed at 85° C. for 4 hours, followed by an aging treatment at 80° C. for 2 hours. Thus, a resin particle dispersion rh3 was prepared, in which the resin particles having a median diameter of 0.18 μm were dispersed.

Resin Particle Dispersion rh4

A monomer solution including 204 g of styrene, 36 g of n-butylacrylate, and 2.4 g of acrylic add was dispersed in 350 g of ion-exchanged water with 2.5 g of nonionic surface-active agent (NONIPOL 400 manufactured by Sanyo Chemical Industries, Ltd.) and 36 g of anionic surface-active agent (S20-F, a 20% concentration aqueous solution, manufactured by Sanyo Chemical Industries, Ltd.). Then, 2.4 g of potassium persulfate was added to the resultant solution, and emulsion polymerization was performed at 80° C. for 5 hours, followed by an aging treatment at 90° C. for 2 hours. Thus, a resin particle dispersion rh4 was prepared, in which the binder resin particles having Mn of 18600, Mw of 238700, Mz of 529000, Mp of 163600, a softening temperature of 182° C., a glass transition temperature of 67° C., and a median diameter of 0.16 μm were dispersed.

(2) Colorant Particle Dispersion Production

Next, examples of producing the colorant particle dispersion will be described. Table 3 shows the pigments used in each of colorant particle dispersions (PM1, PC1, PY1, PB11 and PM2) and comparative colorant particle dispersions (pm3 and pm4) that were prepared as examples of producing the colorant particle dispersion. Table 4 shows the amount of nonion (g) and the amount of anion (g) of the surface-active agents used for the colorant particle dispersions, and the ratio (wt %) of the amount of nonion to the total amount of the surface-active agents.

TABLE 3

| Colorant particle dispersion | Colorant (pigment) |
|---|---|
| PM1 | PERMANENT RUBINE F6B (Clariant) |
| PC1 | KETBLUE111 (Dainippon Ink and Chemicals, Inc.) |
| PY1 | PY74 (Sanyo Color Works, Ltd.) |
| PB1 | MA100S (Mitsubishi Chemical Corporation) |

TABLE 4

| Colorant particle dispersion | Ma pigment (g) | Amount of nonion (g) | Amount of anion (g) | Ratio of nonion (wt %) |
|---|---|---|---|---|
| PM1 | 20 | 2 | 0 | 100.0% |
| PM2 | 20 | 1.5 | 1.2 | 55.6% |
| pm3 | 20 | 1.2 | 1.4 | 46.2% |
| pm4 | 20 | 0 | 2 | 0.0% |

(2-1) Preparation of Colorant Particle Dispersion PM1

20 g of magenta pigment (PERMANENT RUBINE F6B manufactured by Clariant), 2 g of nonionic surface-active agent (ELEMINOL NA 400 manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PM1 was prepared, in which the colorant particles having a median diameter of 0.12 μm were dispersed.

(2-2) Preparation of Colorant Particle Dispersion PC1

20 g of cyan pigment KETBLUE111 manufactured by Dainippon Ink and Chemicals, Inc.), 2 g of nonionic surface-active agent (ELEMINOL NA 400 manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PC1 was prepared, in which the colorant particles having a median diameter of 0.12 μm were dispersed.

(2-3) Preparation of Colorant Particle Dispersion PY1

20 g of yellow pigment (PY74 manufactured by Sanyo Color Works, Ltd.), 2 g of nonionic surface-active agent (ELEMINOL NA 400 manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PY1 was prepared, in which the colorant particles having a median diameter of 0.12 μm were dispersed.

(2-4) Preparation of Colorant Particle Dispersion PB1

20 g of black pigment (MA100S manufactured by Mitsubishi Chemical Corporation), 2 g of nonionic surface-active agent (ELEMINOL NA 400 manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PB1 was prepared, in which the colorant particles having a median diameter of 0.12 μm were dispersed.

(2-5) Preparation of Colorant Particle Dispersion PM2

20 g of magenta pigment (PERMANENT RUBINE F6B manufactured by Clariant), 1.5 g of nonionic surface-active agent (NONIPOL 400 manufactured by Sanyo Chemical Industries, Ltd.), 6 g of anionic surface-active agent (S20-F, a 20% concentration aqueous solution, manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion PM2 was prepared, in which the colorant particles having a median diameter of 0.12 μm were dispersed.

(2-6) Preparation of Colorant Particle Dispersion pm3

20 g of magenta pigment (PERMANENT RUBINE F6B manufactured by Clariant), 1.2 g of nonionic surface-active agent (NONIPOL 400 manufactured by Sanyo Chemical Industries, Ltd.), 7 g of anionic surface-active agent (S20-F, a 20% concentration aqueous solution, manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion pm3 was prepared, in which the colorant particles having a median diameter of 0.12 μm were dispersed.

(2-7) Preparation of Colorant Particle Dispersion pm4

20 g of magenta pigment (PERMANENT RUBINE F6B manufactured by Clariant), 10 g of anionic surface-active agent (S20-F, a 20% concentration aqueous solution, manufactured by Sanyo Chemical Industries, Ltd.), and 78 g of ion-exchanged water were mixed and dispersed by using an ultrasonic dispersing device at an oscillation frequency of 30 kHz for 20 minutes. Thus, a colorant particle dispersion pm4 was prepared, in which the colorant particles having a median diameter of 0.12 μm were dispersed.

(3) Wax Particle Dispersion Production

Next, examples of producing the wax particle dispersion will be described. Tables 5, 6 and 7 show the wax materials (W-1, W-2, W-3, W-4, W-5, W-6, W-7, W-8, W-9, W-10, W-11, W-12 and W-13) and their characteristics used for the production of wax particle dispersions (WA1, WA2, WA3, WA4, WA5, WA6, WA7, WA8, WA9 and WA10) of the present invention and comparative wax particle dispersions (wa11, wa12, wa13, wa14 and wa15) that were prepared as examples of producing the wax particle dispersion.

TABLE 5

| Wax | Material | Melting point Tmw1 (° C.) | Heating loss Ck (wt %) | Iodine value | Saponification value |
|---|---|---|---|---|---|
| W-1 | Maximum hydrogenated jojoba oil | 68 | 2.8 | 2 | 95.7 |
| W-2 | Candelilla wax | 72 | 2.4 | 15 | 62 |
| W-3 | Maximum hydrogenated meadowfoam oil | 71 | 2.5 | 2 | 90 |
| W-4 | Carnauba wax | 84 | 1.5 | 8 | 88 |
| W-5 | Jojoba oil fatty acid pentaerythritol monoester | 84 | 3.4 | 2 | 120 |

TABLE 6

| Wax | Material | Melting point Tmw1 (° C.) | Heating loss Ck (wt %) |
|---|---|---|---|
| W-6 | Stearyl stearate | 58 | 2 |
| W-7 | Triglyceride stearate | 63 | 1.5 |
| W-8 | Pentaerythritol tetrastearate | 70 | 0.9 |
| W-9 | Behenyl behenate | 74 | 1.2 |
| W-10 | Glycerol triester (hydrogenated castor oil) | 85 | 1.9 |

TABLE 7

| Wax | Material | Melting point Tmw2 (° C.) | Acid value | Penetration number |
|---|---|---|---|---|
| W-11 | Saturated hydrocarbon wax (FNP0090 manufactured by Nippon Seiro Co., Ltd.) | 90.2 | | 1 |
| W-12 | Polypropylene/maleic anhydride/alcohol-type wax with a carbon number of 30 or less/ tert-butylperoxy isopropyl monocarbonate: 100/20/8/4 parts by weight | 98 | 45 | 1 |

TABLE 7-continued

| Wax | Material | Melting point Tmw2 (° C.) | Acid value | Penetration number |
|---|---|---|---|---|
| W-13 | Thermally degradable low-density polyethylene wax (NL200 manufactured by Mitsui Chemicals, Inc.) | 104 | | 1 |

Table 8 shows the composition of the wax components and the particle properties of each of the wax particle dispersions (WA1 to WA10) of the present invention and the comparative wax particle dispersions (wa11 to wa15) produced. In Table 8, the "first wax" and the "second wax" represent the wax materials used in the wax particle dispersions, and the values in parentheses after the wax materials indicate the amount (proportion) of composition of the wax mixed. Moreover, "PR16" indicates the value of the particle size at 16% accumulated from a smaller particle diameter side in the volume-based particle size distribution of the wax particles in the wax particle dispersion. Similarly, "PR50" indicates 50% diameter and "PR84" indicates 84% diameter. "PR84/PR16" indicates the ratio of the 84% diameter (PR84) to the 16% diameter (PR16).

TABLE 8

| Wax particle | Wax composition | | Particle size distribution of wax particles | | | |
|---|---|---|---|---|---|---|
| dispersion | First wax | Second wax | PR16 (nm) | PR50 (mn) | PR84 (mn) | PR84/PR16 |
| WA1 | W-1(1) | W-11(5) | 94 | 128 | 162 | 1.72 |
| WA2 | W-2(1) | W-12(2) | 105 | 155 | 205 | 1.95 |
| WA3 | W-3(1) | W-13(1) | 186 | 267 | 348 | 1.87 |
| WA4 | W-4(1) | W-11(2) | 88 | 106 | 124 | 1.41 |
| WA5 | W-5(1) | W-12(4) | 194 | 273 | 352 | 1.81 |
| WA6 | W-6(1) | W-11(5) | 112 | 168 | 224 | 2 |
| WA7 | W-7(1) | W-12(3) | 125 | 187 | 249 | 1.99 |
| WA8 | W-8(1) | W-13(1) | 186 | 267 | 348 | 1.87 |
| WA9 | W-9(1) | W-11(1) | 112 | 158 | 204 | 1.82 |
| WA10 | W-10(1) | W-12(2) | 184 | 266 | 348 | 1.89 |
| wa11 | W-6(1) | None | 168 | 276 | 384 | 2.29 |
| wa12 | W-7(1) | None | 148 | 245 | 342 | 2.31 |
| wa13 | W-11(1) | None | 268 | 418 | 568 | 2.12 |
| wa14 | W-12(1) | None | 284 | 503 | 722 | 2.54 |
| wa15 | W-13(1) | None | 246 | 515 | 784 | 3.19 |

Table 9 shows the amount of nonion (g) and the amount of anion (g) of the surface-active agents used for each of the wax particle dispersions, and the ratio of the amount of nonion to the total amount of the surface-active agents.

TABLE 9

| Wax particle dispersion | Amount of nonion (g) | Amount of anion (g) | Ratio of nonion (wt %) | Amount of first wax (g) | Amount of second wax (g) |
|---|---|---|---|---|---|
| WA1 | 2 | 1 | 67% | 5 | 25 |
| WA2 | 1.8 | 1.2 | 60% | 10 | 20 |
| WA3 | 2.5 | 0.5 | 83% | 15 | 15 |
| WA4 | 3 | 0 | 100% | 10 | 20 |
| WA5 | 3 | 0 | 100% | 6 | 24 |
| WA6 | 3 | 0 | 100% | 5 | 25 |
| WA7 | 3 | 0 | 100% | 7.5 | 22.5 |
| WA8 | 3 | 0 | 100% | 15 | 15 |
| WA9 | 3 | 0 | 100% | 15 | 15 |
| WA10 | 3 | 0 | 100% | 10 | 20 |
| wa11 | 3 | 0 | 100% | 30 | 0 |
| wa12 | 0 | 3 | 0% | 30 | 0 |
| wa13 | 3 | 0 | 100% | 0 | 30 |
| wa14 | 0 | 3 | 0% | 0 | 30 |
| wa15 | 0 | 3 | 0% | 0 | 30 |

Each of the wax particle dispersions was prepared in the following manner.

(1) Preparation of Wax Particle Dispersion WA1

FIG. 3 is a schematic view of a stirring/dispersing device, and FIG. 4 is a plan view of the same. As shown in FIG. 3, cooling water is introduced from 808 to the inside of an outer tank 801 and then is discharged from 807. Reference numeral 802 is a shielding board that stops the flow of the liquid to be treated. The shielding board 802 has an opening in the central portion, and the treated liquid is drawn from the opening and taken out of the device through 805. Reference numeral 803 is a rotating body that is secured to a shaft 806 and rotates at high speed. There are holes (about 1 to 5 mm in size) in the side of the rotating body 803, and the liquid to be treated can move through the holes. The liquid to be treated is put into the tank in an amount of about one-half the capacity (120 ml) of the tank. The maximum rotational speed of the rotating body 803 is 50 m/s. The rotating body 803 has a diameter of 52 mm, and the tank 801 has an internal diameter of 56 mm. Reference numeral 804 is a material inlet used for a continuous treatment. In the case of a batch treatment, the material inlet 804 is closed.

The tank was pressurized at 0.4 Mpa, and 67 g of ion-exchanged water, 2 g of nonionic surface-active agent (ELEMINOL NA 400 manufactured by Sanyo Chemical Industries, Ltd.), 1 g of anionic surface-active agent (SCF manufactured by Sanyo Chemical Industries, Ltd.), 5 g of the first wax (W-1), and 25 g of the second wax (W-11) were blended and treated while the rotating body rotated at a rotational speed of 30 m/s for 5 minutes, and then 50 m/s for 2 minutes. Thus, a wax particle dispersion WA1 was provided.

(2) Preparation of wax particle dispersion WA2

Under the same conditions as the wax particle dispersion WA1, 67 g of ion-exchanged water, 1.8 g of nonionic surface-active agent (ELEMINOL NA 400 manufactured by Sanyo Chemical Industries, Ltd.), 1.2 g of anionic surface-active agent (SCF manufactured by Sanyo Chemical Industries, Ltd.), 10 g of the first wax (W-2), and 20 g of the second wax (W-12) were blended and treated while the rotating body rotated at a rotational speed of 30 m/s for 3 minutes, and then 50 m/s for 2 minutes. Thus, a wax particle dispersion WA2 was provided.

(3) Preparation of Wax Particle Dispersion WA3

Under the same conditions as the wax particle dispersion WA1, 67 g of ion-exchanged water, 2.5 g of nonionic surface-active agent (ELEMINOL NA 400 manufactured by Sanyo Chemical Industries, Ltd.), 0.5 g of anionic surface-active agent (SCF manufactured by Sanyo Chemical Industries, Ltd.), 15 g of the first wax (W-3), and 15 g of the second wax (W-13) were blended and treated while the rotating body rotated at a rotational speed of 20 m/s for 3 minutes, and then 45 m/s for 2 minutes. Thus, a wax particle dispersion WA3 was provided.

(4) Preparation of Wax Particle Dispersion WA4

Under the same conditions as the wax particle dispersion WA1, 67 g of ion-exchanged water, 3 g of nonionic surface-active agent (ELEMINOL NA 400 manufactured by Sanyo Chemical Industries, Ltd.), 10 g of the first wax (W-4), and 20 g of the second wax (W-11) were blended and treated while the rotating body rotated at a rotational speed of 30 m/s for 3 minutes, and then 50 m/s for 2 minutes. Thus, a wax particle dispersion WA4 was provided.

(5) Preparation of Wax Particle Dispersion WA5

FIG. 5 is a schematic view of a stirring/dispersing device, and FIG. 6 is a plan view of the same. Reference numeral 850 is an inlet and 852 is a stator with a floating structure. The stator 852 is pressed down by springs 851, but pushed up by a force created when a rotor 853 rotates at high speed. Therefore, a narrow gap of about 1 μm to 10 μm is formed between the stator 852 and the rotor 853. Reference numeral 854 is a shaft connected to a motor (not shown). Materials are fed into the device from the inlet 850, subjected to a strong shearing force in the gap between the stator 852 and the rotor 853, and thus formed into fine particles dispersed in the liquid. The material liquid thus treated is drawn from outlets 856. As shown in FIG. 6, the material liquid 855 is released radially and collected in a dosed container. The rotor 853 has an outer diameter of 100 mm.

The material liquid, in which wax and a surface-active agent were predispersed in a pressurized and heated aqueous medium, was introduced from the inlet 850 and treated instantaneously to make a fine particle dispersion. The amount of material liquid supplied was 1 kg/h, and the maximum rotational speed of the rotor 853 was 100 m/s.

67 g of ion-exchanged water, 3 g of nonionic surface-active agent (ELEMINOL NA 400 manufactured by Sanyo Chemical Industries, Ltd.), 6 g of the first wax (W-5), and 24 g of the second wax (W-12) were blended and treated in a supplied amount of 1 kg/h while the rotor rotated at a rotational speed of 100 m/s. Thus, a wax particle dispersion WA5 was provided.

(6) Preparation of Wax Particle Dispersion WA6

Under the same conditions as the wax particle dispersion WA1, 67 g of ion-exchanged water, 3 g of nonionic surface-active agent (ELEMINOL NA 400 manufactured by Sanyo Chemical Industries, Ltd.), 5 g of the first wax (W-6), and 25 g of the second wax (W-11) were blended and treated while the rotating body rotated at a rotational speed of 20 m/s for 3 minutes, and then 50 m/s for 2 minutes. Thus, a wax particle dispersion WA6 was provided.

(7) Preparation of Wax Particle Dispersion WA7

Under the same conditions as the wax particle dispersion WA1, 67 g of ion-exchanged water, 3 g of nonionic surface-active agent (ELEMINOL NA 400 manufactured by Sanyo Chemical Industries, Ltd.), 7.5 g of the first wax (W-7), and 22.5 g of the second wax (W-12) were blended and treated while the rotating body rotated at a rotational speed of 20 m/s for 3 minutes, and then 50 m/s for 2 minutes. Thus, a wax particle dispersion WA7 was provided.

(8) Preparation of Wax Particle Dispersion WA8

Under the same conditions as the wax particle dispersion WA5, 67 g of ion-exchanged water, 3 g of nonionic surface-active agent (ELEMINOL NA 400 manufactured by Sanyo Chemical Industries, Ltd.), 15 g of the first wax (W-8), and 15 g of the second wax (W-13) were blended and treated in a supplied amount of 1 kg/h while the rotor rotated at a rotational speed of 100 m/s. Thus, a wax particle dispersion WA8 was provided.

(9) Preparation of Wax Particle Dispersion WA9

Under the same conditions as the wax particle dispersion WA1, 67 g of ion-exchanged water, 3 g of nonionic surface-active agent (ELEMINOL NA 400 manufactured by Sanyo Chemical Industries, Ltd.), 15 g of the first wax (W-9), and 15 g of the second wax (W-11) were blended and treated while the rotating body rotated at a rotational speed of 20 m/s for 3 minutes, and then 50 m/s for 2 minutes. Thus, a wax particle dispersion WA9 was provided.

(10) Preparation of Wax Particle Dispersion WA10

Under the same conditions as the wax particle dispersion WA1, 67 g of ion-exchanged water, 3 g of nonionic surface-active agent (ELEMINOL NA 400 manufactured by Sanyo Chemical Industries, Ltd.), 10 g of the first wax (W-10), and 20 g of the second wax (W-12) were blended and treated while the rotating body rotated at a rotational speed of 30 m/s for 3 minutes, and then 50 m/s for 2 minutes. Thus, a wax particle dispersion WA10 was provided.

(11) Preparation of Wax Particle Dispersion wa11

Under the same conditions as the wax particle dispersion WA1, 67 g of ion-exchanged water, 3 g of nonionic surface-active agent (ELEMINOL NA 400 manufactured by Sanyo Chemical Industries, Ltd.), and 30 g of the wax (W-6) were blended and treated while the rotating body rotated at a rotational speed of 30 m/s for 3 minutes, and then 45 m/s for 3 minutes. Thus, a wax particle dispersion wa11 was provided.

(12) Preparation of Wax Particle Dispersion WA12

Under the same conditions as the wax particle dispersion WA1, 67 g of ion-exchanged water, 3 g of anionic surface-active agent (SCF manufactured by Sanyo Chemical Industries, Ltd.), and 30 g of the wax (W-7) were blended and treated while the rotating body rotated at a rotational speed of 30 m/s for 3 minutes, and then 45 m/s for 3 minutes Thus, a wax particle dispersion wa12 was provided.

(13) Preparation of Wax Particle Dispersion wa13

100 g of ion-exchanged water, 3 g of nonionic surface-active agent (ELEMINOL NA 400 manufactured by Sanyo Chemical Industries, Ltd.), and 30 g of the wax (W-11) were blended and treated for 30 minutes by using a homogenizer. Thus, a wax particle dispersion wa13 was provided.

(14) Preparation of Wax Particle Dispersion wa14

100 g of ion-exchanged water, 3 g of anionic surface-active agent (SCF manufactured by Sanyo Chemical Industries, Ltd.), and 30 g of the wax (W-12) were blended and treated for 30 minutes by using a homogenizer. Thus, a wax particle dispersion wa14 was provided.

(15) Preparation of Wax Particle Dispersion wa15

100 g of ion-exchanged water, 3 g of anionic surface-active agent (SCF manufactured by Sanyo Chemical Industries, Ltd.), and 30 g of the wax (W-13) were blended and treated for 30 minutes by using a homogenizer. Thus, a wax particle dispersion wa15 was provided.

(4) Toner Base Production

Next, examples of producing the toner base will be described for magenta toner Table 10 shows the compositions and the characteristics of each of toner bases (M1, M2, M3, M4, M5, M6, M7, M8, M9, M10, M11, M12, M13, M14, M15, M16, M17, M18, M19, M20 and M21) of the present invention that were prepared as examples of producing the toner base. Table 11 shows the compositions and the characteristics of each of toner bases (m22, m23, m24, m25, m26, m27, m28, m29, m30, m31, m32, m33, m34 and m35) of the present invention that were prepared as examples of producing the toner base In Tables 10 and 11, the "coefficient of variation" indicates the degree of expansion of the volume-based particle size distribution of the toner base particles in each of the toner bases produced.

TABLE 10

| | Composition | | | | Toner base particle size | |
|---|---|---|---|---|---|---|
| Toner base | First resin dispersion | Wax dispersion | Pigment dispersion | Second resin dispersion | d50 (μm) | Volume-based coefficient of variation |
| M1 | RL1 | WA1 | PM1 | RH1 | 4.1 | 18.7 |
| M2 | RL1 | WA2 | PM1 | RH1 | 6.8 | 21.1 |
| M3 | RL1 | WA3 | PM1 | RH4 | 4.4 | 16.6 |
| M4 | RL1 | WA4 | PM1 | RH4 | 4.1 | 21.2 |
| M5 | RL2 | WA5 | PM1 | RH1 | 6.6 | 16.8 |
| M6 | RL2 | WA6 | PM1 | RH1 | 4.9 | 17.8 |
| M7 | RL2 | WA7 | PM1 | RH4 | 6.5 | 20.8 |
| M8 | RL2 | WA8 | PM1 | RH4 | 5 | 17.8 |
| M9 | RL3 | WA9 | PM1 | RH1 | 4 | 16.2 |
| M10 | RL3 | WA10 | PM1 | RH4 | 6.9 | 21 |
| M11 | RL2 | WA1 | PM1 | RH2 | 6.9 | 17.8 |
| M12 | RL2 | WA2 | PM1 | RH3 | 6.2 | 19.7 |
| M13 | RL2 | WA3 | PM1 | RH5 | 4.1 | 19.8 |
| M14 | RL2 | WA4 | PM1 | RH2 | 6.8 | 17.8 |
| M15 | RL2 | WA5 | PM1 | RH3 | 6.5 | 18.1 |
| M16 | RL3 | WA6 | PM1 | RH5 | 4.2 | 20.2 |
| M17 | RL3 | WA7 | PM1 | RH2 | 6.4 | 18.2 |
| M18 | RL3 | WA8 | PM1 | RH3 | 4.8 | 19.2 |
| M19 | RL3 | WA9 | PM1 | RH5 | 3.9 | 21 |
| M20 | RL3 | WA10 | PM1 | RH2 | 6.9 | 18.2 |
| M21 | RL3 | WA7 | PM2 | RH2 | 6.6 | 17.8 |

TABLE 11

| | Composition | | | | Toner base particle size | |
|---|---|---|---|---|---|---|
| Toner base | First resin dispersion | Wax dispersion | Pigment dispersion | Second resin dispersion | d50 (μm) | Volume-based coefficient of variation |
| m22 | rl4 | WA6 | PM1 | rh1 | 12.3 | 25.6 |
| m23 | rl5 | WA7 | PM1 | rh4 | 3.3 | 38.6 |
| m24 | RL2 | wa11 | PM1 | RH1 | 21.2 | 30.8 |
| m25 | RL2 | wa12 | PM1 | RH4 | 18.5 | 28.9 |
| m26 | RL2 | wa13 | PM1 | RH1 | 16.7 | 38.4 |
| m27 | rl4 | wa14 | PM1 | rh1 | 25.7 | 31.8 |
| m28 | rl5 | wa15 | PM1 | rh4 | 8.5 | 42.8 |
| m29 | RL2 | wa11 | PM1 | RH2 | 22.8 | 33.8 |
| m30 | RL2 | wa12 | PM1 | RH3 | 20.4 | 35.9 |
| m31 | RL3 | wa13 | PM1 | rh3 | 8.7 | 40.8 |
| m32 | RL2 | wa14 | PM1 | rh2 | 26.8 | 31 |
| m33 | RL3 | wa15 | PM1 | rh3 | 8.5 | 40.1 |
| m34 | RL3 | WA7 | pm3 | RH2 | 9.2 | 27.8 |
| m35 | RL3 | WA7 | pm4 | RH2 | 12.1 | 32.6 |

The production and the characteristics of each toner base are as follows.

Toner Base M1

In a 2000 ml four-neck flask equipped with a thermometer, a cooling tube, a stirring rod, and a pH meter were placed 204 g of first resin particle dispersion RL1, 45 g of colorant particle dispersion PM1, 85 g of wax particle dispersion WA1, and 500 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 2.7.

The pH was increased to 11.8 by adding 1N sodium hydroxide (NaOH) to the mixed dispersion. Subsequently, 150 g of magnesium sulfate (water-soluble inorganic salt) aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours, thus forming aggregated particles. At this time, the mixed dispersion had a pH of 9.2. Moreover, the pH was adjusted to 6.4 by the addition of 1N hydrogen chloride (HCl), and then the temperature was raised to 90° C. and the mixed dispersion was heat-treated for 2 hours to provide core particles.

After the water temperature was reduced to 60° C., the pH was adjusted to 7.2, and 165 g of second resin particle dispersion RH1 was added. This mixture was heated at 90° C. for 3 hours, thereby providing toner base particles fused with the second binder resin. After cooling, the reaction product (toner base particles) was filtered and washed three times with ion-exchanged water. The toner base particles thus obtained were dried at 40° C. for 6 hours by using a fluid-type dryer, resulting in a toner base M1 with a volume-average particle size of 4.1 μm and a coefficient of variation of 18.7.

If the pH before adding the water-soluble inorganic salt and heating was less than 9.5, the core particles became coarser. If the pH was 12.5, the liberated wax was increased, and it was difficult to incorporate the wax components uniformly. If the pH of the mixed dispersion at the time of forming the core particles was more than 9.5, the numbers of liberated wax or colorant particles were increased due to poor aggregation.

After the temperature was raised from 22° C. to 70° C. at a rate of 5° C./min, and the heat-treatment was performed at 80° C. for 2 hours, if the mixed dispersion was heat-treated without adjusting the pH, or the adjusted pH was more than 6.8, the core particles were likely to be slightly larger. If the pH was reduced to less than 2.2, the effect of the surface-active agent was eliminated, and the particle size was increased.

Toner Base M2

In a 2000 ml four-neck flask were placed 204 g of first resin particle dispersion RL1, 45 g of colorant particle dispersion PM1, 80 g of wax particle dispersion WA2, and 500 ml of ion-exchanged water and then mixed for 10 minutes by using a homogenizer (Ultratalax T25 manufactured by IKA CO., LTD.). Thus, a mixed dispersion was prepared. The pH of the mixed dispersion was 1.8.

The pH was increased to 9.7 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours, thus forming aggregated particles. At this time, the mixed dispersion had a pH of 7.2. Moreover, the temperature was raised to 90° C. and the mixed dispersion was heat-treated for 2 hours to provide core particles.

After the water temperature was reduced to 60° C., the pH was adjusted to 3.2, and 165 g of second resin particle dispersion RH1 was added. This mixture was heated at 90° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M2 with a volume-average particle size of 6.8 μm and a coefficient of variation of 21.1.

Toner Base M3

In a 2000 ml four-neck flask were placed 204 g of first resin particle dispersion RL1, 31 g of colorant particle dispersion PM1, 40 g of wax particle dispersion WA3, and 330 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 3.2.

The pH was increased to 11 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours, thus forming aggregated particles. At this time, the mixed dispersion had a pH of 8.4. Moreover, the pH was adjusted to 5.4 by the addition of 1N HCl, and then the temperature was raised to 90° C. and the mixed dispersion was heat-treated for 2 hours to provide core particles.

After the water temperature was reduced to 60° C., the pH was adjusted to 6.6, and 50 g of second resin particle dispersion RH4 was added. This mixture was heated at 95° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M3 with a volume-average particle size of 4.4 μm and a coefficient of variation of 16.6.

Toner Base M4

In a 2000 ml four-neck flask were placed 204 g of first resin particle dispersion RL1, 31 g of colorant particle dispersion PM1, 40 g of wax particle dispersion WA4, and 330 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 3.8.

The pH was increased to 11.9 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours, thus forming aggregated particles. At this time, the mixed dispersion had a pH of 9.3. Moreover, the pH was adjusted to 6.2 by the addition of 1N HCl, and then the temperature was raised to 90° C. and the mixed dispersion was heat-treated for 2 hours to provide core particles.

After the water temperature was reduced to 60° C., the pH was adjusted to 6.6, and 50 g of second resin particle dispersion RH4 was added. This mixture was heated at 95° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M4 with a volume-average particle size of 4.1 μm and a coefficient of variation of 21.2.

Toner Base M5

In a 2000 ml four-neck flask were placed 204 g of first resin particle dispersion RL2, 42 g of colorant particle dispersion PM1, 90 g of wax particle dispersion WA5, and 500 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.2.

The pH was increased to 9.7 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 7. Moreover, the temperature was raised to 90° C. and the mixed dispersion was heat-treated for 2 hours to provide core particles.

After the water temperature was reduced to 60° C., the pH was adjusted to 3.2, and 145 g of second resin particle dispersion RH1 was added. This mixture was heated at 90° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M5 with a volume-average particle size of 6.6 μm and a coefficient of variation of 16.8.

Toner Base M6

In a 2000 ml four-neck flask were placed 204 g of first resin particle dispersion RL2, 42 g of colorant particle dispersion PM1, 50 g of wax particle dispersion WA6, and 450 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 3.8.

The pH was increased to 11.8 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 9.2. Moreover, the pH was adjusted to 6.6 by the addition of 1N HCl, and then the temperature was raised to 90° C. and the mixed dispersion was heat-treated for 2 hours to provide core particles.

After the water temperature was reduced to 60° C., the pH was adjusted to 7.6, and 145 g of second resin particle dispersion RH1 was added. This mixture was heated for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M6 with a volume-average particle size of 4.9 μm and a coefficient of variation of 17.8.

Toner Base M7

In a 2000 ml four-neck flask were placed 204 g of first resin particle dispersion RL2, 32 g of colorant particle dispersion PM1, 60 g of wax particle dispersion WA7, and 360 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 1.8.

The pH was increased to 9.7 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 7.2. Moreover, the temperature was raised to 90° C. and the mixed dispersion was heat-treated for 2 hours to provide core particles.

After the water temperature was reduced to 60° C., the pH was adjusted to 3.4, and 60 g of second resin particle dispersion RH4 was added. This mixture was heated at 95° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M7 with a volume-average particle size of 6.5 μm and a coefficient of variation of 20.8.

Toner Base M8

In a 2000 ml four-neck flask were placed 204 g of first resin particle dispersion RL2, 32 g of colorant particle dispersion PM1, 40 g of wax particle dispersion WA8, and 350 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 2.1.

The pH was increased to 11.2 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 8.5. Moreover, the pH was adjusted to 5.4 by the addition of 1N HCl, and then the temperature was raised to 90° C. and the mixed dispersion was heat-treated for 2 hours to provide core particles.

After the water temperature was reduced to 60° C., the pH was adjusted to 5.5, and 60 g of second resin particle dispersion RH4 was added. This mixture was heated at 95° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M8 with a volume-average particle size of 5 μm and a coefficient of variation of 17.8.

Toner Base M9

In a 2000 ml four-neck flask were placed 204 g of first resin particle dispersion RL3, 45 g of colorant particle dispersion PM1, 90 g of wax particle dispersion WA9, and 500 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.8.

The pH was increased to 11.9 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 9.3. Moreover, the pH was adjusted to 3.2 by the addition of 1N HCl, and then the temperature was raised to 90° C. and the mixed dispersion was heat-treated for 2 hours to provide core particles.

After the water temperature was reduced to 60° C., the pH was adjusted to 3.4, and 165 g of second resin particle dispersion RH1 was added. This mixture was heated at 90° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M9 with a volume-average particle size of 4 μm and a coefficient of variation of 16.2.

Toner Base M10

In a 2000 ml four-neck flask were placed 204 g of first resin particle dispersion RL3, 32 g of colorant particle dispersion PM1, 40 g of wax particle dispersion WA10, and 350 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 1.9.

The pH was increased to 9.7 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 7. Moreover, the temperature was raised to 90° C. and the mixed dispersion was heat-treated for 2 hours to provide core particles.

After the water temperature was reduced to 60° C., the pH was adjusted to 7.4, and 60 g of second resin particle dispersion RH4 was added This mixture was heated at 95° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base M10 with a volume-average particle size of 6.9 μm and a coefficient of variation of 21.

Toner Base M11

In a 2000 ml four-neck flask were placed 204 g of first resin particle dispersion RL2, 40 g of colorant particle dispersion PM1, 80 g of wax particle dispersion WA1, and 500 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 2.5.

The pH was increased to 10.5 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 80° C., and then the mixture was heat-treated further for 2 hours. The resultant dispersion had a pH of 7.9. Moreover, the pH was adjusted to 6.4 by the addition of 1N HCl, and then the temperature was raised to 90° C. and the mixed dispersion was heat-treated for 2 hours to provide core particles.

After the water temperature was reduced to 60° C., the pH was adjusted to 7.2, and 130 g of second resin particle dispersion RH2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M11 with a volume-average particle size of 6.9 μm and a coefficient of variation of 17.8.

If the pH before adding the watersoluble inorganic salt and heating was less than 9.5, the core particles became coarser. If the pH was 12.5, the numbers of liberated wax or pigment particles were increased, and it was difficult to form uniform particles of the wax, the pigment, and the resin particles. If the pH of the liquid at the time of forming the core particles was more than 9.5, the numbers of liberated wax or colorant particles were increased due to poor aggregation.

After the temperature was raised from 22° C. to 70° C. at a rate of 1° C./min, and the heat-treatment was performed at 80° C. for 2 hours, if the mixed dispersion was heat-treated without adjusting the pH, or the adjusted pH was more than 6.8, the particles were likely to be slightly larger. If the pH was reduced to less than 2.2, the effect of the surface-active agent was eliminated, and the particle size was increased.

Toner Base M12

In a 2000 ml four-neck flask were placed 204 g of first resin particle dispersion RL2, 40 g of colorant particle dispersion PM1, 60 g of wax particle dispersion WA2, and 400 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 1.9.

The pH was increased to 9.7 by adding 1N NaOH to the mixed dispersion. Subsequently, 120 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 80° C., and then the mixture was heat-treated further for 2 hours. The resultant dispersion had a pH of 7.2. Moreover, the temperature was raised to 90° C. and the mixed dispersion was heat-treated for 2 hours to provide core particles.

After the water temperature was reduced to 60° C., the pH was adjusted to 3.2, and 125 g of second resin particle dispersion RH3 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M12 with a volume-average particle size of 6.2 μm and a coefficient of variation of 19.7.

Toner Base M13

In a 2000 ml four-neck flask were placed 204 g of first resin particle dispersion RL2, 33 g of colorant particle dispersion PM1, 40 g of wax particle dispersion WA3, and 300 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 2.9.

The pH was increased to 11.8 by adding 1N NaOH to the mixed dispersion. Subsequently, 90 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 80° C., and then the mixture was heat-treated further for 2 hours. The resultant dispersion had a pH of 8.4. Moreover, the pH was adjusted to 5.4 by the addition of 1N HCl, and then the temperature was raised to 90° C. and the mixed dispersion was heat-treated for 2 hours to provide core particles.

After the water temperature was reduced to 60° C., the pH was adjusted to 6.6, and 65 g of second resin particle dispersion RM5 was added. This mixture was heated at 95° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M13 with a volume-average particle size of 4.1 μm and a coefficient of variation of 19.8.

Toner Base M14

In a 2000 ml four-neck flask were placed 204 g of first resin particle dispersion RL2, 40 g of colorant particle dispersion PM1, 80 g of wax particle dispersion WA4, and 360 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 3.2.

The pH was increased to 9.8 by adding 1N NaOH to the mixed dispersion. Subsequently, 108 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 80° C., and then the mixture was heat-treated further for 2 hours. The resultant dispersion had a pH of 7.3. Moreover, the pH was adjusted to 6.2 by the addition of 1N HCl, and then the temperature was raised to 90° C. and the mixed dispersion was heat-treated for 2 hours to provide core particles.

After the water temperature was reduced to 60° C., the pH was adjusted to 6.6, and 125 g of second resin particle dispersion RH2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M14 with a volume-average particle size of 6.8 μm and a coefficient of variation of 17.8.

Toner Base M15

In a 2000 ml four-neck flask were placed 204 g of first resin particle dispersion RL2, 40 g of colorant particle dispersion PM1, 80 g of wax particle dispersion WA5, and 400 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.2.

The pH was increased to 9.7 by adding 1N NaOH to the mixed dispersion. Subsequently, 120 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 80° C., and then the mixture was heat-treated further for 2 hours. The resultant dispersion had a pH of 7. Moreover, the temperature was raised to 90° C. and the mixed dispersion was heat-treated for 2 hours to provide core particles.

After the water temperature was reduced to 60° C., the pH was adjusted to 3.2, and 125 g of second resin particle dispersion RH3 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M15 with a volume-average particle size of 6.5 μm and a coefficient of variation of 18.1.

Toner Base M16

In a 2000 ml four-neck flask were placed 204 g of first resin particle dispersion RL3, 33 g of colorant particle dispersion PM1, 30 g of wax particle dispersion WA6, and 300 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 3.8.

The pH was increased to 11.8 by adding 1N NaOH to the mixed dispersion. Subsequently, 90 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 9.2. Moreover, the pH was adjusted to 6.6 by the addition of 1N HCl, and then the temperature was raised to 90° C. and the mixed dispersion was heat-treated for 2 hours to provide core particles.

After the water temperature was reduced to 60° C., the pH was adjusted to 7.6, and 65 g of second resin particle dispersion RH5 was added. This mixture was heated at 95° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M16 with a volume-average particle size of 4.2 μm and a coefficient of variation of 20.2.

Toner Base M17

In a 2000 ml four-neck flask were placed 204 g of first resin particle dispersion RL3, 39 g of colorant particle dispersion PM1, 80 g of wax particle dispersion WA7, and 350 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 1.8.

The pH was increased to 9.7 by adding 1N NaOH to the mixed dispersion. Subsequently, 105 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 7.2. Moreover, the temperature was raised to 90° C. and the mixed dispersion was heat-treated for 2 hours to provide core particles.

After the water temperature was reduced to 60° C., the pH was adjusted to 3.4, and 120 g of second resin particle dispersion RH2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M17 with a volume-average particle size of 6.4 μm and a coefficient of variation of 18.2.

Toner Base M18

In a 2000 ml four-neck flask were placed 204 g of first resin particle dispersion RL3, 39 g of colorant particle dispersion PM1, 60 g of wax particle dispersion WA8, and 350 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 2.1.

The pH was increased to 11.2 by adding 1N NaOH to the mixed dispersion. Subsequently, 105 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 8.5. Moreover, the pH was adjusted to 5.4 by the addition of 1N HCl, and then the temperature was raised to 90° C. and the mixed dispersion was heat-treated for 2 hours to provide core particles.

After the water temperature was reduced to 60° C., the pH was adjusted to 5.5, and 120 g of second resin particle dispersion RH 3 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M18 with a volume-average particle size of 4.8 μm and a coefficient of variation of 19.2.

Toner Base M19

In a 2000 ml four-neck flask were placed 204 g of first resin particle dispersion RL3, 30 g of colorant particle dispersion PM1, 30 g of wax particle dispersion WA9, and 250 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.8.

The pH was increased to 11.9 by adding 1N NaOH to the mixed dispersion. Subsequently, 75 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 9.3. Moreover, the pH was adjusted to 3.2 by the addition of 1N HCl, and then the temperature was raised to 90° C. and the mixed dispersion was heat-treated for 2 hours to provide core particles.

After the water temperature was reduced to 60° C., the pH was adjusted to 3.4, and 40 g of second resin particle dispersion RH5 was added. This mixture was heated at 95° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M19 with a volume-average particle size of 3.9 μm and a coefficient of variation of 21.0.

Toner Base M20

In a 2000 ml four-neck flask were placed 204 g of first resin particle dispersion RL3, 39 g of colorant particle dispersion PM1, 80 g of wax particle dispersion WA 10, and 370 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 1.9.

The pH was increased to 9.7 by adding 1N NaOH to the mixed dispersion. Subsequently, 111 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 7. Moreover, the temperature was raised to 90° C. and the mixed dispersion was heat-treated for 2 hours to provide core particles.

After the water temperature was reduced to 60° C., the pH was adjusted to 7.4, and 120 g of second resin particle dispersion RH2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base with a volume-average particle size of 6.9 μm and a coefficient of variation of 18.2.

Toner Base M21

In a 2000 ml four-neck flask were placed 204 g of first resin particle dispersion RL3, 39 g of colorant particle dispersion PM2, 80 g of wax particle dispersion WA7, and 350 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.6.

The pH was increased to 9.7 by adding 1N NaOH to the mixed dispersion. Subsequently, 105 g of magnesium sulfate aqueous solution (30% concentration) was added and stirred for 10 minutes. After the temperature was raised from 20° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 7.1. Moreover, the temperature was raised to 90° C. and the mixed dispersion was heat-treated for 2 hours to provide core particles.

After the water temperature was reduced to 60° C., the pH was adjusted to 3.4, and 120 g of second resin particle dispersion RH2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base M21 with a volume-average particle size of 6.6 μm and a coefficient of variation of 17.8.

Toner Base M22

In a 2000 ml four-neck flask were placed 204 g of first resin particle dispersion rl4, 45 g of colorant particle dispersion PM1, 50 g of wax particle dispersion WA6, and 450 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 3.2.

The pH was increased to 9.7 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours, thus forming aggregated particles. At this time, the mixed dispersion had a pH of 7. Moreover, the temperature was raised to 90° C. and the mixed dispersion was heat-treated for 2 hours to provide core particles.

After the water temperature was reduced to 60° C., the pH was adjusted to 5, and 165 g of second resin particle dispersion rh1was added. This mixture was heated at 90° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base m22 with a volume-average particle size of 12.3 μm and a coefficient of variation of 25.6.

Toner Base M25

In a 2000 ml four-neck flask were placed 204 g of first resin particle dispersion RL2, 32 g of colorant particle dispersion PM1, 40 g of wax particle dispersion wa12, and 350 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.2.

The pH was increased to 10.8 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 8.1. Moreover, the pH was adjusted to 2.8 by the addition of 1N HCl, and then the temperature was raised to 90° C. and the mixed dispersion was heat-treated for 2 hours to provide core particles.

After the water temperature was reduced to 60° C., the pH was adjusted to 2.8, and 60 g of second resin particle dispersion RH4 was added. This mixture was heated at 95° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base m25 with a volume-average particle size of 18.5 μm and a coefficient of variation of 28.9.

Toner Base M26

In a 2000 ml four-neck flask were placed 204 g of first resin particle dispersion RL2, 43 g of colorant p article dispersion PM1, 50 g of wax particle dispersion wa13, and 450 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.2.

The pH was increased to 10.7 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 7.9. Moreover, the pH was adjusted to 2.8 by the addition of 1N HCl, and then the temperature was raised to 90° C. and the mixed dispersion was heat-treated for 2 hours to provide core particles.

After the water temperature was reduced to 60° C., the pH was adjusted to 8, and 150 g of second resin particle dispersion RH1 was added. This mixture was heated at 90° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base m26 with a volume-average particle size of 16.7 μm and a coefficient of variation of 38.4.

Toner Base M27

In a 2000 ml four-neck flask were placed 204 g of first resin particle dispersion rl4, 43 g of colorant particle dispersion PM1, 50 g of wax particle dispersion wa14, and 450 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 2.1.

The pH was increased to 9 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture was heat-treated further for 2 hours, thus forming aggregated particles. At this time, the mixed dispersion had a pH of 5.8. Moreover, the temperature was raised to 90° C. and the mixed dispersion was heat-treated for 2 hours to provide core particles.

After the water temperature was reduced to 60° C., the pH was adjusted to 8, and 150 g of second resin particle dispersion rh1 was added. This mixture was heated at 90° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base m27 with a volume-average particle size of 25.7 μm and a coefficient of variation of 31.8.

Toner Base M28

In a 2000 ml four-neck flask were placed 204 g of first resin particle dispersion rl5, 32 g of colorant particle dispersion PM1, 40 g of wax particle dispersion wa15, and 350 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 3.7.

The pH was increased to 12.4 by adding 1N NaOH to the mixed dispersion. Subsequently, 150 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture was heat-treated further for 2 hours, thus forming aggregated particles. At this time, the mixed dispersion had a pH of 8.4. Moreover, the temperature was raised to 90° C. and the mixed dispersion was heat-treated for 2 hours to provide core particles.

After the water temperature was reduced to 60° C., the pH was adjusted to 2.4, and 60 g of second resin particle dispersion rh4 was added. This mixture was heated at 95° C. for 3 hours, thereby providing toner base particles fused with the second binder resin. After cooling, the reaction product was filtered and washed three times with ion-exchanged water. The toner base particles thus obtained were dried at 40° C. for 6 hours, resulting in a toner base m28 with a volume-average particle size of 8.5 μm and a coefficient of variation of 42.8.

Toner Base M29

In a 2000 ml four-neck flask equipped with a thermometer and a cooling tube were placed 204 g of first resin particle dispersion RL2, 39 g of colorant particle dispersion PM1, 50 g of wax particle dispersion wa11, and 360 ml of ion-exchanged water, and then mixed for 10 minutes by using a homogenizer (Ultratalax T25 manufactured by IKA CO., LTD.). Thus, a mixed dispersion was prepared. The pH of the mixed dispersion was 3.2.

The pH was increased to 9.7 by adding 1N NaOH to the mixed dispersion. Subsequently, 108 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 80° C., and then the mixture was heat-treated further for 2 hours. The resultant dispersion had a pH of 7. Moreover, the temperature was raised to 90° C. and the mixed dispersion was heat-treated for 2 hours to provide core particles.

After the water temperature was reduced to 60° C., the pH was adjusted to 5, and 120 g of second resin particle dispersion RH2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base m29 with a volume-average particle size of 22.8 μm and a coefficient of variation of 33.8. In the toner base m29, the particles became coarser and the particle size distribution became broader.

Toner Base M31

In a 2000 ml four-neck flask equipped with a thermometer and a cooling tube were placed 204 g of first resin particle dispersion RL3, 44 g of colorant particle dispersion PM1, 50 g of wax particle dispersion wa13, and 400 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.2.

The pH was increased to 12.4 by adding 1N NaOH to the mixed dispersion. Subsequently, 120 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 8.4. Moreover, the temperature was raised to 90° C. and the dispersion was heat-treated for 2 hours to provide core particles.

After the water temperature was reduced to 60° C., the pH was adjusted to 2.4, and 160 g of second resin particle dispersion rh3 was added. This mixture was heated at 95° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base m31 with a volume-average particle size of 8.7 μm and a coefficient of variation of 40.8. In the toner base m31, secondary aggregation of the core particles was increased, and there were many small suspended particles to which no second resin particle adhered, so that the particle size distribution became broader.

Toner Base M32

In a 2000 ml four-neck flask equipped with a thermometer and a cooling tube were placed 204 g of first resin particle dispersion RL2, 32 g of colorant particle dispersion PM1, 40 g of wax particle dispersion wa14, and 300 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.2.

The pH was increased to 9 by adding 1N NaOH to the mixed dispersion. Subsequently, 90 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 80° C., and then the mixture was heat-treated further for 2 hours. The resultant dispersion had a pH of 6. Moreover, the temperature was raised to 90° C. and the dispersion was heat-treated for 2 hours to provide core particles.

After the water temperature was reduced to 60° C., the pH was adjusted to 2, and 60 g of second resin particle dispersion rh2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base m32 with a volume-average particle size of 26.8 μm and a coefficient of variation of 31.0. In the toner base m32, the particles became coarser and the particle size distribution became broader.

Toner Base M33

In a 2000 ml four-neck flask equipped with a thermometer and a cooling tube were placed 204 g of first resin particle dispersion RL3, 31 g of colorant particle dispersion PM1, 50 g of wax particle dispersion wa15, and 300 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 2.2.

The pH was increased to 12.4 by adding 1N NaOH to the mixed dispersion. Subsequently, 90 g of magnesium sulfate aqueous solution (30% concentration) was added and stirred for 10 minutes. After the temperature was raised from 22° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 8.4. Moreover, the temperature was raised to 90° C. and the dispersion was heat-treated for 2 hours to provide core particles.

After the water temperature was reduced to 60° C., the pH was adjusted to 2.4, and 50 g of second resin particle dispersion rh3 was added. This mixture was heated at 95° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base m33 with a volume-average particle size of 8.5 μm and a coefficient of variation of 40.1. In the toner base m33, secondary aggregation of the core particles was increased, and there were many small suspended particles to which no second resin particle adhered, so that the particle size distribution became broader.

Toner Base M34

In a 2000 ml four-neck flask were placed 204 g of first resin particle dispersion RL3, 39 g of colorant particle dispersion pm3, 80 g of wax particle dispersion WA7, and 350 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 3.2.

The pH was increased to 9.7 by adding 1N NaOH to the mixed dispersion. Subsequently, 105 g of magnesium sulfate aqueous solution (30% concentration) was added and stirred for 10 minutes. After the temperature was raised from 20° C. to 70° C. at a rate of 1° C./min, the mixture was heat-treated at 70° C. for 2 hours. The temperature was raised to 85° C., and then the mixture was heat-treated further for 2 hours. The resultant dispersion had a pH of 6.9. Moreover, the temperature was raised to 90° C. and the dispersion was heat-treated for 2 hours to provide core particles.

After the water temperature was reduced to 60° C., the pH was adjusted to 3.4, and 120 g of second resin particle dispersion RH2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base m34 with a volume-average particle size of 9.2 μm and a coefficient of variation of 27.8. In the toner base m34, the particle size distribution became slightly broader.

Toner Base M35

In a 2000 ml four-neck flask were placed 204 g of first resin particle dispersion RL3, 39 g of colorant particle dispersion pm4, 80 g of wax particle dispersion WA7, and 350 ml of ion-exchanged water, and then mixed for 10 minutes by using a homogenizer (Ultratalax T50 manufactured by IKA CO., LTD.). Thus, a mixed dispersion was prepared. The pH of the mixed dispersion was 3.2.

The pH was increased to 9.7 by adding 1N NaOH to the mixed dispersion. Subsequently, 105 g of magnesium sulfate aqueous solution (30% concentration) was added and stirred for 10 minutes. After the temperature was raised from 20° C. to 70° C. at a rate of 1° C./min, the mixture was heat-treated for 3 hours to provide core particles. The resultant core particle dispersion had a pH of 7.2.

After the water temperature was reduced to 60° C., the pH was adjusted to 3.4, and 120 g of second resin particle dispersion RH2 was added. This mixture was heated at 90° C. for 3 hours, thereby providing particles fused with the second resin particles. After cooling, the reaction product (toner base) was filtered and washed three times with ion-exchanged water. The toner base thus obtained was dried at 40° C. for 6 hours by using a fluid-type dryer, resulting in a toner base m35 with a volume-average particle size of 12.1 μm and a coefficient of variation of 32.6. In the toner base m35, the particles size distribution became broader.

Tables 12, 13 and 14 show the pH and temperature of the mixed dispersion and the particle size (volume average particle size) of the aggregated particles formed with respect to the treatment time in production of each of the toner bases. Table 12 shows examples of the toner bases M1 to M10 of the present invention. Table 13 shows examples of the toner bases M11 to M20 of the present invention. Table 14 shows examples of the toner bases m22 to m33 for comparison.

TABLE 12

| Toner base particles | | Treatment time (h) 0 | 1 | 2 | 3 | 4 | 5 | 6 | 7 | 8 | 9 |
|---|---|---|---|---|---|---|---|---|---|---|---|
| M1 | pH | 11.8 | | | | 9.2 | 6.4 | | 7.2 | | |
| | temperature (° C.) | | 70 | 70 | 80 | 80 | 90 | 90 | 90 | 90 | 90 |
| | d50(μm) | | 2.08 | 2.28 | 2.89 | 2.98 | 3.08 | 3.27 | 4.01 | 4.08 | 4.14 |
| M2 | pH | 9.7 | | | | 7.2 | | | 3.2 | | |
| | temperature (° C.) | | 70 | 70 | 80 | 80 | 90 | 90 | 90 | 90 | 90 |
| | d50(μm) | | 3.87 | 4.21 | 4.39 | 4.54 | 5.34 | 5.39 | 6.28 | 6.68 | 6.84 |
| M3 | pH | 11 | | | | 8.4 | 5.4 | | 6.6 | | |
| | temperature (° C.) | | 70 | 70 | 80 | 80 | 90 | 90 | 95 | 95 | 95 |
| | d50(μm) | | 2.37 | 2.45 | 3.24 | 3.34 | 3.38 | 3.38 | 4.28 | 4.29 | 4.41 |
| M4 | pH | 11.9 | | | | 9.3 | 6.2 | | 6.6 | | |
| | temperature (° C.) | | 70 | 70 | 80 | 80 | 90 | 90 | 95 | 95 | 95 |
| | d50(μm) | | 2.01 | 2.34 | 2.78 | 2.78 | 2.87 | 3.07 | 3.89 | 3.91 | 4.11 |
| M5 | pH | 9.7 | | | | 7 | | | 3.2 | | |
| | temperature (° C.) | | 70 | 70 | 85 | 85 | 90 | 90 | 90 | 90 | 90 |
| | d50(μm) | | 3.98 | 4.21 | 4.57 | 4.62 | 5.24 | 5.34 | 6.28 | 6.38 | 6.61 |
| M6 | pH | 11.8 | | | | 9.2 | 6.6 | | 7.6 | | |
| | temperature (° C.) | | 70 | 70 | 85 | 85 | 90 | 90 | 90 | 90 | 90 |
| | d50(μm) | | 2.56 | 2.68 | 2.89 | 3.01 | 3.24 | 3.34 | 4.45 | 4.68 | 4.91 |
| M7 | pH | 9.7 | | | | 7.2 | | | 3.4 | | |
| | temperature (° C.) | | 70 | 70 | 85 | 85 | 90 | 90 | 95 | 95 | 95 |
| | d50(μm) | | 3.38 | 3.45 | 3.98 | 4.12 | 4.98 | 5.38 | 6.32 | 6.45 | 6.51 |
| M8 | pH | 11.2 | | | | 8.5 | 5.4 | | 5.5 | | |
| | temperature (° C.) | | 70 | 70 | 85 | 85 | 90 | 90 | 95 | 95 | 95 |
| | d50(μm) | | 2.87 | 3.42 | 3.54 | 3.67 | 3.78 | 3.82 | 4.81 | 4.89 | 5.01 |
| M9 | pH | 11.9 | | | | 9.3 | 3.2 | | 3.4 | | |
| | temperature (° C.) | | 70 | 70 | 85 | 85 | 90 | 90 | 90 | 90 | 90 |
| | d50(μm) | | 2.04 | 2.41 | 2.52 | 2.63 | 2.78 | 2.89 | 3.87 | 3.98 | 4.02 |
| M10 | pH | 9.7 | | | | 7 | | | 7.4 | | |
| | temperature (° C.) | | 70 | 70 | 85 | 85 | 90 | 90 | 95 | 95 | 95 |
| | d50(μm) | | 3.07 | 4.08 | 4.38 | 4.68 | 5.45 | 5.68 | 6.78 | 6.89 | 6.94 |

TABLE 13

| Toner base particles | | Treatment time (h) 0 | 1 | 2 | 3 | 4 | 5 | 6 | 7 | 8 | 9 |
|---|---|---|---|---|---|---|---|---|---|---|---|
| M11 | pH | 10.5 | | | | 7.9 | 6.4 | | 7.2 | | |
| | temperature (° C.) | | 70 | 70 | 80 | 80 | 90 | 90 | 90 | 90 | 90 |
| | d50(μm) | | 3.78 | 4.23 | 4.89 | 5.14 | 5.28 | 5.54 | 6.74 | 6.64 | 6.91 |
| M13 | pH | 11.8 | | | | 8.4 | 5.4 | | 6.6 | | |
| | temperature (° C.) | | 70 | 70 | 80 | 80 | 90 | 90 | 95 | 95 | 95 |
| | d50(μm) | | 2.01 | 2.21 | 2.48 | 2.87 | 3.01 | 3.14 | 3.98 | 4.01 | 4.11 |
| M15 | pH | 9.7 | | | | 7 | | | 3.2 | | |
| | temperature (° C.) | | 70 | 70 | 80 | 80 | 90 | 90 | 90 | 90 | 90 |
| | d50(μm) | | 3.78 | 4.12 | 4.61 | 4.72 | 5.14 | 5.24 | 6.34 | 6.45 | 6.52 |
| M16 | pH | 11.8 | | | | 9.2 | 6.6 | | 7.6 | | |
| | temperature (° C.) | | 70 | 70 | 85 | 85 | 90 | 90 | 95 | 95 | 95 |
| | d50(μm) | | 2.14 | 2.54 | 2.71 | 2.78 | 2.84 | 2.89 | 4.1 | 4.12 | 4.22 |
| M17 | pH | 9.7 | | | | 7.2 | | | 3.4 | | |
| | temperature (° C.) | | 70 | 70 | 85 | 85 | 90 | 90 | 90 | 90 | 90 |
| | d50(μm) | | 3.28 | 3.48 | 3.89 | 4.11 | 4.89 | 5.28 | 6.35 | 6.41 | 6.42 |
| M18 | pH | 11.2 | | | | 8.5 | 5.4 | | 5.5 | | |
| | temperature (° C.) | | 70 | 70 | 85 | 85 | 90 | 90 | 90 | 90 | 90 |
| | d50(μm) | | 2.78 | 3.12 | 3.31 | 3.52 | 3.61 | 3.65 | 4.78 | 4.82 | 4.84 |

TABLE 13-continued

| Toner base particles | | Treatment time (h) 0 | 1 | 2 | 3 | 4 | 5 | 6 | 7 | 8 | 9 |
|---|---|---|---|---|---|---|---|---|---|---|---|
| M19 | pH | 11.9 | | | | 9.3 | 3.2 | | 3.4 | | |
| | temperature (° C.) | | 70 | 70 | 85 | 85 | 90 | 90 | 95 | 95 | 95 |
| | d50(μm) | | 2.01 | 2.12 | 2.34 | 2.48 | 2.54 | 2.68 | 3.81 | 3.89 | 3.91 |
| M20 | pH | 9.7 | | | | 7 | | | 7.4 | | |
| | temperature (° C.) | | 70 | 70 | 85 | 85 | 90 | 90 | 90 | 90 | 90 |
| | d50(μm) | | 3.28 | 4.18 | 4.39 | 4.61 | 5.42 | 5.59 | 6.74 | 6.84 | 6.91 |

TABLE 14

| Toner base particles | | Treatment time (h) 0 | 1 | 2 | 3 | 4 | 5 | 6 | 7 | 8 | 9 |
|---|---|---|---|---|---|---|---|---|---|---|---|
| m22 | pH | 9.7 | | | | 7 | | | 5 | | |
| | temperature (° C.) | | 70 | 70 | 80 | 80 | 90 | 90 | 90 | 90 | 90 |
| | d50(μm) | | 4.21 | 4.68 | 5.28 | 6.45 | 7.58 | 9.28 | 11.2 | 11.58 | 12.31 |
| m23 | pH | 12.4 | | | | 8.4 | | | 2.4 | | |
| | temperature (° C.) | | 70 | 70 | 85 | 85 | 90 | 90 | 95 | 95 | 95 |
| | d50(μm) | | 2.12 | 2.21 | 2.31 | 2.32 | 2.41 | 2.54 | 2.87 | 3.15 | 3.34 |
| m24 | pH | 9 | | | | 6 | | | 2 | | |
| | temperature (° C.) | | 70 | 70 | 80 | 80 | 90 | 90 | 90 | 90 | 90 |
| | d50(μm) | | 3.37 | 4.68 | 6.48 | 6.58 | 7.89 | 8.29 | 13.58 | 16.87 | 21.21 |
| m25 | pH | 10.8 | | | | 8.1 | 2.8 | | 2.8 | | |
| | temperature (° C.) | | 70 | 70 | 85 | 85 | 90 | 90 | 95 | 95 | 95 |
| | d50(μm) | | 3.29 | 3.68 | 4.28 | 5.89 | 6.21 | 6.45 | 10.28 | 14.89 | 18.52 |
| m26 | pH | 10.7 | | | | 7.9 | 2.8 | | 8 | | |
| | temperature (° C.) | | 70 | 70 | 85 | 85 | 90 | 90 | 90 | 90 | 90 |
| | d50(μm) | | 2.68 | 2.98 | 3.54 | 3.78 | 4.45 | 4.68 | 9.87 | 12.48 | 16.72 |
| m27 | pH | 9 | | | | 5.8 | | | 8 | | |
| | temperature (° C.) | | 70 | 70 | 80 | 80 | 90 | 90 | 90 | 90 | 90 |
| | d50(μm) | | 5.28 | 5.98 | 6.87 | 8.79 | 9.78 | 11.58 | 15.98 | 21.8 | 25.7 |
| m28 | pH | 12.4 | | | | 8.4 | | | 2.4 | | |
| | temperature (° C.) | | 70 | 70 | 85 | 85 | 90 | 90 | 95 | 95 | 95 |
| | d50(μm) | | 1.89 | 2.12 | 2.28 | 2.37 | 2.41 | 2.47 | 5.48 | 6.87 | 8.51 |
| m29 | pH | 9.7 | | | | 7 | | | 5 | | |
| | temperature (° C.) | | 70 | 70 | 80 | 80 | 90 | 90 | 90 | 90 | 90 |
| | d50(μm) | | 4.12 | 4.58 | 5.38 | 5.98 | 7.45 | 7.68 | 11.2 | 17.8 | 22.8 |
| m30 | pH | 9 | | | | 6 | | | 2 | | |
| | temperature (° C.) | | 70 | 70 | 80 | 80 | 90 | 90 | 90 | 90 | 90 |
| | d50(μm) | | 3.89 | 4.35 | 5.28 | 5.87 | 6.54 | 7.98 | 11.8 | 15.8 | 20.4 |
| m31 | pH | 12.4 | | | | 8.4 | | | 2.4 | | |
| | temperature (° C.) | | 70 | 70 | 85 | 85 | 90 | 90 | 95 | 95 | 95 |
| | d50(μm) | | 2.01 | 2.24 | 2.65 | 2.78 | 3.98 | 4.87 | 6.78 | 6.98 | 8.71 |
| m32 | pH | 9 | | | | 6 | | | 2 | | |
| | temperature (° C.) | | 70 | 70 | 80 | 80 | 90 | 90 | 90 | 90 | 90 |
| | d50(μm) | | 4.42 | 4.89 | 5.78 | 6.98 | 8.57 | 9.98 | 15.97 | 21.8 | 26.8 |
| m33 | pH | 12.4 | | | | 8.4 | | | 2.4 | | |
| | temperature (° C.) | | 70 | 70 | 85 | 85 | 90 | 90 | 95 | 95 | 95 |
| | d50(μm) | | 1.89 | 2.12 | 2.28 | 2.64 | 4.21 | 5.68 | 6.89 | 8.41 | 8.51 |

In the toner base M1 of the present invention, as can be seen from Table 12, the volume average particle size of the aggregated particles is increased gradually from 2.08 μm to 3.27 μm during the process of producing the core particles for a treatment dime of 1 to 6 hours. Thereafter, in the process of forming the resin fused layer (for a treatment time of 7 to 9 hours), the volume average particle size is in the range of 4.01 μm to 4.14 μm, i.e., maintained substantially constant. Thus, it is evident that the aggregated particles do not become coarser.

As described above, the coefficient of variation indicates the degree of expansion of the volume-based particle size distribution of the toner base particles in the toner base. The coefficients of variation of the toner bases M1 to M20 of the present invention are relatively small.

The comparative toner bases m22 to m35 in Table 11 have a large coefficient of variation, which indicates that the particle size varies considerably, and the particle size distribution is broad.

As described above, the particle size of each of the toner bases M1 to M20 of the present invention is maintained substantially constant in the period of time between the formation of the core particles and the formation of the toner base particles having the resin fused layer, in which the second binder resin is fused with the core particles. Therefore, the molten aggregated particles that serve as toner base particles do not become coarser. This makes it possible to provide toner base particles having a small, substantially uniform particle size without requiring a classification process.

On the other hand, in the comparative toner bases m22 to m35, the molten aggregated particles that should be toner base particles are coarse or too small, and the aggregation is unstable. Therefore, it is not possible to provide toner base particles having a small, substantially uniform particle size without requiring a classification process.

Although the above examples of producing the toner base have been described for magenta toner, the toner bases of black, cyan, and yellow can be produced in the same manner as the magenta toner except that PB1, PC1, and PY1 are used as pigments, respectively.

(5) Additive

Table 15 shows the materials and characteristics of each of additives (S1, S2, S3, S4, S5, S6, S7, S8 and S9) used in this example. In Table 13, the "5-minute value" and the "30-minute value" representing the charge amount ([μC/g]) were measured by a blow-off method using frictional charge with an uncoated ferrite carrier. Specifically, under the environmental conditions of 25° C. and 45% RH, 50 g of carrier and 0.1 g of silica or the like were mixed in a 100 ml polyethylene container, and then stirred by vertical rotation at a speed of 100 $min^{-1}$ for 5 minutes and 30 minutes, respectively. Thereafter, 0.3 g of sample was taken for each stirring time, and a nitrogen gas was blown on the samples at $1.96\times10^4$ [Pa] for 1 minute. It is preferable that the 5-minute value is −100 to −800 μC/g and the 30-minute value is −50 to −600 μC/g for the negative chargeability. Silica having a high charge amount can function well in a small quantity.

10 parts by weight of the treatment material were mixed with 100 parts by weight of the additive particles. The mixing weight ratio of the treatment materials A and B is shown in parentheses.

TABLE 16

| | Configuration | | | |
|---|---|---|---|---|
| | | Additive | | |
| Toner | Toner base | Additive A | Additive B | Additive C |
| TM1 | M1 | S1(0.6) | S3(2.5) | None |
| TM2 | M2 | S2(1.8) | S4(1.5) | None |
| TM3 | M3 | S1(1.8) | S5(1.2) | None |
| TM4 | M4 | S2(2.5) | None | None |
| TM5 | M5 | S1(2.0) | S6(2.0) | None |
| TM6 | M6 | S2(1.8) | S7(3.5) | None |
| TM7 | M7 | S1(0.6) | S8(2.0) | None |
| TM8 | M8 | S1(0.6) | S7(3.5) | S7(1.5) |
| TM9 | M9 | S1(0.6) | S6(2.0) | S7(1.5) |
| TM10 | M10 | S2(1.8) | S7(3.5) | None |
| TM11 | M11 | S1(0.6) | S3(2.5) | None |
| TM12 | M12 | S2(1.8) | S4(1.5) | None |
| TM13 | M13 | S1(1.8) | S5(1.2) | None |
| TM14 | M14 | S2(2.5) | None | None |
| TM15 | M15 | S1(2.0) | S6(2.0) | None |
| TM16 | M16 | S2(1.8) | S7(3.5) | None |
| TM17 | M17 | S1(0.6) | S8(2.0) | None |
| TM18 | M18 | S1(0.6) | S7(3.5) | S7(1.5) |
| TM19 | M19 | S1(0.6) | S6(2.0) | S7(1.5) |
| TM20 | M20 | S2(1.8) | S7(3.5) | None |
| TM21 | M21 | S1(0.6) | S8(2.0) | None |

TABLE 15

| | Material | | | Various characteristics | | | | | | | |
|---|---|---|---|---|---|---|---|---|---|---|---|
| | | Surface treatment material | | | | | | | | | |
| Inorganic fine powder | Material | Treatment material A | Treatment material B | Particle size (nm) | Methanol titration (%) | Moisture absorption | Ignition loss (wt %) | Drying loss (wt %) | 5-min value (μC/g) | 30-min value (μC/g) | 5-min/ 30-min value |
| S1 | Silica | Silica treated with dimethylpolysiloxane | | 6 | 88 | 0.1 | 10.5 | 0.2 | −820 | −710 | 86.59 |
| S2 | Silica | Silica treated with methyl hydrogen polysiloxane | | 16 | 88 | 0.1 | 5.5 | 0.2 | −560 | −450 | 80.36 |
| S3 | Silica | Methyl hydrogen polysiloxane (1) | | 40 | 88 | 0.1 | 10.8 | 0.2 | −580 | −480 | 82.76 |
| S4 | Silica | Dimethylpolysiloxane (20) | Aluminum distearate (2) | 40 | 84 | 0.09 | 24.5 | 0.2 | −740 | −580 | 78.38 |
| S5 | Silica | Methyl hydrogen polysiloxane (1) | Stearic acid amide (1) | 40 | 88 | 0.1 | 10.8 | 0.2 | −580 | −480 | 82.76 |
| S6 | Silica | Dimethylpolysiloxan (2) | Fatty acid pentaerythritol monoester (1) | 80 | 88 | 0.12 | 15.8 | 0.2 | −620 | −475 | 76.61 |
| S7 | Silica | Methyl hydrogen polysiloxane (1) | | 150 | 89 | 0.10 | 6.8 | 0.2 | −580 | −480 | 82.76 |
| S8 | Titanium oxide | Diphenylpolysiloxan (10) | Sodium stearate (1) | 80 | 88 | 0.1 | 18.5 | 0.2 | −750 | −650 | 86.67 |
| S9 | Silica | Silica treated with hexamethyldisilazane | | 16 | 68 | 0.60 | 1.6 | 0.2 | −800 | −620 | 77.50 |

(6) Toner Composition and Addition Treatment

Next, examples of the toner composition and the addition treatment will be described. Table 16 shows the composition of materials for each of magenta toners (TM1, TM2, TM3, TM4, TM5, TM6, TM7, TM8, TM9, TM10, TM11, TM12, TM13, TM14, TM15, TM16, TM17, TM18, TM19, TM20 and 21) of the present invention that were prepared as examples of producing the toner. Table 17 shows the composition of materials for each of magenta toners (tm22, tm23, tm24, tm25, tm26, tm27, tm28, tm29, tm30, tm31, tm32, tm33, tm34 and tm35) for comparison. In Tables 16 and 17, the values in parentheses after the additives indicate the amount (parts by weight) of the additive per 100 parts by weight of the toner base.

TABLE 17

| | Configuration | | | |
|---|---|---|---|---|
| | | Additive | | |
| Toner | Toner base | Additive A | Additive B | Additive C |
| tm22 | m22 | S2(1.0) | None | None |
| tm23 | m23 | S2(1.0) | None | None |
| tm24 | m24 | S9(0.5) | None | None |
| tm25 | m25 | S9(0.5) | None | None |
| tm26 | m26 | S9(0.5) | None | None |
| tm27 | m27 | S9(0.5) | None | None |
| tm28 | m28 | S9(0.5) | None | None |
| tm29 | m29 | S2(1.0) | None | None |
| tm30 | m30 | S2(1.0) | None | None |

TABLE 17-continued

| | Configuration | | | |
|---|---|---|---|---|
| | | Additive | | |
| Toner | Toner base | Additive A | Additive B | Additive C |
| tm31 | m31 | S9(0.5) | None | None |
| tm32 | m32 | S9(0.5) | None | None |
| tm33 | m33 | S9(0.5) | None | None |
| tm34 | m34 | S9(0.5) | None | None |
| tm35 | m35 | S9(0.5) | None | None |

The addition treatment of the toner was performed by using a Henschel mixer FM20B with a Z0S0-type mixer blade, an input amount of 1 kg, a number of revolutions of 2000 $min^{-1}$, and a treating time of 5 minutes.

Although the above examples have been described for magenta toner, the material composition and the addition treatment of the other black, cyan, and yellow toners are the same as the magenta toner except that PB1, PC1, and PY1 are used as pigments, respectively.

Example of Image Forming Apparatus

Next, an example of an image forming apparatus will be described. FIG. 1 is a cross-sectional view showing the configuration of a full color image forming apparatus used in this example. In FIG. 1, the outer housing of a color electrophotographic printer is not shown. A transfer belt unit 17 includes a transfer belt 12, a first color (yellow) transfer roller 10Y, a second color (magenta) transfer roller 10M, a third color (cyan) transfer roller 10C, a fourth color (black) transfer roller 10K, a driving roller 11 made of aluminum, a second transfer roller 14 made of an elastic body, a second transfer follower roller 13, a belt cleaner blade 16 for cleaning a toner image that remains on the transfer belt 12, and a roller 15 located opposite to the belt cleaner blade 16. The first to fourth color transfer rollers 10Y, 10M, 10C, and 10K are made of an elastic body. A distance between the first color (Y) transfer position and the second color (M) transfer position is 70 mm (which is the same as a distance between the second color (M) transfer position and the third color (C) transfer position and a distance between the third color (C) transfer position and the fourth color (K) transfer position). The circumferential velocity of a photoconductive member is 125 mm/s.

The transfer belt 12 can be obtained by kneading a conductive filler in an insulating resin and making a film with an extruder. In this example, polycarbonate resin (e.g., European Z300 manufactured by Mitsubishi Gas Kagaku Co., Ltd.) was used as the insulating resin, and 5 parts by weight of conductive carbon (e.g., "KETJENBLACK") were added to 95 parts by weight of the polycarbonate resin to form a film. The surface of the film was coated with a fluorocarbon resin. The film had a thickness of about 100 μm, a volume resistance of $10^7$ to $10^{12}$ Ω·cm, and a surface resistance of $10^7$ to $10^{12}$ Ω/□ (square). The use of this film can improve the dot reproducibility and prevent slackening of the transfer belt 12 over a long period of use or charge accumulation effectively. By coating the film surface with a fluorocarbon resin, the filming of toner on the surface of the transfer belt 12 due to a long period of use also can be suppressed effectively. If the volume resistance is less than $10^7$ Ω·cm, retransfer is likely to occur. If the volume resistance is more than $10^{12}$ Ω·cm, the transfer efficiency is degraded.

A first transfer roller 10 is a conductive polyurethane foam including carbon black and has an outer diameter of 8 mm. The resistance value is $10^2$ to $10^6$Ω. In the first transfer operation, the first transfer roller 10 is pressed against a photoconductive member 1 with a force of about 1.0 to 9.8 (N) via the transfer belt 12, so that the toner is transferred from the photoconductive member 1 to the transfer belt 12. If the resistance value is less than $10^2$Ω, retransfer is likely to occur. If the resistance value is more than $10^6$Ω, a transfer failure is likely to occur. The force less than 1.0 (N) may cause a transfer failure, and the force more than 9.8 (N) may cause transfer voids. The second transfer roller 14 is a conductive polyurethane foam including carbon black and has an outer diameter of 10 mm. The resistance value is $10^2$ to $10^6$Ω. The second transfer roller 14 is pressed against the follower roller 13 via the transfer belt 12 and a transfer medium 19 such as a paper or OHP sheet. The follower roller 13 is rotated in accordance with the movement of the transfer belt 12. In the second transfer operation, the second transfer roller 14 is pressed against the follower roller 13 with a force of 5.0 to 21.8 (N), so that the toner is transferred from the transfer belt 12 to the transfer medium 19. If the resistance value is less than $10^2$Ω, retransfer is likely to occur. If the resistance value is more than $10^6$Ω, a transfer failure is likely to occur. The force less than 5.0 (N) may cause a transfer failure, and the force more than 21.8 (N) may increase the load and generate jitter easily.

Four image forming units 18Y, 18M, 18C, and 18K for yellow (Y), magenta (M), cyan (C), and black (K) are arranged in series, as shown in FIG. 1.

The image forming units 18Y, 18M, 18C, and 18K have the same components except for a developer contained therein. For simplification, only the image forming unit 18Y for yellow (Y) will be described, and an explanation of the other units will not be repeated.

The image forming unit is configured as follows. Reference numeral 1 is a photoconductive member, 3 is pixel laser signal light, and 4 is a developing roller of aluminum that has an outer diameter of 10 mm and includes a magnet with a magnetic force of 1200 gauss. The developing roller 4 is located opposite to the photoconductive member 1 with a gap of 0.3 mm between them, and rotates in the direction of the arrow. A stirring roller 6 stirs toner and a carrier in a developing unit and supplies the toner to the developing roller 4. The mixing ratio of the toner to the carrier is read from a permeability sensor (not shown), and the toner is supplied timely from a toner hopper (not shown). A magnetic blade 5 is made of metal and controls a magnetic brush layer of a developer on the developing roller 4. In this example, 150 g of developer was introduced, and the gap was 0.4 mm. Although a power supply is not shown in FIG. 1, a direct voltage of −500 V and an alternating voltage of 1.5 kV (p-p) at a frequency of 6 kHz were applied to the developing roller 4. The circumferential velocity ratio of the photoconductive member 1 to the developing roller 4 was 1:1.6. The mixing ratio of the toner to the carrier was 93:7. The amount of developer in the developing unit was 150 g.

A charging roller 2 is made of epichlorohydrin rubber and has an outer diameter of 10 mm. A direct-current bias of −1.2 kV is applied to the charging roller 2 for charging the surface of the photoconductive member 1 to −600 V. Reference numeral 8 is a cleaner, 9 is a waste toner box, and 7 is a developer.

A paper is conveyed from the lower side of the transfer belt unit 17, and a paper conveying path is formed so that a paper 19 is transported by a paper feed roller (not shown) to a nip portion where the transfer belt 12 and the second transfer roller 14 are pressed against each other.

The toner is transferred from the transfer belt 12 to the paper 19 by +1000 V applied to the second transfer roller 14, and then is conveyed to a fixing portion in which the toner is fixed. The fixing portion includes a fixing roller 201, a pressure roller 202, a fixing belt 203, a heat roller 204, and an induction heater 205.

Figure 2:
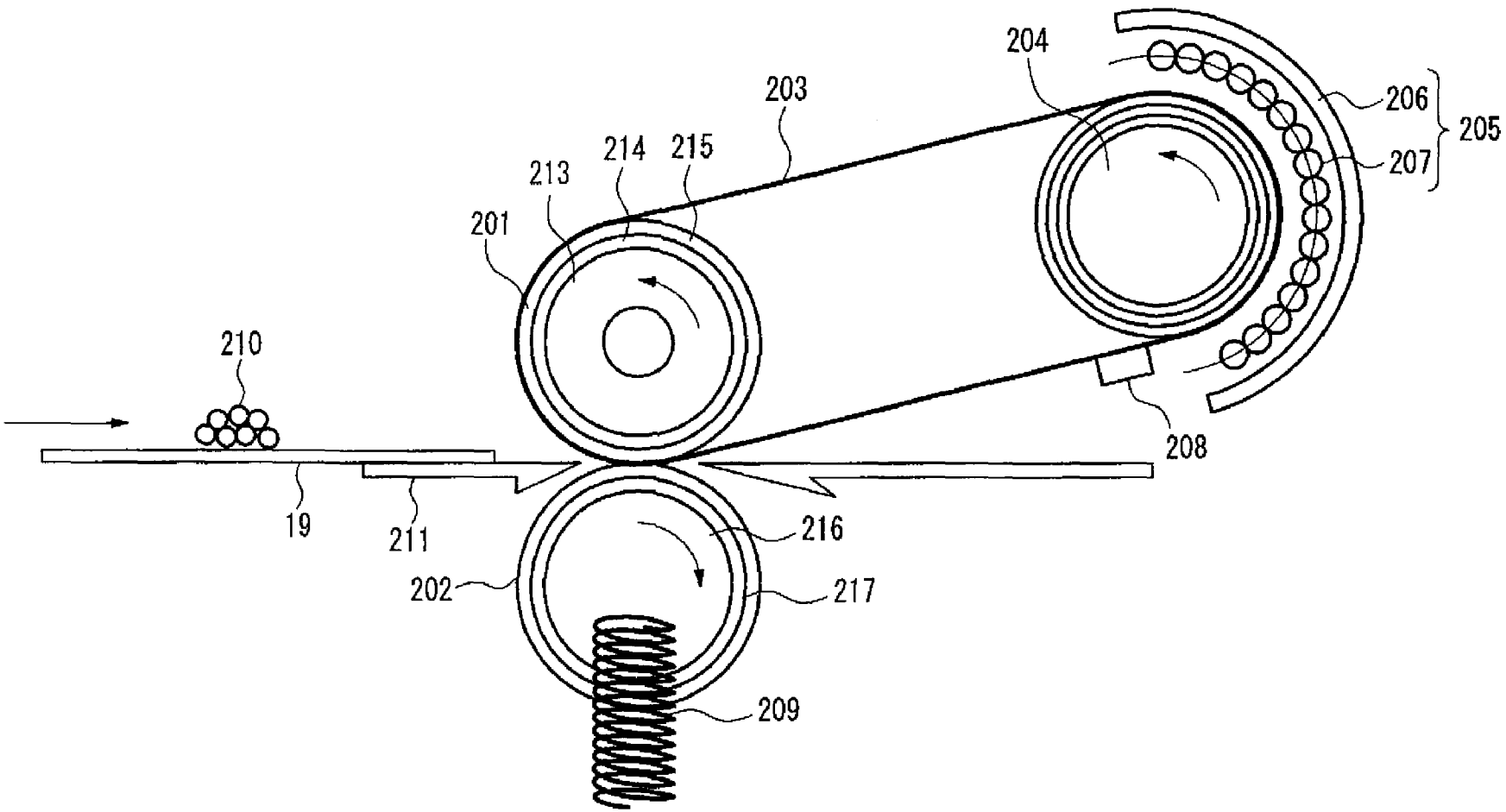
FIG. 2 is a cross-sectional view showing the configuration of a fixing unit used in an example of the present invention.

FIG. 2 shows a fixing process. A belt 203 runs between the fixing roller 201 and the heat roller 204. A predetermined load is applied between the fixing roller 201 and the pressure roller 202 so that a nip is formed between the belt 203 and the pressure roller 202. The induction heater 205 including a ferrite core 206 and a coil 207 is provided on the periphery of the heat roller 204, and a temperature sensor 208 is arranged on the outer surface.

The belt 203 is formed by arranging a Ni substrate (30 μm), silicone rubber (150 μm), and PFA (tetrafluoroethylene-perfluoroalkyl vinyl ether copolymer) (30 μm) in layers.

The pressure roller 202 is pressed against the fixing roller 201 by a spring 209. A recording material 19 with the toner 210 is moved along a guide plate 211.

The fixing roller 201 (fixing member) includes a hollow core 213, an elastic layer 214 formed on the hollow core 213, and a silicone rubber layer 215 formed on the elastic layer 214. The hollow core 213 is made of aluminum and has a length of 250 mm, an outer diameter of 14 mm, and a thickness of 1 mm. The elastic layer 214 is made of silicone rubber with a rubber hardness (JIS-A) of 20 degrees based on the JIS standard and has a thickness of 3 mm. The silicone rubber layer 215 has a thickness of 3 mm. Therefore, the outer diameter of the fixing roller 201 is about 26 mm. The fixing roller 201 is rotated at 125 mm/s with a driving force from a driving motor (not shown).

The heat roller 204 includes a hollow pipe having a thickness of 1 mm and an outer diameter of 20 mm. The surface temperature of the fixing belt is controlled to 170° C. by using a thermistor.

The pressure roller 202 (pressure member) has a length of 250 mm and an outer diameter of 20 mm, and includes a hollow core 216 and an elastic layer 217 formed on the hollow core 216. The hollow core 216 is made of aluminum and has an outer diameter of 16 mm and a thickness of 1 mm. The elastic layer 217 is made of silicone rubber with a rubber hardness (JIS-A) of 55 degrees based on the JIS standard and has a thickness of 2 mm. The pressure roller 202 is mounted rotatably, and a 5.0 mm width nip is formed between the pressure roller 202 and the fixing roller 201 under a one-sided load of 147N from the spring 209.

The operations will be described below. In the full color mode, all the first transfer rollers 10 of Y, M, C, and K are lifted and pressed against the respective photoconductive members 1 of the image forming units via the transfer belt 12. At this time, a direct-current bias of +800 V is applied to each of the first transfer rollers 10. An image signal is transmitted through the laser beam 3 and enters the photoconductive member 1 whose surface has been charged by the charging roller 2, thus forming an electrostatic latent image. The electrostatic latent image formed on the photoconductive member 1 is made visible by the toner on the developing roller 4 that is rotated in contact with the photoconductive member 1.

In this case, the image formation rate (125 mm/s, which is equal to the circumferential velocity of the photoconductive member) of the image forming unit 18Y is set so that the speed of the photoconductive member is 0.5 to 1.5% slower than the traveling speed of the transfer belt 12.

In the image forming process, signal light 3Y is input to the image forming unit 18Y, and an image is formed with Y toner. At the same time as the image formation, the Y toner image is transferred from the photoconductive member 1Y to the transfer belt 12 by the action of the first transfer roller 10Y, to which a direct voltage of +800 V is applied.

There is a time lag between the first transfer of the first color (Y) and the first transfer of the second color (M). Then, signal light 3M is input to the image forming unit 18M, and an image is formed with M toner. At the same time as the image formation, the M toner image is transferred from the photoconductive member 1M to the transfer belt 12 by the action of the first transfer roller 10M. In this case, the M toner is transferred onto the first color (Y) toner that has been formed on the transfer belt 12. Subsequently, the C (cyan) toner and K (black) toner images are formed in the same manner and transferred by the action of the first transfer rollers 10C and 10K. Thus, YMCK toner images are formed on the transfer belt 12. This is a so-called tandem process.

A color image is formed on the transfer belt 12 by superimposing the four color toner images in registration. After the last transfer of the K toner image, the four color toner images are transferred collectively to the paper 19 fed by a feeding cassette (not shown) at matched timing by the action of the second transfer roller 14. In this case, the follower roller 13 is grounded, and a direct voltage of +1 kV is applied to the second transfer roller 14. The toner images transferred to the paper 19 are fixed by a pair of fixing rollers 201 and 202. Then, the paper 19 is ejected through a pair of ejecting rollers (not shown) to the outside of the apparatus. The toner that is not transferred and remains on the transfer belt 12 is cleaned by the belt cleaner blade 16 to prepare for the next image formation.

Example of Visual Image Evaluation

Next, an example of evaluating visual images with toner and a two-component developer will be described. Using an image forming apparatus, running durability tests with 100,000 sheets of A4 paper were conducted for each of various types of two-component developers that differed in a mixing ratio of the toner to the carrier, and the charge amount and the image density were measured. Moreover, background fog in a non-image portion, the uniformity of a solid image, the transfer properties (skipping in characters during transfer, reverse transfer, and transfer voids), and toner filming of the output samples were evaluated. The charge amount was measured by a blow-off method using frictional charge with a ferrite carrier. Specifically, under the environmental conditions of 25° C. and 45% RH, 0.3 g of sample was taken to evaluate the durability, and a nitrogen gas was blown on the sample at $1.96\times10^4$ Pa for 1 minute.

Table 18 shows the compositions of the toner and the carrier as the two-component developer, and the results of evaluation of the running durability test with 100,000 sheets of A4 paper for each of two-component developers (DM1, DM2, DM3, DM4, DM5, DM6, DM7, DM8, DM9, DM10, DM11, DM12, DM13, DM14, DM15, DM16, DM17, DM18, DM19, DM20 and DM21) of the present invention and two-component developers (cm22, cm23, cm24, cm25, cm26, cm27, cm28, cm29, cm30, cm31, cm32, cm33, cm34 and cm35) for comparison. These two-component developers were used in this example. In Table 18, "○" indicates that the evaluation was good, and "X" indicates that there were some problems.

TABLE 18

| | Configuration | | Evaluation 1 | | | | | | | |
|---|---|---|---|---|---|---|---|---|---|---|
| Developer | Toner | Carrier | Filming on photoconductive member | Image density (ID) initial/after test | | Fog | Uniformity of solid image | Transfer skipping in characters | Reverse transfer | Transfer voids |
| DM1 | TM1 | A1 | Not occur | 1.45 | 1.44 | ○ | ○ | ○ | ○ | ○ |
| DM2 | TM2 | B1 | Not occur | 1.48 | 1.45 | ○ | ○ | ○ | ○ | ○ |
| DM3 | TM3 | C1 | Not occur | 1.50 | 1.52 | ○ | ○ | ○ | ○ | ○ |
| DM4 | TM4 | A2 | Not occur | 1.35 | 1.32 | ○ | ○ | ○ | ○ | ○ |
| DM5 | TM5 | A1 | Not occur | 1.46 | 1.42 | ○ | ○ | ○ | ○ | ○ |
| DM6 | TM6 | B1 | Not occur | 1.44 | 1.41 | ○ | ○ | ○ | ○ | ○ |
| DM7 | TM7 | C1 | Not occur | 1.49 | 1.42 | ○ | ○ | ○ | ○ | ○ |
| DM8 | TM8 | A2 | Not occur | 1.36 | 1.32 | ○ | ○ | ○ | ○ | ○ |
| DM9 | TM9 | C1 | Not occur | 1.47 | 1.42 | ○ | ○ | ○ | ○ | ○ |
| DM10 | TM10 | A2 | Not occur | 1.39 | 1.33 | ○ | ○ | ○ | ○ | ○ |
| DM11 | TM11 | A1 | Not occur | 1.43 | 1.41 | ○ | ○ | ○ | ○ | ○ |
| DM12 | TM12 | B1 | Not occur | 1.45 | 1.42 | ○ | ○ | ○ | ○ | ○ |
| DM13 | TM13 | C1 | Not occur | 1.51 | 1.51 | ○ | ○ | ○ | ○ | ○ |
| DM14 | TM14 | A2 | Not occur | 1.34 | 1.34 | ○ | ○ | ○ | ○ | ○ |
| DM15 | TM15 | A1 | Not occur | 1.42 | 1.40 | ○ | ○ | ○ | ○ | ○ |
| DM16 | TM16 | B1 | Not occur | 1.45 | 1.42 | ○ | ○ | ○ | ○ | ○ |
| DM17 | TM17 | C1 | Not occur | 1.50 | 1.47 | ○ | ○ | ○ | ○ | ○ |
| DM18 | TM18 | A2 | Not occur | 1.34 | 1.31 | ○ | ○ | ○ | ○ | ○ |
| DM19 | TM19 | C1 | Not occur | 1.48 | 1.45 | ○ | ○ | ○ | ○ | ○ |
| DM20 | TM20 | A2 | Not occur | 1.35 | 1.32 | ○ | ○ | ○ | ○ | ○ |
| DM21 | TM21 | C1 | Occur | 1.48 | 1.41 | ○ | ○ | ○ | ○ | ○ |
| cm22 | tm22 | d3 | Occur | 1.39 | 1.19 | X | X | X | X | X |
| cm23 | tm23 | a1 | Occur | 0.89 | 0.80 | X | X | X | X | X |
| cm24 | tm24 | d2 | Occur | Difficult to evaluate | | X | X | X | X | X |
| cm25 | tm25 | d3 | Occur | 1.39 | 1.11 | X | X | X | X | X |
| cm26 | tm26 | a1 | Occur | 1.35 | 1.04 | X | X | X | X | X |
| cm27 | tm27 | A1 | Occur | Difficult to evaluate | | X | X | X | X | X |
| cm28 | tm28 | A1 | Occur | 1.45 | 1.21 | X | X | X | X | X |
| cm29 | tm29 | d3 | Occur | 1.42 | 1.52 | X | X | X | X | X |
| cm30 | tm30 | a1 | Occur | 1.34 | 1.48 | X | X | X | X | X |
| cm31 | tm31 | d2 | Occur | 0.72 | 0.75 | X | X | X | X | X |
| cm32 | tm32 | d3 | Occur | 1.11 | 1.02 | X | X | X | X | X |
| cm33 | tm33 | a1 | Occur | 0.87 | 0.72 | X | X | X | X | X |
| cm34 | tm34 | A1 | Occur | 1.42 | 1.44 | ○ | X | X | X | X |
| cm35 | tm35 | A1 | Occur | 1.41 | 1.38 | ○ | X | X | X | X |

For all the two-component developers DM1 to DM21 of the present invention, toner fling on the photoconductive member was not a problem for practical use after the running durability test with 100,000 sheets of A4 paper. The toner filming on the transfer belt also was not a problem for practical use. Moreover, a cleaning failure of the transfer belt did not occur. In the case of a full color image formed by superimposing three colors, a paper was not wound around the fixing belt. With respect to the image density before and after the running durability test, high-resolution images having a density of 1.3 or more were obtained by each of the two-component developers DM1 to DM21 of the present invention. Even after the durability test with 100,000 sheets of A4 paper, the flowability of the two-component developers was stable, and the image density was 1.3 or more and not changed much. With respect to fog and solid image uniformity, the image density was high, and there was neither background fog in the non-image portion nor toner scattering, so that high resolution was achieved. The solid images in development also had good uniformity.

Moreover, no streak occurred in the images over continuous use. There was almost no spent of the toner components on the carrier. Both a change in carrier resistance and a decrease in charge amount were suppressed. When the solid images were developed continuously, and then the toner was supplied quickly the charge build-up property was good. Fog was not increased under high humidity conditions.

For all the two-component developers of the present invention, the transfer properties such as skipping in characters during transfer, reverse transfer, and transfer voids were not a problem for practical use, and no transfer defect occurred in the full color image consisting of three superimposed colors. The transfer efficiency was about 95%.

Even if the mixing ratio of the toner to the carrier was changed by 5 to 20 wt %, the two-component developers DM1 to DM21 of the present invention changed little in image density and image quality such as background fog. Thus, the toner concentration was controlled widely.

On the other hand, toner filming on the photoconductive member occurred in some of the comparative two-component developers cm22 to cm35 during the running durability test. With respect to the image density before and after the running durability test, the image density was low or reduced due to an increase in charge amount over a long period of use. When the solid images were developed continuously, and then the toner was supplied quickly, the charge was decreased, and fog was increased. This phenomenon became worse, particularly under high humidity conditions. Moreover, when the mixing ratio of the toner to the carrier was in the range of 6 to 8 wt %, the image density and the image quality such as background fog were changed little, even if the toner concentration was changed. However, the image density was reduced as the mixing ratio was smaller than this range, while the background fog was increased as the mixing ratio was larger than this range.

Next, an example of the evaluation of the fixability, offset resistance, high-temperature storage stability, and winding of paper around the fixing belt of a full color image will be described, In this case, a solid image was fixed in an amount of 1.2 mg/cm$^2$ at a process speed of 125 mm/s by using a fixing device provided with an oilless belt, and the OHP film transmittance fixing temperature: 160° C.), the minimum fixing temperature, and the temperature at which high-temperature offset occurs were measured. As to the storage stability, the state of the toner was evaluated after being left standing at 55° C. for 24 hours. The OHP film transmittance was measured with 700 nm light by using a spectrophotometer (U-3200 manufactured by Hitachi, Ltd.).

Table 19 shows the results of the evaluation of the fixability, offset resistance, high-temperature storage stability, and winding of paper around the fixing belt of a full color image. In Table 19, "○" indicates that the evaluation was good, and "X" indicates that there were some problems.

TABLE 19

| | Evaluation 2 | | | | |
|---|---|---|---|---|---|
| Toner | OHP transmittance (%) | Minimum fixing temperature (° C.) | High-temperature offset generation temperature (° C.) | Storage stability test | Winding around fixing belt |
| TM1 | 88.9 | 125 | 210 | ○ | Not occur |
| TM2 | 87.9 | 130 | 210 | ○ | Not occur |
| TM3 | 82.7 | 135 | 220 | ○ | Not occur |
| TM4 | 83.2 | 135 | 220 | ○ | Not occur |
| TM5 | 87.4 | 130 | 220 | ○ | Not occur |
| TM6 | 86.7 | 130 | 220 | ○ | Not occur |
| TM7 | 83.5 | 135 | 220 | ○ | Not occur |
| TM8 | 82.1 | 140 | 230 | ○ | Not occur |
| TM9 | 80.2 | 140 | 230 | ○ | Not occur |
| TM10 | 80.1 | 140 | 230 | ○ | Not occur |
| TM11 | 88.9 | 125 | 210 | ○ | Not occur |
| TM12 | 87.9 | 130 | 210 | ○ | Not occur |
| TM13 | 82.7 | 135 | 220 | ○ | Not occur |
| TM14 | 83.2 | 135 | 220 | ○ | Not occur |
| TM15 | 87.4 | 130 | 220 | ○ | Not occur |
| TM16 | 86.7 | 130 | 220 | ○ | Not occur |
| TM17 | 83.5 | 135 | 220 | ○ | Not occur |
| TM18 | 82.1 | 140 | 230 | ○ | Not occur |
| TM19 | 80.2 | 140 | 230 | ○ | Not occur |
| TM20 | 80.1 | 140 | 230 | ○ | Not occur |
| tm22 | 92.5 | 130 | 150 | X | Occur |
| tm23 | 40.1 | 200 | 230 | ○ | Not occur |

TABLE 19-continued

| | Evaluation 2 | | | | |
|---|---|---|---|---|---|
| Toner | OHP transmittance (%) | Minimum fixing temperature (° C.) | High-temperature offset generation temperature (° C.) | Storage stability test | Winding around fixing belt |
| tm24 | 78.9 | 150 | 200 | ○ | Not occur |
| tm25 | 70.5 | 150 | 210 | X | Occur |
| tm26 | 68.7 | 140 | 180 | X | Occur |
| tm27 | 70.2 | 140 | 150 | X | Occur |
| tm28 | 45.8 | 190 | 230 | ○ | Not occur |
| tm29 | 92.5 | 130 | 150 | X | Occur |
| tm30 | 40.1 | 200 | 230 | ○ | Not occur |
| tm31 | 78.9 | 150 | 200 | ○ | Not occur |
| tm32 | 70.5 | 150 | 210 | X | Occur |
| tm33 | 68.7 | 140 | 180 | X | Occur |

All the toners TM1 to TM20 of this example exhibited good fixability, since the OHP film transmittance was 80% or more. The offset resistance temperature range was increased by using the fixing roller without oil. Moreover, the fixable temperature range (from the minimum fixing temperature to the temperature at which high-temperature offset occurs) was wide. No offset occurred in the test of image formation on 200,000 sheets of plain paper. Even if a silicone or fluorine-based fixing belt was used without oil, the surface of the belt did not wear. Moreover, agglomeration hardly was observed in the storage stability test of 55° C. for 24 hours.

On the other hand, for fixability, the OHP film transmittance was low in some of the comparative toners tm22 to tm33. With respect to the offset resistance, a margin of the fixable temperature range was narrow. That is, the minimum fixing temperature was increased, while the offset generation temperature was decreased, resulting in low offset resistance. In many cases, the comparative toners had poor storage stability.

Next, an example of the evaluation of glossiness will be described. In this example, the glossiness of a solid image portion at each fixing temperature in the fixable temperature range was measured. The glossiness was measured with a Gloss Checker IG-320 (manufactured by Horiba, Ltd.).

Table 20 shows the glossiness of a solid image portion at each fixing temperature in the fixable temperature range.

TABLE 20

| | Glossiness Fixing Temperature C. ° | | | | | | | | | | | | |
|---|---|---|---|---|---|---|---|---|---|---|---|---|---|
| Toner | 120 | 125 | 130 | 135 | 140 | 150 | 160 | 170 | 180 | 190 | 200 | 210 | 220 |
| TM1 | | 18.7 | 18.9 | 20.4 | 21.9 | 22.4 | 22.9 | 23.4 | 23.8 | 24.9 | 25.1 | 25.2 | |
| TM2 | | | 19.7 | 19.8 | 21.3 | 21.4 | 22.1 | 22.5 | 23.4 | 24.5 | 24.6 | 25.1 | |
| TM3 | | | | 12.5 | 12.6 | 12.4 | 13.4 | 13.8 | 14.9 | 15.2 | 16.1 | 18.9 | 20.4 |
| TM4 | | | | 11.5 | 12.5 | 13.5 | 14.2 | 14.3 | 14.6 | 15.1 | 16.8 | 17.2 | 17.9 |
| TM5 | | | 18.9 | 19.8 | 20.1 | 22.4 | 23.4 | 23.8 | 24.6 | 26.4 | 26.8 | 26.8 | 28.7 |
| TM6 | | | 19.8 | 20.1 | 22.1 | 23.1 | 23.5 | 23.6 | 23.4 | 24.9 | 25.9 | 26.9 | 27.8 |
| TM7 | | | | 11.5 | 12.5 | 12.6 | 12.8 | 13.1 | 14.5 | 15.1 | 15.9 | 16.7 | 17.9 |
| TM8 | | | | | 12.8 | 13.5 | 14.8 | 15.2 | 15.3 | 15.2 | 16.7 | 16.8 | 17.2 |
| TM9 | | | | | 11.2 | 11.5 | 12.4 | 13.4 | 13.8 | 14.5 | 14.6 | 16.8 | 18.9 |
| TM10 | | | | | 9.8 | 10.2 | 11.3 | 12.4 | 12.8 | 13.4 | 13.8 | 14.9 | 16.7 |
| tm22 | | | 15.8 | 16.8 | 22.1 | 25.9 | | | | | | | |
| tm23 | | | | | | | | | | | 8.9 | 12.4 | 14.5 |
| tm24 | | | | | | 12.5 | 14.8 | 16.7 | 17.4 | 21.5 | 22.5 | | |
| tm25 | | | | | | 9.8 | 11.5 | 12.8 | 14.8 | 16.7 | 19.8 | 23.8 | |
| tm26 | | | | | 8.9 | 11.2 | 12.8 | 14.9 | 18.9 | | | | |
| tm27 | | | | | 18.9 | 22.5 | | | | | | | |
| tm28 | | | | | | | | | | 6.8 | 8.9 | 13.4 | 16.8 |

The toners TM1 to TM10 of the present invention showed the characteristics that a difference in the image glossiness was small in a wide range of fixing temperatures. On the other hand, the image glossiness of the comparative toners tm22 to tm28 increased with the fixing temperature, and the change in glossiness was large, namely, a so-called "shiny" image was generated.

As described above, when a resin particle dispersion in which binder resin particles are dispersed, a colorant particle dispersion in which colorant particles are dispersed, and a wax particle dispersion in which wax particles (release agent) are dispersed are mixed in an aqueous medium, and then heated so that the particles are aggregated to form toner base particles, the present invention can eliminate the presence of wax and colorant particles that are not aggregated but suspended in the aqueous medium. Therefore, molten aggregated particles (i.e., the toner base particles) do not become coarser, even if the wax is added. Thus, the toner base particles can have a small, substantially uniform particle size without requiring a classification process. By using a low melting point wax and a high melting point wax together, the present invention also can ensure both the melting performance (that allows the toner to melt at low temperatures for low-temperature fixing) and the aggregation performance (that prevents high-temperature offset and coagulation of the toner during storage). Accordingly while low-temperature fixing can be achieved, high-temperature offset can be suppressed without the application of fixing oil. The present invention can produce a toner that does not deteriorate by spent when it is used as a two-component developer.

INDUSTRIAL APPLICABILITY

The present invention is useful not only for an electrophotographic system including a photoconductive member, but also for a printing system in which the toner adheres directly on paper or the toner including a conductive material is applied on a substrate as a wiring pattern.

The invention claimed is:

1. A toner, comprising:

toner base particles that are obtained by adding a second resin particle dispersion in which second resin particles are dispersed to aggregated particles and heating the resultant mixture so that the second resin particles are fused with the aggregated particles, the aggregated particles being obtained by mixing in an aqueous medium at least a resin particle dispersion in which resin particles are dispersed, a colorant particle dispersion in which colorant particles are dispersed, and a wax particle dispersion in which wax particles are dispersed and heating the mixed dispersion so that the particles are aggregated, wherein a gel permeation chromatography (GPC) measurement of the resin particles forming the aggregated particles shows that a weight-average molecular weight (Mw1) is 10000 to 60000, and a ratio (Mw1/Mn1) of the weight-average molecular weight (Mw1) to a number-average molecular weight (Mn1) is 1.5 to 6, wherein a gel permeation chromatography (GPC) measurement of the second resin particles shows that a number-average molecular weight (Mn) is 9000 to 30000, a weight-average molecular weight (Mw) is 50000 to 300000, and a ratio (Mw/Mn) of the weight-average molecular weight (Mw) to the number-average molecular weight (Mn) is 2 to 10, and wherein the wax particles comprise at least a first wax and a second wax, the first wax has an endothermic peak temperature (melting point Tmw1) of 55° C. to 85° C. based on a differential scanning calorimetry (DSC) method and comprises a wax having an iodine value of not more than 25 and a saponification value of 30 to 300 or an ester wax that includes at least one of higher alcohol having a carbon number of 16 to 24 and higher fatty acid having a carbon number of 16 to 24, a second wax comprises an aliphatic hydrocarbon wax, and a relationship between an endothermic peak temperature (melting point Tmw2) of the second wax based on the DSC method and Tmw1 is expressed as $$5+Tmw1(^\circ C.) \leqq Tmw2(^\circ C.) \leqq 50+Tmw1(^\circ C.).$$

2. The toner according to claim 1, wherein the resin particles have a glass transition point (Tg2(° C.)) of 45° C. to 55° C. and a softening point (Ts2(° C.)) of 90° C. to 140° C.

3. The toner according to claim 1, wherein the endothermic peak temperature of the second wax based on the DSC method is 80° C. to 120° C.

4. The toner according to claim 1, wherein the wax particle dispersion is produced by mixing, emulsifying, and dispersing the first wax and the second wax.

5. The toner according to claim 4, wherein the wax particle dispersion is produced by mixing, emulsifying, and dispersing the first wax and the second wax with a surface-active agent that includes a nonionic surface-active agent as a main component.

6. The toner according to claim 1, wherein a FT2 to ES1 ratio (FT2/ES1) of the wax particles is 0.2 to 10 where ES1 and FT2 are weight ratios of the first wax and the second wax to 100 parts by weight of the wax in the wax particle dispersion, respectively.

7. The toner according to claim 1, wherein a main component of a surface-active agent used for the resin particle dispersion is a nonionic surface-active agent, a main component of a surface-active agent used for the wax particle dispersion is a nonionic surface-active agent, and a main component of a surface-active agent used for the colorant particle dispersion is a nonionic surface-active agent.

8. The toner according to claim 1, wherein a surface-active agent used for the resin particle dispersion is a mixture of a nonionic surface-active agent and an ionic surface-active agent, the nonionic surface-active agent is 60 to 95 wt % with respect to the total surface-active agent, and a surface-active agent used for the wax particle dispersion is a nonionic surface-active agent.

9. The toner according to claim 1, wherein the toner has a volume-average particle size of 3 μm to 7 μm, a content of toner base particles having a particle size of 2.52 μm to 4 μm in a number distribution is 10% to 75% by number, the toner base particles having a particle size of 4 μm to 6.06 μm in a volume distribution is 25% to 75% by volume, the toner base particles having a particle size of not less than 8 μm in the volume distribution is not more than 5% by volume, and P46/V46 is in a range of 0.5 to 1.5 where V46 is a volume percentage of the toner base particles having a particle size of 4 μm to 6.06 μm in the volume distribution and P46 is a number percentage of the toner base particles having a particle size of 4 μm to 6.06 μm in the number distribution.

* * * * *